US007043169B2

(12) United States Patent
Ito et al.

(10) Patent No.: US 7,043,169 B2
(45) **Date of Patent: *May 9, 2006**

(54) METHOD, DEVICE, SYSTEM AND RECORDING MEDIUM FOR DETECTING IMPROPER CARTRIDGE, AND CARTRIDGE

(75) Inventors: Yoshihiro Ito, Tokyo (JP); Kazuo Okoyama, Tokyo (JP); Takeshi Watanabe, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/179,530

(22) Filed: Jul. 13, 2005

(65) Prior Publication Data

US 2005/0249510 A1 Nov. 10, 2005

Related U.S. Application Data

(62) Division of application No. 10/885,710, filed on Jul. 8, 2004, which is a division of application No. 10/678,315, filed on Oct. 6, 2003, now Pat. No. 6,853,814, which is a division of application No. 09/675,129, filed on Sep. 29, 2000, now Pat. No. 6,658,219.

(30) Foreign Application Priority Data

| | | |
|---|---|---|
| Sep. 30, 1999 | (JP) | 11-280464 |
| Sep. 30, 1999 | (JP) | 11-280465 |
| Oct. 25, 1999 | (JP) | 11-303029 |
| Oct. 26, 1999 | (JP) | 11-304121 |
| Nov. 25, 1999 | (JP) | 11-333718 |

(51) Int. Cl.
*G03G 15/08* (2006.01)
*G03G 21/16* (2006.01)
*G03G 15/00* (2006.01)

(52) U.S. Cl. ..... 399/27; 399/25; 399/111

(58) Field of Classification Search ..... 399/12, 399/24, 27, 109, 9, 30, 111, 25; 347/19
See application file for complete search history.

(56) References Cited

U.S. PATENT DOCUMENTS 4,961,088 A 10/1990 Gilliland et al.

(Continued)

FOREIGN PATENT DOCUMENTS

JP 63-212956 A 9/1988

(Continued)

*Primary Examiner*—Susan Lee
(74) *Attorney, Agent, or Firm*—Sughrue Mion, PLLC

(57) ABSTRACT

A cartridge is set in a printer main unit, and has a remaining toner measurer which measures toner in a toner chamber upon setting of the cartridge. A cartridge memory stores information of a remaining toner amount measured previously. CPU compares the remaining toner amount measured newly with the remaining toner amount measured previously and read from the cartridge memory. If there is an increase in the toner, the cartridge is determined as improper cartridge reloaded with the toner. An alarm signal is generated. Also, printing is inhibited. In another preferred embodiment, shortage information is assigned to the cartridge upon using up the toner. The cartridge, if it has the shortage information, is determined as improper. If a characteristic of the toner is not within a reference range, the cartridge is determined improper. In another preferred embodiment, an upper limit of the number of times of toner reloading is predetermined. The cartridge is determined improper if the reloading time number comes up to the upper limit. The improper cartridge is set in a state in which operation is inhibited. Also, when the cartridge is disassembled, the improper cartridge is inhibited from operating.

60 Claims, 31 Drawing Sheets

U.S. PATENT DOCUMENTS

| | | | | |
|---|---|---|---|---|
| 4,974,238 | A | | 11/1990 | Kobayashi et al. |
| 5,008,711 | A | | 4/1991 | Sakamoto et al. |
| 5,012,286 | A | | 4/1991 | Kawano et al. |
| 5,132,729 | A | | 7/1992 | Matsushita et al. |
| 5,146,269 | A | | 9/1992 | Shimizu et al. |
| 5,218,407 | A | | 6/1993 | Matsushita et al. |
| 5,223,896 | A | | 6/1993 | Shimizu et al. |
| 5,229,824 | A | | 7/1993 | Tsusaka et al. |
| 5,283,597 | A | | 2/1994 | Yoshida et al. |
| 5,452,059 | A | | 9/1995 | Seikya |
| 5,579,088 | A | | 11/1996 | Ko |
| 5,596,390 | A | | 1/1997 | Sawada et al. |
| 5,690,893 | A | | 11/1997 | Ozawa et al. |
| 5,708,912 | A | | 1/1998 | Lee |
| 5,802,419 | A | | 9/1998 | Sakurai et al. |
| 5,822,647 | A | | 10/1998 | Sakuraba et al. |
| 5,860,363 | A | * | 1/1999 | Childers et al. |
| 5,923,922 | A | | 7/1999 | Ishida et al. |
| 5,926,665 | A | | 7/1999 | Suzuki |
| 5,926,666 | A | | 7/1999 | Miura et al. |
| 5,995,774 | A | * | 11/1999 | Applegate et al. ..... 399/276 |
| 6,014,531 | A | * | 1/2000 | Ebata et al. |
| 6,070,958 | A | | 6/2000 | Kanome |
| 6,112,036 | A | | 8/2000 | Shinohara |
| 6,118,466 | A | | 9/2000 | Lee |
| 6,151,041 | A | | 11/2000 | Bolash et al. |
| 6,158,837 | A | | 12/2000 | Hilton et al. |
| 6,163,660 | A | | 12/2000 | Maeshima et al. |
| 6,188,852 | B1 | | 2/2001 | Ojima et al. |
| 6,205,060 | B1 | * | 3/2001 | Sanda et al. |
| 6,227,638 | B1 | * | 5/2001 | Childers et al. ..... 347/19 |
| 6,229,970 | B1 | | 5/2001 | Onimura et al. |
| 6,266,492 | B1 | | 7/2001 | Macchara |
| 6,275,664 | B1 | | 8/2001 | Wolf et al. |
| 6,334,658 | B1 | | 1/2002 | Suzuki |
| 6,338,539 | B1 | | 1/2002 | Kobayashi et al. |
| 6,343,193 | B1 | | 1/2002 | Matsumoto et al. |
| 6,385,407 | B1 | | 5/2002 | Inose |
| 6,459,861 | B1 | | 10/2002 | Sakurai et al. |

FOREIGN PATENT DOCUMENTS

| | | | |
|---|---|---|---|
| JP | 64-057272 | | 3/1989 |
| JP | 64-063177 | A | 3/1989 |
| JP | 1-134471 | | 5/1989 |
| JP | 3-225381 | A | 4/1991 |
| JP | 3-152569 | A | 6/1991 |
| JP | 4-139471 | A | 5/1992 |
| JP | 4-240661 | | 8/1992 |
| JP | 4-362961 | A | 12/1992 |
| JP | 4-371965 | | 12/1992 |
| JP | 5-53384 | A | 5/1993 |
| JP | 5-197224 | A | 6/1993 |
| JP | 05-210304 | | 8/1993 |
| JP | 5-210304 | A | 8/1993 |
| JP | 05-224479 | | 9/1993 |
| JP | 5-249830 | A | 9/1993 |
| JP | 6-075442 | A | 3/1994 |
| JP | 6-102759 | A | 4/1994 |
| JP | 6-149051 | | 5/1994 |
| JP | 7-28320 | | 1/1995 |
| JP | 8-197748 | A | 8/1996 |
| JP | 8-202238 | | 8/1996 |
| JP | 8-244314 | A | 9/1996 |
| JP | 8-248861 | | 9/1996 |
| JP | 9-114334 | | 5/1997 |
| JP | 9-120238 | | 5/1997 |
| JP | 9-120246 | A | 5/1997 |
| JP | 09-169123 | A | 6/1997 |
| JP | 9-190121 | A | 7/1997 |
| JP | 9-212045 | | 8/1997 |
| JP | 9-213407 | A | 8/1997 |
| JP | 10-26917 | A | 1/1998 |
| JP | 10-039693 | | 2/1998 |
| JP | 10-069139 | | 3/1998 |
| JP | 10-133528 | A | 5/1998 |
| JP | 10-133529 | A | 5/1998 |
| JP | 10-133544 | A | 5/1998 |
| JP | 10-161411 | | 6/1998 |
| JP | 10-240101 | | 9/1998 |
| JP | 11-126008 | A | 5/1999 |
| JP | 11-296022 | A | 10/1999 |
| JP | 2002-214985 | A | 7/2002 |

* cited by examiner

METHOD, DEVICE, SYSTEM AND RECORDING MEDIUM FOR DETECTING IMPROPER CARTRIDGE, AND CARTRIDGE

This is a divisional of application Ser. No. 10/885,710, filed Jul. 8, 2004, which is a divisional of application Ser. No. 10/678,315 filed Oct. 6, 2003, which is a divisional of application Ser. No. 09/675,129, filed Sep. 29, 2000 and now U.S. Pat. No. 6,658,219; the disclosures of which are incorporated herein by reference.

BACKGROUND OF THE INVENTION

1. Field of the Invention

The present invention relates to a cartridge for containing expendable material adapted to image recording, and for being set in an image recorder device, such as a printer, telefacsimile machine, duplicator or the like. More particularly, the present invention relates to a method, device, system and recording medium for detecting improper cartridge for detecting improper cartridge and inhibiting a user of the same.

The improper cartridge is defined as the cartridge not suitable for the image recorder device. Examples of the improper cartridge are one in which expendable material is used up, one loaded again with the expendable material, the cartridge being disassembled, the cartridge different from a genuine type, and the like. If reloading of the expendable material is reloaded for a plurality of times, the cartridge becomes the improper cartridge when the number of times of reloading the cartridge with the expendable material comes up to an upper limit. There are plural examples of the expendable material different between kinds of the image recorder device with which the cartridge is loaded. If the cartridge is for use with an electrophotographic type of the printer, then the expendable material is toner. If in an ink jet printer, the expendable material is ink. If in a thermal printer, the expendable material is ink ribbon.

2. Description Related to the Prior Art

In an electrophotographic type of the printer, a laser scanning optical system is incorporated, and used with a toner cartridge loaded with toner as developing medium. In the toner cartridge, a predetermined amount of the toner is accommodated. The toner cartridge is set in the printer in an exchangeable manner. The use of the toner cartridge makes it unnecessary to use a supply bottle for supplying a toner chamber of the printer with the toner. It follows that a user s hands or clothes are free from being contaminated with the toner. Also, operation of supply of the toner is very simple because of a renewal of the toner cartridge.

As an extensive form of the toner cartridge, a process cartridge is also known, and has a structure with a photoreceptor drum, a charger roller, a developer roller, a cleaning structure and the like. The process cartridge is loaded with toner at an amount determined in consideration of a lifetime of the photoreceptor drum and the other elements, which can be renewed at the same time as the renewal of the toner. This is advantageous in simplicity in maintaining operation. The process cartridge makes it unnecessary for a user to have a contract with a dealer or agent for periodical maintenance. So the process cartridge is widely used with the printer of a personal type.

In both of the toner cartridge and process cartridge, an indicator is caused to indicate shortage of toner when a remaining amount of the toner decreases to an amount insufficient for printing, which is disclosed in the prior art portion of JP-A 07-028320. Then the toner cartridge or process cartridge is replaced with a new cartridge. The state of the shortage is detected by measuring a remaining toner amount in a remaining toner measurer. The remaining toner measurer has a structure including a light source and a photo sensor both disposed in a cartridge chamber for setting of the cartridge. Two lateral walls of the cartridge are provided with respectively transparent windows, through which light from the light source becomes incident upon the photo sensor. When the remaining toner amount of the toner is still much, light from the light source is blocked by the toner, to decrease an output of the photo sensor. When the remaining toner amount of the toner decreases, the output of the photo sensor increases. Accordingly, it is judged that shortage of the toner occurs when the output of the photo sensor comes up to a predetermined lower limit.

A printer manufacturer supplies plural types of genuine cartridges for respectively types of printers. The cartridge from the printer manufacturer is handled by a dealer before being sold to a user. A used cartridge without toner is returned to the dealer and then withdrawn by the printer manufacturer. To recycle the cartridge, the printer manufacturer disassembles the cartridge, inspects various parts, and reuses normal parts among them. Plastic parts from the cartridge are melted and pelletized, and recycled as material to be molded again. The recycle of the cartridge is advantageous in reducing a cost of the cartridge.

It is likely that a part of numerous used cartridges are sent to a reloading agent. The reloading agent receives a user s request, disassembles the cartridge and reloads it with toner to meet the user s request. Furthermore, some reloading agent buys numerous used cartridges, reloads them with the toner and sells the regenerated cartridges at a considerably lower cost than that of the genuinely shipped cartridges being unused.

In the genuine cartridge, toner of the genuine type is contained and has appropriate characteristics. The toner of the genuine type has a composition determined in consideration of processing characteristics of the printer, including a characteristic of a photoreceptor drum, a charging voltage, a cleaning characteristic and a fixing characteristic. The toner used by the reloading agent, however, has a composition different from that of the genuine type, and is likely to lower printing quality. Also, the toner is likely to stick to a fixer roller to damage the fixer roller.

The unauthorized loading of toner causes a drop in the image quality or a breakage of the printer. However, users are likely to suppose that a problem occurs in the printer to lower the image quality or cause a breakage without awareness of the problem of the toner. Thus, reputation to the quality of the printer is lost seriously no matter how high the reputation of the printer manufacturer of the printer has been raised. The most critical users may discontinue using or buying all products manufactured by the printer manufacturer.

To maintain ensured reputation of the printer, it is necessary to apply various countermeasures against causes for low quality in the image. Reloading of expendable material such as toner and ink should be prevented. The reuse of the improper cartridge reloaded with the expendable material should be avoided.

To prevent reloading of expendable material, JP-A 07-028320 discloses a use of the process cartridge including a counter and an electromagnetic brake. The counter counts the number of produced prints. The electromagnetic brake blocks rotation of the developer roller. A used amount of the toner is measured indirectly according to the number of prints. When the number of the prints comes up to a reference number, it is estimated that shortage of the toner has occurred. Then the electromagnetic brake is actuated. Rotation of the developer roller is blocked by the electromagnetic brake, to inhibit the use of the process cartridge. Once the toner decreases to at most a predetermined limit, the process cartridge cannot be used irrespective of existence or lack of addition of the toner. As a result, the process cartridge, containing a sufficient amount of the toner but in which the electromagnetic brake operates, is determined as improper, because reloaded with the toner.

However, the technique according to JP-A 07-028320 has a problem. Before the electromagnetic brake operates, a certain amount of toner remains. If the cartridge is loaded with the toner in a manner of partial reloading, the process cartridge becomes reusable in an unexpected manner. Furthermore, there are differences in the number of letters between prints. If the remaining amount of the toner is estimated according to the number of the prints, the result of the estimating the remaining toner amount may be different from an accurate value. Even when there remains a considerable amount of the toner, the electromagnetic brake may operate to inhibit the use of the process cartridge. This results in waste of the resource.

In the known technique for preventing reloading of expendable material, the electromagnetic brake is required in the process cartridge, which must have a complicated and large structure and have a high cost. Furthermore, a reloading agent or other persons can visually understand the state of operating the electromagnetic brake. The reloading agent is ready to eliminate the electromagnetic brake or release the process cartridge from operation of the electromagnetic brake for the purpose of disassembling the process cartridge. Thus, the electromagnetic brake is not sufficiently effective for preventing reloading.

There is a known example of the process cartridge in which cartridge parts, including the photoreceptor drum, charger roller and developer roller, are improved to have a longer lifetime. It is conceivable to recycle the process cartridge by adding toner in a reloading manner. However, there occurs a problem in lowering the image quality with time due to the repeated use of the cartridge parts. This is because the cartridge parts are used for a considerably long time by repeated supply of the toner. There is no consideration for determining the lifetime of the cartridge according to durability of the cartridge parts.

SUMMARY OF THE INVENTION

In view of the foregoing problems, an object of the present invention is to provide a method, device and system for detecting improper cartridge, of which examples are the cartridge reloaded with expendable material, the cartridge in which the expendable material has been used up, the cartridge being disassembled, the cartridge different from a genuine type, the cartridge of which the number of times of reloading the expendable material has come up to at least a reference number, and the like, for the purpose of preventing the use of the improper cartridge. Another object of the present invention is to provide a cartridge suitable for the method, device and system, and recording medium for storing a program for being run in the method, device and system.

Another object of the present invention is to provide a method, device, system and recording medium for detecting improper cartridge, in which the improper cartridge can be prevented from being used in the image recorder device.

Still another object of the present invention is to provide a method, device, system and recording medium for detecting improper cartridge, in which remaining amount of expendable material is measured accurately to use the expendable material fully without waste.

Another object of the present invention is to provide a method, device, system and recording medium for detecting improper cartridge easily and at a lost cost without complicating a structure of the cartridge.

A further object of the present invention is to provide a method, device, system and recording medium for detecting improper cartridge, in which an operation inhibited state of the cartridge has a not externally observable appearance, to avoid undoing the operation inhibited state easily.

Another object of the present invention is to provide a method, device, system and recording medium for detecting improper cartridge, in which the use of the cartridge at the lapse of its lifetime is avoided by limiting the number of times of reloading the cartridge with expendable material.

In order to achieve the above and other objects and advantages of this invention, a remaining amount of expendable material contained in a cartridge is measured, and compared with the remaining amount of the expendable material measured previously. If there is an increase in the remaining amount of the expendable material, the cartridge is determined as an improper cartridge which has been reloaded with the expendable material. Upon determination of the improper cartridge, an alarm indicator, such as a lamp, buzzer, display panel or the like, is driven. Image recording in an image recorder is inhibited with the improper cartridge. The remaining amount of the expendable material measured previously is written to a cartridge memory or a printer memory. In the case of the printer memory, the remaining amount of the expendable material is stored with discernment information for discernment of the cartridge, such as a cartridge ID.

According to a preferred embodiment, shortness information representing shortage of the shortness information is assigned to the cartridge when shortage occurs in the expendable material in the cartridge. According to existence or lack of the shortness information, it is checked whether the cartridge is the improper cartridge or not. The shortness information is written to the cartridge memory, or to the printer memory with the cartridge ID.

According to another preferred embodiment, a characteristic of the expendable material contained in the cartridge is measured. If the characteristic is not within a reference range, the cartridge is determined as the improper cartridge reloaded with the expendable material.

According to another preferred embodiment, a recording time number of times of reloading the cartridge with the expendable material is counted or estimated. If the recording time number has come up to a reference number, then the cartridge is determined as the improper cartridge. When a reloading detector generates an output signal, the recording time number is stepped incrementally by one (1). The recording time number of the expendable material is written to the cartridge memory, or to the printer memory with the cartridge ID.

According to a further preferred embodiment, the cartridge is determined as the improper cartridge if the expendable material in the cartridge decreases to at most a reference amount. Upon determining of the impropriety, the cartridge is inhibited from operating. If the cartridge is disassembled to reload the cartridge with the expendable material, the cartridge is determined as the improper cartridge, and inhibited from operating. Furthermore, disassembly information is assigned to the cartridge if the cartridge is disassembled. When the disassembly information exists, an alarm signal is generated. Image recording is inhibited.

The cartridge includes the cartridge memory for storing information representing impropriety of the improper cartridge, for example the remaining amount of the expendable material, the shortness information, the characteristic, the recording time number, the disassembly information or the cartridge discernment information. Also, a recording medium according to the invention stores a program for determining the improper cartridge and a program for disabling the improper cartridge from operating. Those programs are installed in a printer.

By the construction of the present invention, the improper cartridge can be discerned as reloaded with the expendable material, because an increase in the expendable material is checked. Also, the remaining amount of the expendable material can be monitored because measured precisely. The use of the improper cartridge can be prevented reliably and easily, because of indication of alarm information or inhibiting image recording. There is no change in the appearance of the cartridge even upon occurrence of the improper state. There is no erroneous repair like a case of an electromagnetic brake.

In the present embodiment, existence or lack of the shortness information makes it possible to check the improper cartridge reliably, because the shortness information is assigned to the cartridge short of the expendable material. Also, the improper cartridge can checked easily and reliably, because the characteristic of the expendable material is measured to recognize reloading of the expendable material. Furthermore, the use of the improper cartridge can be inhibited, because disassembly of the cartridge is detected to disable the cartridge from operating according to a signal from the reloading detector.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
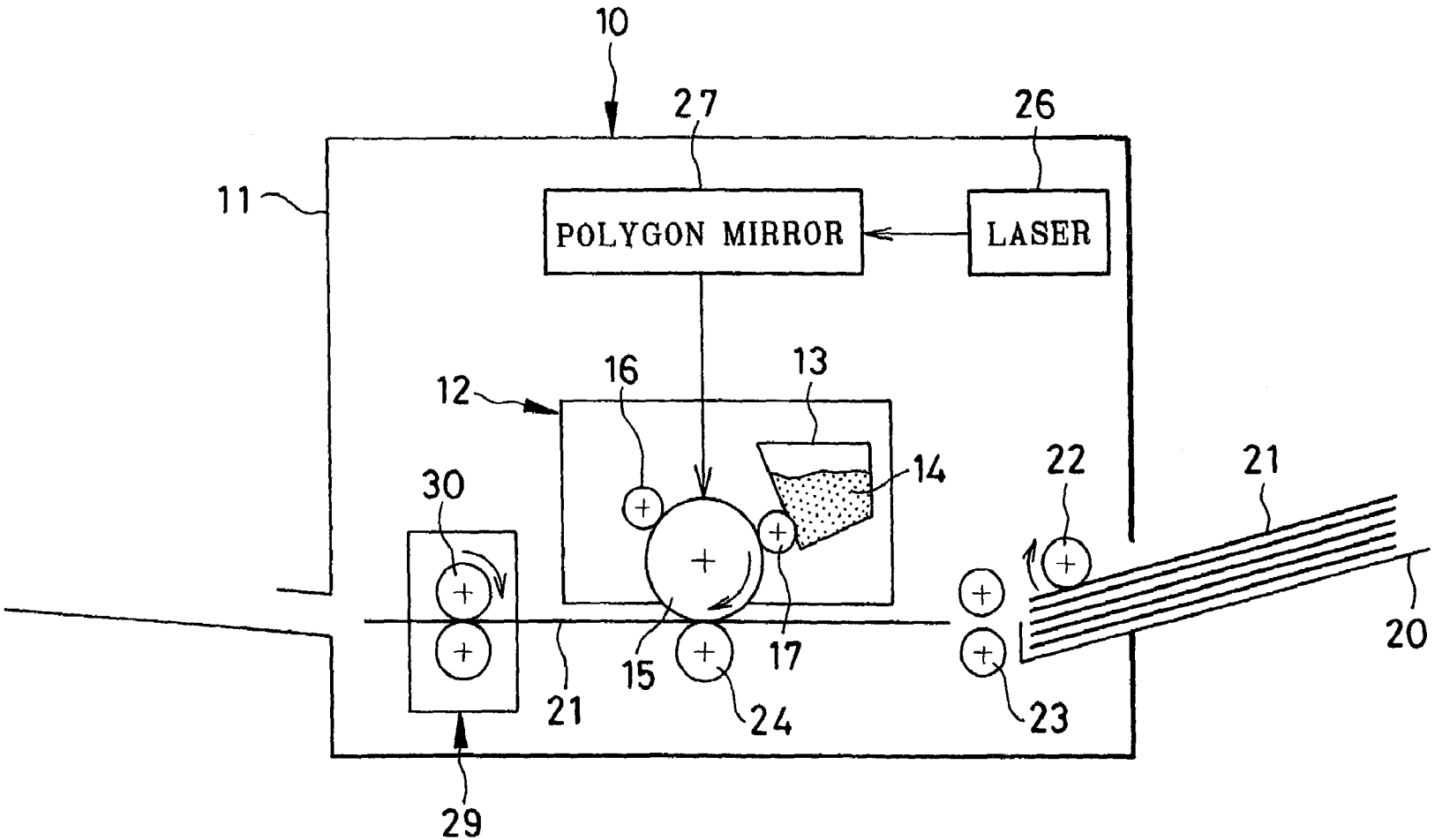
FIG. 1 is a schematic view illustrating a printer of an electrophotographic type.

In FIG. 1, an electrophotographic type of a printer 10 according to the present invention is illustrated. The printer 10 has a printer main unit 11, in which a cartridge 12 is mounted in a removable manner. The cartridge 12 has a toner chamber 13 filled with toner 14, and also includes a photoreceptor drum 15, a charger roller 16 and developer roller 17 filled with the toner 14. The cartridge 12 has a form of a process cartridge known in the art of printer.

The photoreceptor drum 15 is constituted of a metal cylindrical body, and a film overlaid on a surface of the cylindrical body and having photoconductivity. The charger roller 16 includes a shaft, a cylindrical body, and a tube. The shaft is formed from metal. The cylindrical body is disposed about the shaft, formed from polyurethane foam, and has electric conductivity. The tube is plastic, is disposed about the cylindrical body, and has semiconductivity. The charger roller 16 is caused to contact the surface of the photoreceptor drum 15 by resiliency of the polyurethane foam. To apply predetermined voltage between the photoreceptor drum 15 and the charger roller 16, the cylindrical body of the photoreceptor drum 15 and the shaft of the charger roller 16 are connected with a charger circuit in the printer main unit 11. For this connections, the printer main unit 11 and the cartridge 12 have electric contact points (not shown).

Plural recording sheets 21 are set on a supply tray 20. A supply roller 22 draws an uppermost one of the recording sheets 21 on the supply tray 20, and supplies a pair of feed rollers 23 with the same. The feed rollers 23 nip the recording sheet 21 and feeds it to a transfer position. A transfer roller 24 is disposed in the transfer position, and contacts the photoreceptor drum 15 when the cartridge 12 is set.

In the course of printing, the photoreceptor drum 15 rotates in the clockwise direction at a regular speed. When the photoreceptor drum 15 rotates in contact with the charger roller 16, the surface of the photoreceptor drum 15 is uniformly charged. A semiconductor laser 26 is driven by image data, and generates laser light of which intensity is modulated. A polygon mirror 27 receives the laser light, and reflects it toward the photoreceptor drum 15. The polygon mirror 27 deflects the laser light in a main scan direction or axial direction of the transfer roller 24 for raster scan operation. On the surface of the photoreceptor drum 15, charge is eliminated from portions receiving the laser light, to create an electrostatic latent image.

The toner 14 in the toner chamber 13 is fed while stuck on a surface of the developer roller 17 in rotation. The toner 14 while fed is moved to pass a regulator blade 28. See FIG. 4. During this passage, the toner 14 is charged with polarity reverse to that of the photoreceptor drum 15 by means of friction with the regulator blade 28. When the toner 14 comes to the photoreceptor drum 15, the toner 14 is attracted by the photoreceptor drum 15 electrostatically. Thus, an electrostatic latent image on the photoreceptor drum 15 is rendered visible as a toner image.

When the photoreceptor drum 15 rotates, the toner image moves to a transfer position. In the transfer position, the recording sheet 21 is squeezed between the transfer roller 24 and the photoreceptor drum 15 and moved at a speed equal to a peripheral speed of the photoreceptor drum 15. The transfer roller 24 is biased at a potential reverse to the toner image. So the toner image on the photoreceptor drum 15 is transferred to the recording sheet 21.

The recording sheet 21 with the toner image transferred thereon is fed to a fixer 29. The fixer 29 is constituted by a pair of fixer rollers 30 and a heater (not shown), and heats and melts the toner. The melted toner is attracted by the recording sheet 21. The recording sheet 21 after the fixation is ejected from the printer main unit 11.

Figure 2:
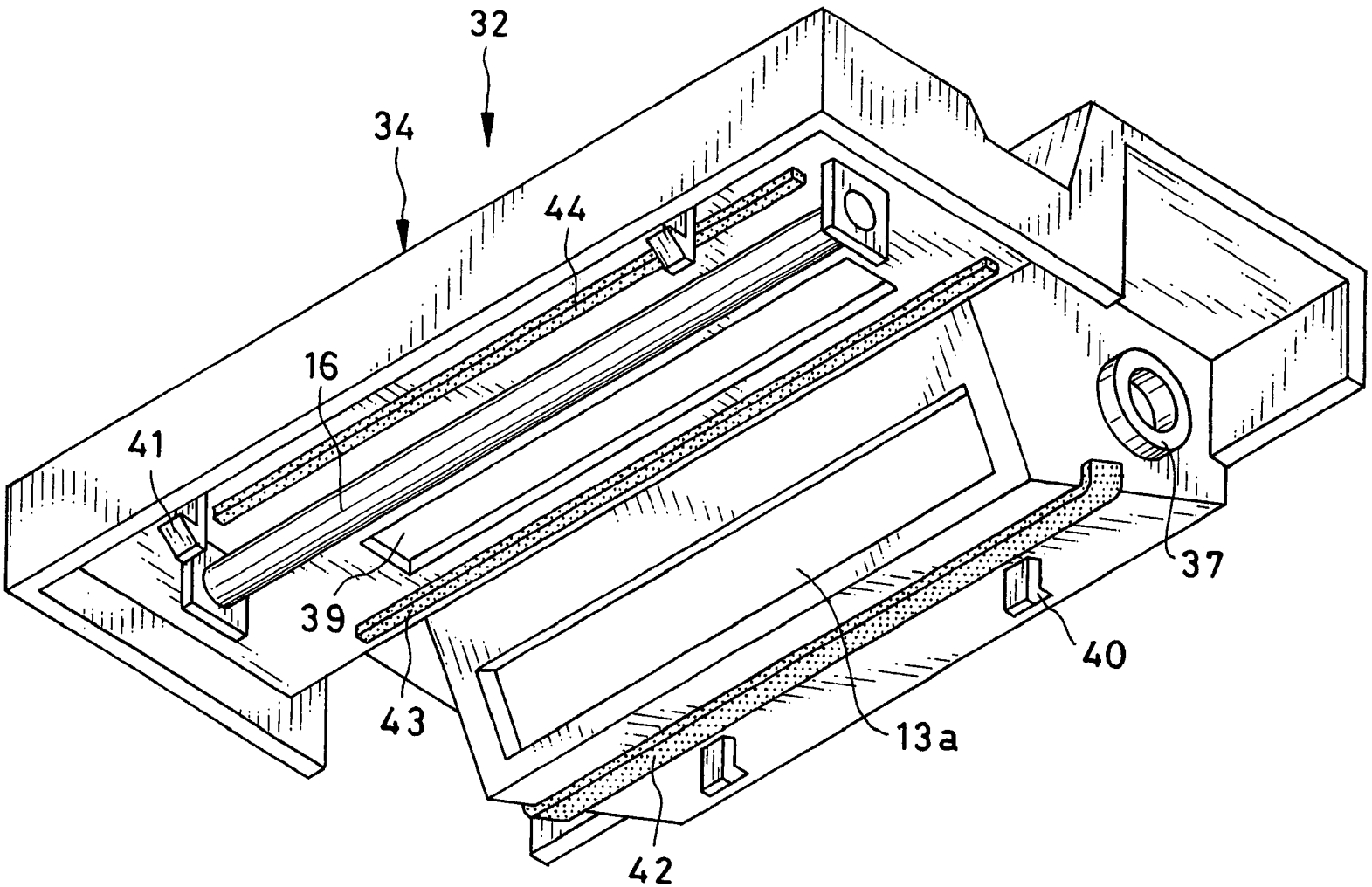
FIG. 2 is a perspective illustrating an upper cartridge.
Figure 3:
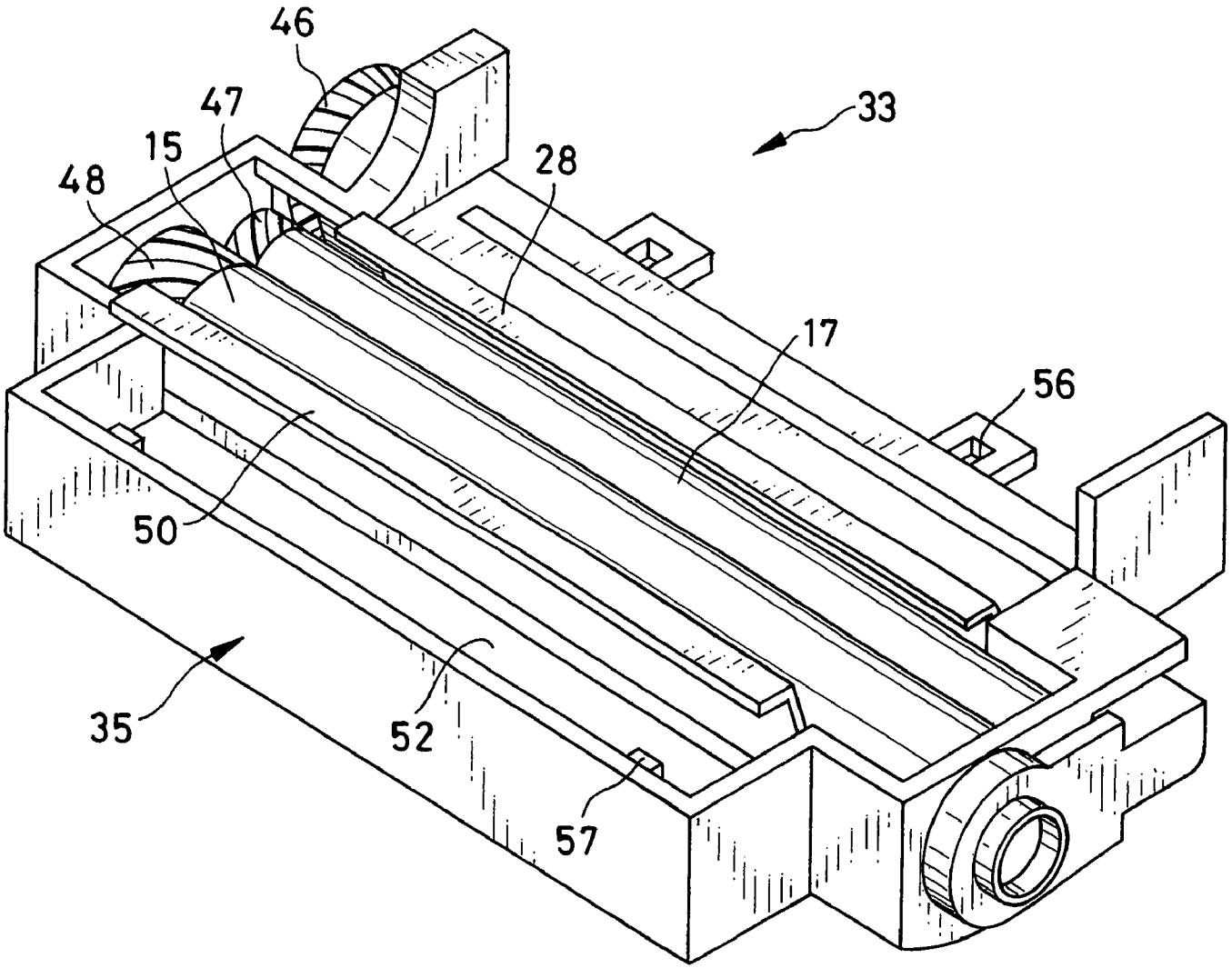
FIG. 3 is a perspective illustrating a lower cartridge.
Figure 4:
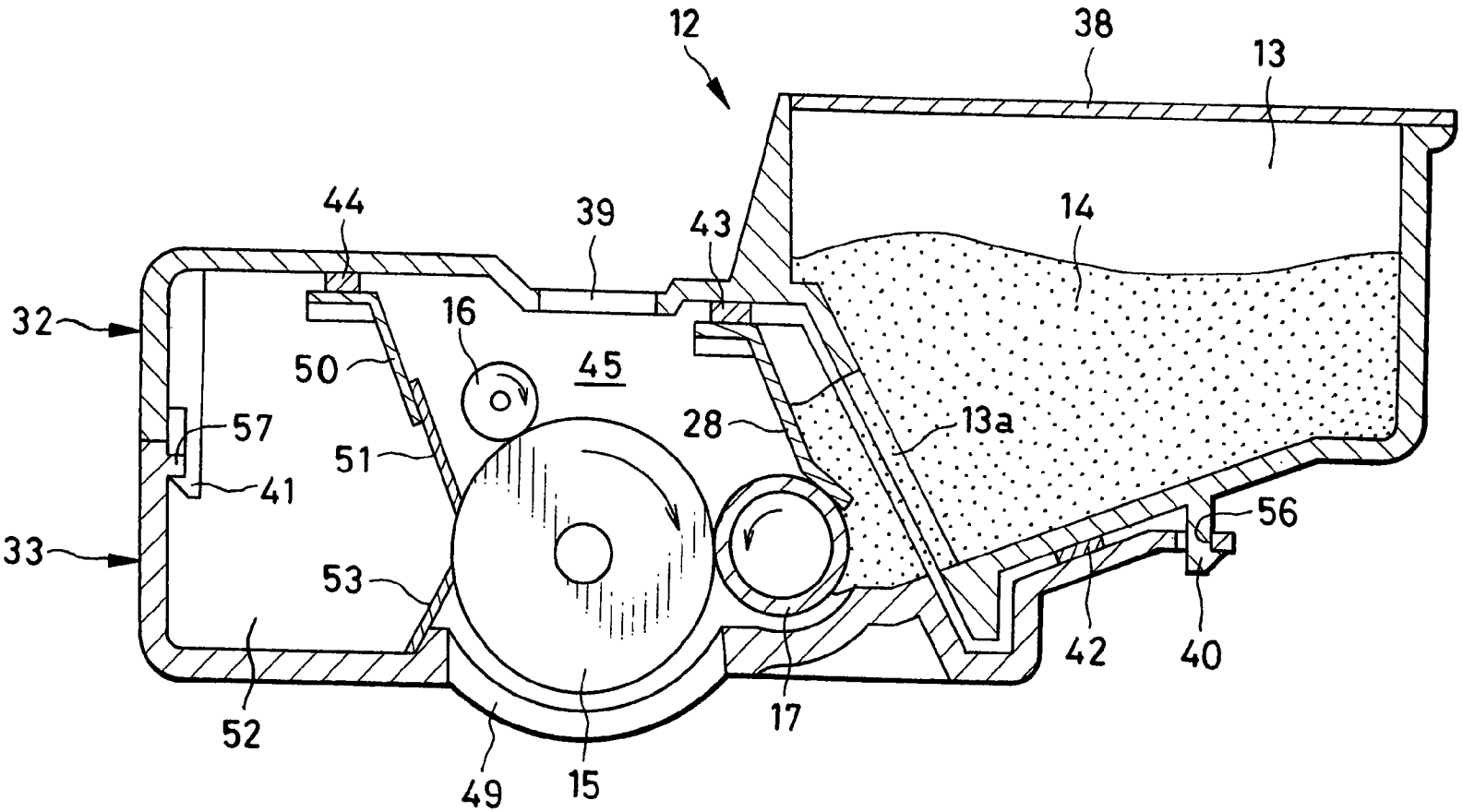
FIG. 4 is a cross section illustrating a cartridge constructed by assembling the upper and lower cartridges.

In FIGS. 2–4, a cartridge is illustrated. In FIG. 2, an upper cartridge 32 is depicted. In FIG. 3, a lower cartridge 33 is depicted. In FIG. 4, a state of assembling the upper and lower cartridges is depicted. The upper and lower cartridges 32 and 33 have respectively cartridge bodies 34 and 35, which are plastic molded pieces of a black color.

In FIGS. 2 and 4, the upper cartridge 32 has the toner chamber 13 filled with the toner 14 of a predetermined full amount in the course of manufacture. There is a toner supply opening 13*a* formed in a lower wall of the toner chamber 13, and closed by a sticker tape (not shown) before use. There is a toner loading opening (not shown) formed in a lateral wall of the toner chamber 13, and after loading, is enclosed by a cap 37. An upper plate 38 constitutes a top of the toner chamber 13, and is attached to the cartridge body 34 by adhesion.

The charger roller 16 is mounted in the cartridge body 34 in a rotatable manner. An exposure opening 39 is formed in a position close to the charger roller 16, and causes laser light to come incident upon the photoreceptor drum 15.

To connect the upper cartridge 32 with the lower cartridge 33, the cartridge body 34 has two retaining claws 40 and two retaining claws 41. The retaining claws 40 are disposed under the toner chamber 13. The retaining claws 41 are disposed close to the charger roller 16. In FIG. 4, sponge tapes 42, 43 and 44 are used to block gaps or spaces for preventing the toner 14 from entry into an exposure chamber 45.

In FIGS. 3 and 4, the cartridge body 35 has the photoreceptor drum 15 and the developer roller 17 supported in a rotatable manner. A driven gear 46 is disposed in the cartridge body 35 for mesh with a driving gear (not shown) in the printer main unit 11. Rotation of the driven gear 46 is transmitted to the developer roller 17 by a gear 47, and then transmitted by a gear 48 to the photoreceptor drum 15. An opening 49 is formed in the lower cartridge 33 and located under the photoreceptor drum 15. The transfer roller 24 is received by the opening 49 to come in contact with the photoreceptor drum 15.

A cleaning blade 51 is secured to an edge of a support plate 50, to remove surplus toner from the photoreceptor drum 15. A collection sheet 53 is secured to the cartridge body 35. A waste toner chamber 52 is a space defined by the support plate 50, the cleaning blade 51 and the collection sheet 53, and operates to collect the surplus toner guided by the collection sheet 53.

As an upper end of the support plate 50 contacts the sponge tape 44, the waste toner chamber 52 is separated from the exposure chamber 45, to prevent the used toner from leaking out of the cartridge 12 from the exposure chamber 45. The sponge tape 42 contacts the inside of the cartridge body 35. The sponge tape 43 contacts an upper end of the regulator blade 28. The sponge tapes 42 and 43 separating the exposure chamber 45 from the toner chamber 13 prevent unused toner from leaking out of the cartridge 12 from the exposure chamber 45.

There are engaging holes 56 and retaining projections 57 in the cartridge body 35. When the upper cartridge 32 is fitted on the lower cartridge 33, the retaining claws 40 in the cartridge body 34 are inserted in the engaging holes 56. The retaining claws 41 of the cartridge body 34 are engaged with the retaining projections 57. The upper cartridge 32 is kept fixed on the lower cartridge 33 by the retaining claws 40 and 41, the engaging holes 56 and the retaining projections 57.

While the elements of the cartridge 12 remain assembled, the cap 37 is covered by the cartridge body 35 and kept from emerging externally. If reloading of toner is intended, it is necessary to remove the cartridge body 34 from the cartridge body 35.

Figure 5:
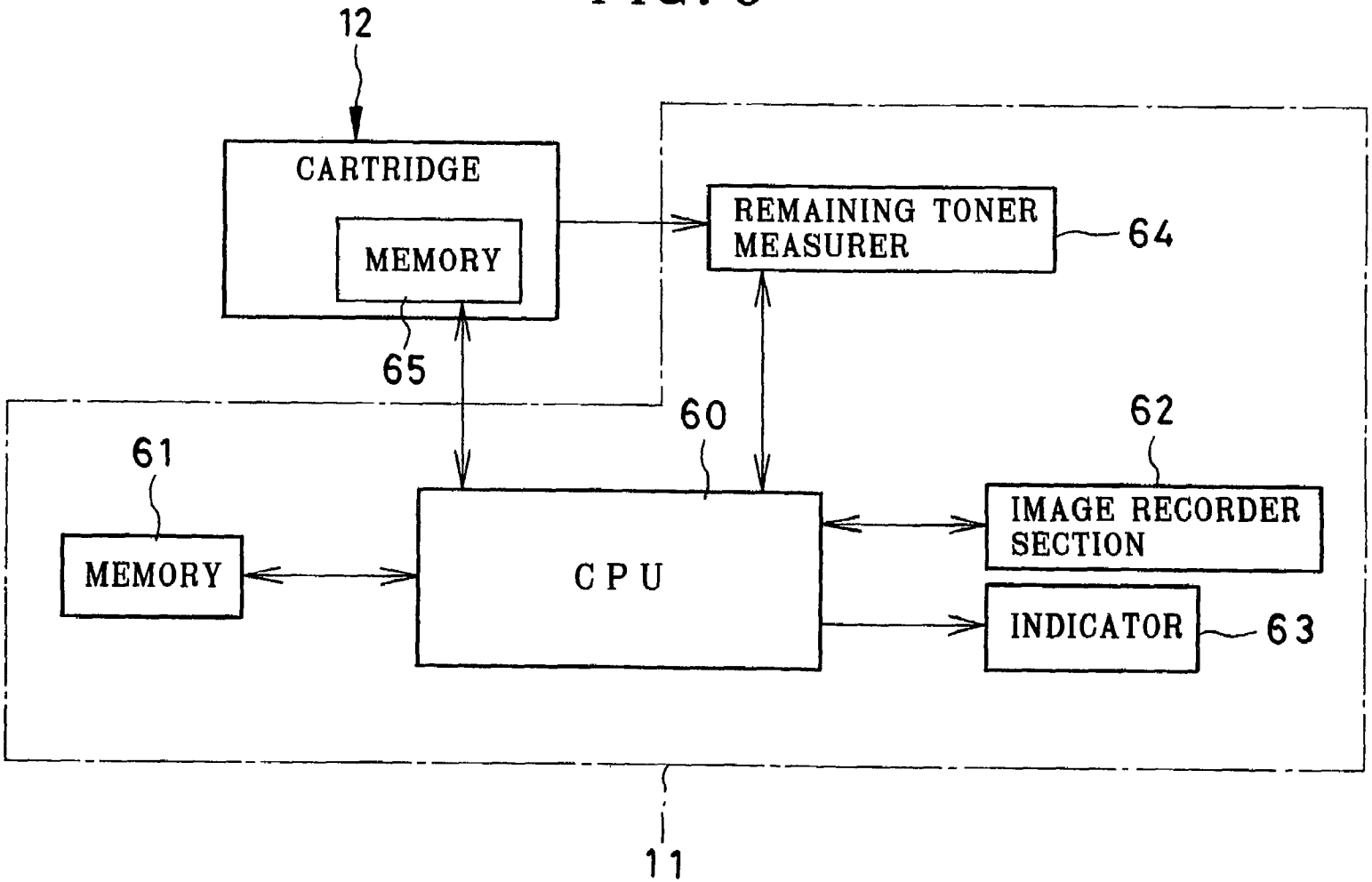
FIG. 5 is a block diagram illustrating arrangement of circuits of the printer of FIG. 1.

In FIG. 5 for electric circuits of the printer, the printer main unit 11 includes a computer or CPU 60, a printer memory 61, an image recorder section 62, an indicator 63 and a remaining toner measurer 64. A cartridge memory 65 is incorporated in the cartridge 12. To connect the cartridge memory 65 electrically with CPU 60, there are contact points (not shown) outside the cartridge 12, and contact points (not shown) in the printer main unit 11. The printer memory 61 and the cartridge memory 65 are EEPROMs which do not require back-up operation.

CPU 60 controls various elements of the printer 10 sequentially, and also determines propriety or impropriety of the cartridge in consideration of reloading of toner. In the case of impropriety, CPU 60 causes the indicator 63 to indicate the reloaded state, requirement of replacement of the cartridge, and inhibition of printing. Also, CPU 60 inhibits the image recorder section 62 from operating. The indicator 63 is disposed on an outer face of the printer main unit 11 together with an operation panel (not shown).

If each cartridge is provided with discernment information or cartridge ID, the printer memory 61 is caused to store the cartridge ID of the cartridge that has been once set in the printer main unit 11, and information of the remaining toner amount of the cartridge. Examples of the cartridge ID are a train of numbers, letters or signs, or a combination of those.

In order to avoid reading or rewriting of information by reloading agents, it is preferable to cipher the information of the cartridge ID or remaining toner amount, or to use a special cipher for reading of the information, for the purpose of protecting the information. Note that a manufacturer of the printer can read or rewrite the information by inputting a cipher or by inputting a secret command signal for undoing the protection.

The image recorder section 62 has a laser scanning optical system including the semiconductor laser 26 and the polygon mirror 27. Also, the image recorder section 62 includes the fixer 29, a motor, a charger circuit and the like. The motor drives the transfer roller 24, the cartridge 12, the supply roller 22 and the feed rollers 23. The charger circuit applies voltage to the charger roller 16.

The cartridge memory 65 is caused to store information of the remaining toner amount measured by the remaining toner measurer 64 or the like. If the cartridge is unused, the information for a full amount is previously written in the course of manufacture. Also, this information can be protected in the manner described above. If each of the cartridges is provided with a cartridge ID, the cartridge ID is previously written in the course of manufacture instead of the remaining toner amount.

Figure 6:
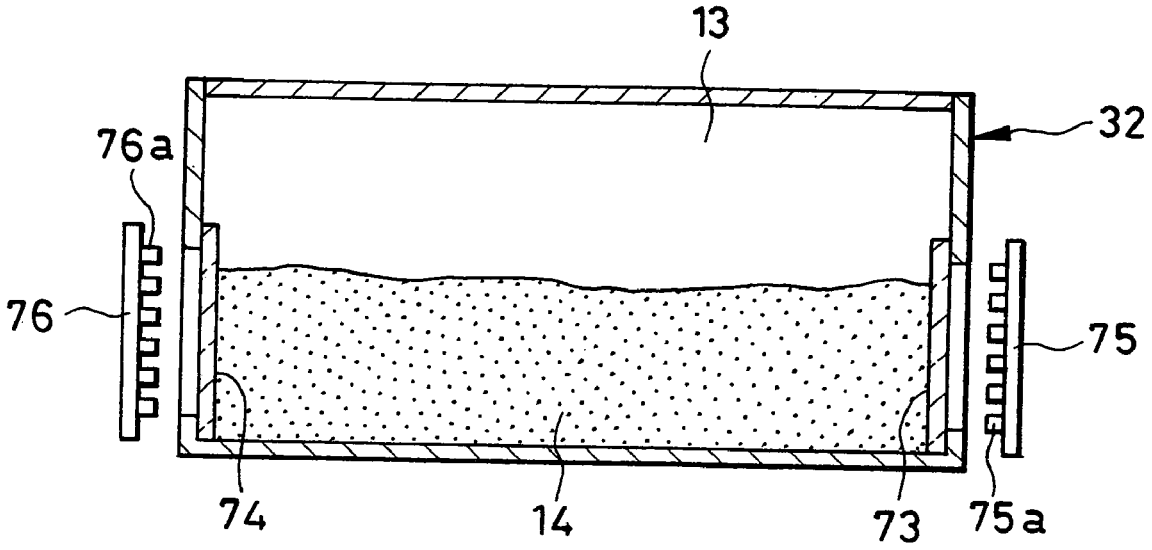
FIG. 6 is a vertical section illustrating a preferred example of remaining toner measurer.

In FIG. 6, an example of remaining toner measurer is illustrated. A pair of windows are formed in respectively lateral walls of the toner chamber 13. Transparent plates 73 and 74 are secured to respectively the windows. There are a line-shaped light source 75 and a line-shaped sensor 76 so disposed that the transparent plates 73 and 74 are located between those.

The remaining toner measurer 64 is constituted by the line-shaped light source 75 and the line-shaped sensor 76. The line-shaped light source 75 is caused by CPU 60 to emit light for a predetermined time for measurement. A signal from the line-shaped sensor 76 is retrieved by CPU 60. An estimated amount of the remaining toner is calculated according to a light detecting state represented by the signal.

The line-shaped light source 75 consists of an array of plural LEDs (light-emitting diodes) 75*a*. Alternatively, a fluorescent lamp of a long shape may be used as the line-shaped light source 75. The line-shaped sensor 76 consists of an array of plural photo sensors 76*a*. The line-shaped sensor 76 may be a line image sensor, for example a CCD (charge-coupled device).

In measuring the remaining toner, the line-shaped light source 75 is driven by CPU 60. Lower part of light emitted by the line-shaped light source 75 is blocked by the toner 14 in positions lower than an upper surface of the toner 14. However, upper part of the light emitted by the line-shaped light source 75 travels without being blocked by the toner 14 in positions, and becomes incident upon the line-shaped sensor 76.

If the remaining toner is considerably much, a greater number of the photo sensors 76*a* in the line-shaped sensor 76 are blocked by the toner. Only the remainder of the photo sensors 76*a* located higher than those being blocked detect light from the line-shaped light source 75. According to a decrease of the remaining toner, the number of the photo sensors 76*a* detecting light is increased. CPU 60 estimates the remaining toner amount according to the number of blocked photo sensors 76*a* or the number of photo sensors 76*a* detecting light.

Should the toner 14 be stuck on the transparent plate 73 or 74, failure occurs in accurate measurement of the toner in the remaining toner measurer 64. Accordingly, the transparent plates 73 and 74 are formed from material with such a characteristic that the toner 14 is not likely to stick on it electrically or physically. Also, surfaces of the transparent plates 73 and 74 are provided with high smoothness for facilitating drop of the toner 14.

It is to be noted that the cartridge 12 may have the remaining toner measurer, which may send amount data of the remaining toner to CPU 60 of the printer main unit 11. In such a structure, the line-shaped light source 75 and the line-shaped sensor 76 are accommodated in the cartridge 12. The cartridge 12 is provided with a specialized CPU (not shown) for the purpose of controlling the line-shaped light source 75 and calculating the remaining toner amount. The specialized CPU obtains a remaining toner amount in response to a data command signal from CPU 60, and sends the amount data of the remaining toner to CPU 60.

Figure 7:
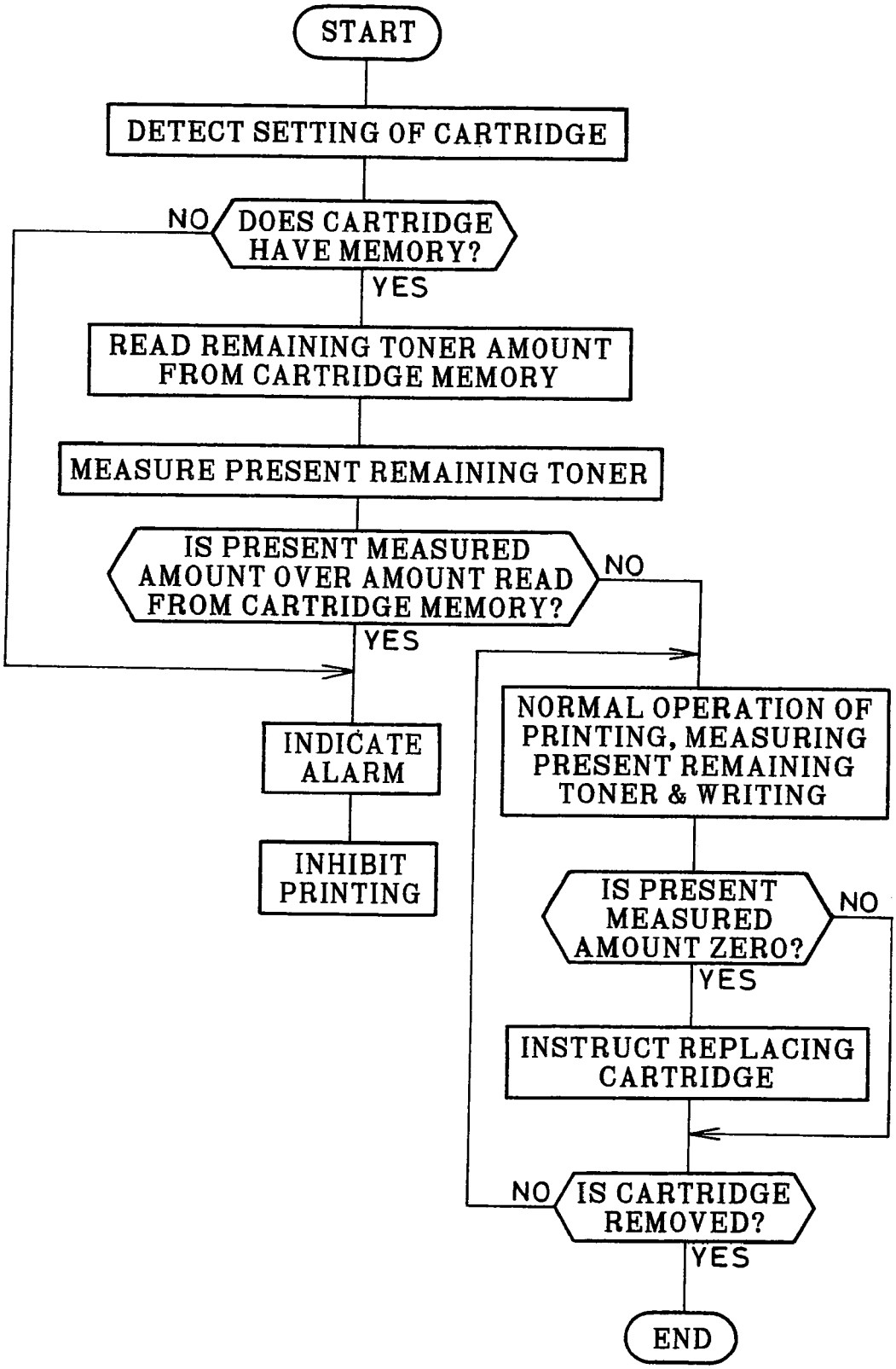
FIG. 7 is a flow chart illustrating a preferred embodiment in which a remaining toner amount is written to a cartridge memory.

In FIG. 7, a preferred embodiment is illustrated, in which the measured remaining toner amount is compared with the remaining toner amount read from the cartridge memory 65 for the purpose of checking impropriety of the cartridge. To load a cartridge chamber (not shown) of the printer main unit 11 with the cartridge 12, a sticker tape is peeled from the cartridge 12 to open the toner supply opening 13*a*. Upon the opening operation of the toner supply opening 13*a*, the toner 14 in the toner chamber 13 is ready to advance to the developer roller 17. Then a lid of the cartridge chamber is opened. The cartridge 12 is set in the cartridge chamber. The cartridge memory 65 becomes connected with CPU 60. The photoreceptor drum 15 and the charger roller 16 become connected with a charger circuit (not shown) in the image recorder section 62.

When the power source is turned on, CPU 60 receives a signal from a switch (not shown) for detecting closing of the lid of the cartridge chamber, and judges that the cartridge 12 has been set. Then CPU 60 checks existence or lack of the cartridge memory 65. The cartridge memory 65 has been storing a flag representing existence of the cartridge memory 65 in addition to the data of the remaining toner amount. CPU 60, if the flag is read safely, determines that the cartridge is proper and genuine as supplied by a printer manufacturer.

If a cartridge is improper, the cartridge is likely to have no cartridge memory 65. No flag can be read from the cartridge. This improper cartridge is treated in the same manner as the cartridge reloaded with toner. CPU 60 operates for indication of an alarm, and inhibits printing operation.

When CPU 60 determines propriety of the cartridge, CPU 60 reads the amount data of the remaining toner from the cartridge memory 65. If the cartridge is unused, the cartridge memory 65 previously stores the data of the full amount by writing in the course of manufacturing the cartridge. If the cartridge is used, the cartridge memory 65 has been storing the amount data of the remaining toner measured by the remaining toner measurer 64. In case the amount data of the remaining toner is fraudulently changed, reloading of the toner cannot be detected. In order to avoid fraudulent changes in the data, ciphered data may be used, and may be decoded by CPU 60. Furthermore, a special protocol may be used for reading the data.

Then CPU 60 causes the remaining toner measurer 64 to measure the present remaining toner 14 in the toner chamber 13. CPU 60 compares the measured amount with the remaining toner amount read from the cartridge memory 65, and checks occurrence of reloading of the toner 14.

If the present remaining toner is more than the remaining toner of the data read from the cartridge memory 65, CPU 60 determines impropriety of the cartridge reloaded with toner. In contrast, if the present remaining toner is as much as or less than the remaining toner of the data read from the cartridge memory 65, CPU 60 determines propriety of the cartridge without reloading.

If impropriety of the cartridge due to reloading is detected, CPU 60 operates for indicating information of reloading of toner, probability in degradation of printing quality, requirement of use of a proper cartridge and the like. Furthermore, CPU 60 inhibits the image recorder section 62 from operating. If a printing command signal is received from a personal computer or the like, CPU 60 does not respond to the printing command signal but keeps the image recorder section 62 from operating.

In contrast, if CPU 60 detects propriety of the cartridge without reloading of toner, CPU 60 allows the image recorder section 62 to operate for printing. Upon receipt of a printing command signal from a personal computer or the like, CPU 60 sequentially controls the image recorder section 62 to record an image or letters to the recording sheet 21. While the printer 10 operates normally, CPU 60 causes the remaining toner measurer 64 to measure the toner at each time that a prescribed number of prints are produced, or at each time of lapse of prescribed time. CPU 60 writes information of the measured remaining toner amount to the memory 65.

Data of the remaining toner is renewed to be new data. Furthermore, additional data of an amount of remaining toner may be recorded chronologically in combination with data of a measuring date or time. According to chronological data of the remaining toner, the history of operation of the printer can be found, and can be utilized to analyze breakages or as information for future improvement of printers.

When the measured remaining amount comes down to a predetermined limit during the normal operation of the printer 10, the indicator 63 is caused to indicate shortage of toner and requirement of replacing the cartridge. The predetermined limit is preferably zero. It is to be noted that, even when the measured remaining amount is zero, there is a small amount of remaining toner practically. Only a small number of prints can be still produced. When the cartridge is replaced with an unused cartridge by following the instruction, then the existence of the cartridge memory and an increase in the toner are checked in the manner described above. If the cartridge is genuine and unused, the printer can operate normally by use of the same.

Some user may request a reloading agent to reload a used cartridge with toner. The reloading agent disengages the retaining claws 40 from the engaging holes 56 and the retaining claws 41 from the retaining projections 57, to disassemble the cartridge 12 into the upper and lower cartridges 32 and 33.

Various portions of the cartridge 12 are cleaned after disassembly. Then a sticker tape is attached to the toner supply opening 13*a* of the upper cartridge 32 to close the same. Then the cap 37 is removed from the upper cartridge 32, in which the toner chamber 13 is filled with toner. After this, the cap 37 is fitted on the upper cartridge 32 again to close the toner chamber 13 tightly. After filling of the toner, the reloading agent reassembles the upper and lower cartridges 32 and 33 to obtain the cartridge 12, which is packaged and shipped out to the user.

When an improper cartridge provided by a reloading agent is set in the printer main unit 11, an increase in the toner is checked in the manner described above. The cartridge memory 65 stores data representing the remaining toner amount being zero. In contrast, the amount of the present remaining toner measured by the remaining toner measurer 64 is substantially a full amount. Thus, the present remaining toner is more than the former. CPU 60 determines impropriety of the cartridge reloaded with toner, and thus generates an alarm signal and inhibits printing.

While printing is inhibited, the printer 10 does not respond to a printing command signal from a personal computer or the like. The cartridge 12 reloaded with the toner 14 cannot be used. As a result, the user becomes clearly aware of unacceptability of reloading of the toner 14, and is caused to use only genuine cartridges supplied by the printer manufacturer. The printing quality by use of the improper reloading of the toner 14 is prevented from becoming low. Also, breakage or difficulties in the printer 10 are reduced. Furthermore, it is possible in the process cartridge to prevent the photoreceptor drum 15 and other parts from being used after lapse of the lifetime with guaranteed quality, so the printing quality is kept high. The measurement and writing of the remaining amount of the toner 14 are suitably effected during the normal printing operation. However, it is possible to write the remaining amount of the toner 14 only at the time of removing the cartridge 12 from the printer main unit 11.

Figure 8:
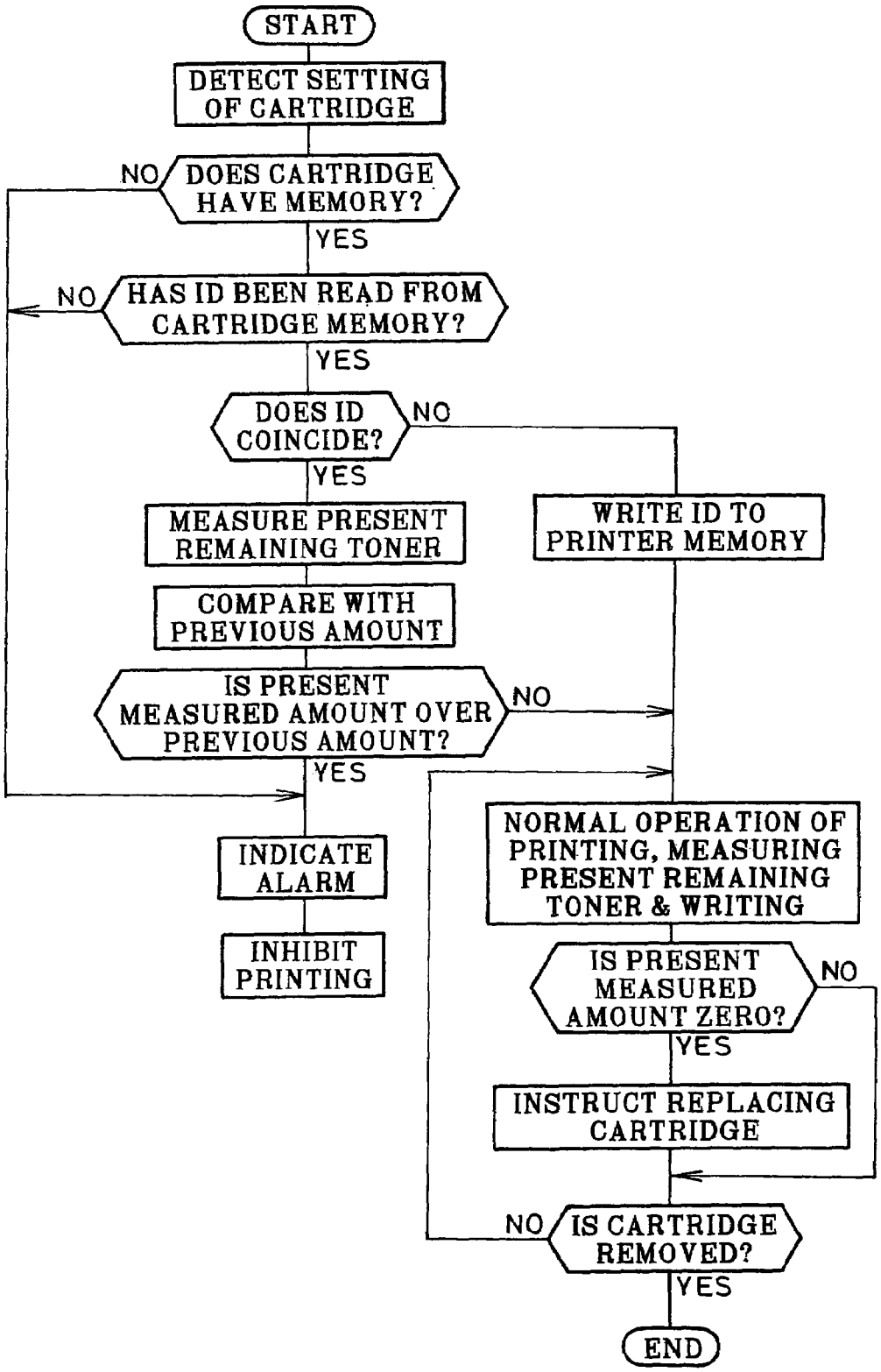
FIG. 8 is a flow chart illustrating an embodiment in which discernment information is stored in the cartridge memory, and the remaining toner amount is written to a printer memory.

In FIG. 8, a preferred embodiment is illustrated, in which a cartridge ID or discernment information is assigned to each cartridge, and the remaining toner amount is written to the printer memory 61 with the cartridge ID. When setting of the cartridge 12 is detected, CPU 60 checks whether the cartridge 12 has the cartridge memory 65.

If the cartridge 12 does not have the cartridge memory 65, the cartridge 12 is determined not proper. Also, the cartridge ID may be a ciphered code or special protocol. It is likely that a fraudulently prepared cartridge is provided with the cartridge memory 65. However, the cartridge ID can be suitably checked to reject the fraudulently prepared cartridge as improper by use of the ciphered code or special protocol.

In the case of the impropriety, an alarm signal is generated to indicate alarm. Also, the printing is inhibited.

Then coincidence of the cartridge ID being read is checked. At first, the data format of the cartridge ID is evaluated to check whether the cartridge ID is appropriate. After this, it is checked whether the cartridge ID is stored in the printer memory 61. In general, once a cartridge is used in the printer main unit 11, the printer memory 61 stores the cartridge ID and the remaining toner amount. Checking the cartridge ID makes it possible to discern an unused cartridge or a cartridge which has been once set in the printer main unit 11.

If the cartridge 12 is unused, the cartridge ID and data of a full amount of the toner are written to the printer memory 61. The full amount is an amount of the toner filled in the toner chamber 13 in the manufacturing process. After the data are written, the printer 10 operates normally as described with FIG. 7. In the normal operation, the remaining toner amount is measured, to renew or add data of the remaining toner amount in relation to the printer memory 61. Note that, if the shortage of toner is indicated, the cartridge is replaced by an unused cartridge.

If the cartridge 12 is recognized according to the cartridge ID as used in the printer main unit 11 formerly, then the remaining toner measurer 64 is driven to measure the remaining toner amount in the toner chamber 13. The printer memory 61 stores the cartridge ID of the previously used cartridge and the previously measured remaining toner amount. Thus, the data of the remaining toner amount is read from the printer memory 61 at the address of the cartridge ID read from the cartridge memory 65.

CPU 60 compares the presently remaining toner amount with the remaining toner amount read from the printer memory 61. If there is an increase in the toner, then the cartridge is determined to be improper as reloaded with toner. An alarm signal is generated. Also, printing is inhibited. If there is no increase in the toner, then the cartridge is determined to be proper. The printer 10 comes to operate normally for printing.

Figure 9:
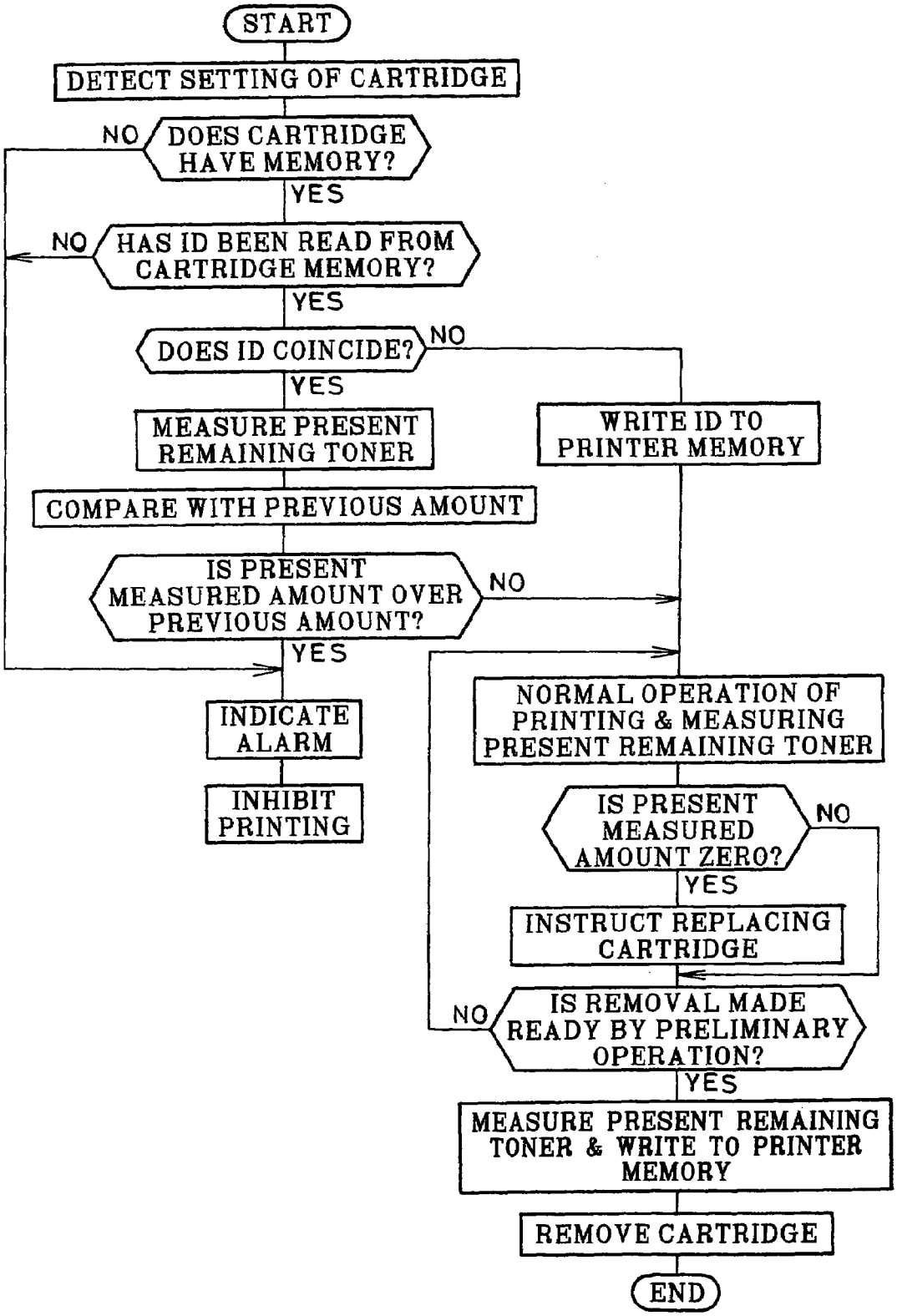
FIG. 9 is a flow chart illustrating a preferred embodiment in which the remaining toner amount is written to the printer memory upon a mechanical operation preliminary to removal of the cartridge.

In FIG. 9, another preferred embodiment is illustrated, in which the remaining toner amount is written to the printer memory 61 upon removal of the cartridge from the printer main unit. There is a partial flow the same as that of FIG. 8. Only removal of the cartridge is described now.

To remove the cartridge 12 from the printer main unit 11, the lid for the cartridge chamber is opened, before a cartridge lock lever is operated to unlock the cartridge. The opening operation of the lid or the actuation of the cartridge lock lever is predetermined as a removal preliminary mechanical operation. There is a detector switch for detecting the preliminary mechanical operation, to recognize readiness of removal of the cartridge 12. When CPU 60 receives a signal from the detector switch, the remaining toner measurer 64 is driven to measure an amount of the remaining toner. The remaining amount is written to the printer memory 61 at an address of the cartridge ID.

During the printing operation, the remaining toner amount is measured in a suitable manner. It is also possible to store the remaining amount data to a register in CPU 60 in a temporary manner, and write the stored data of the remaining toner amount to the printer memory 61. Furthermore, in the process depicted in FIG. 7, it is possible to utilize the process of the storing the remaining toner amount to the memory upon the mechanical operation preliminary to the removal of the cartridge.

The above embodiment for use with the cartridge ID has a shortcoming in that an improper cartridge reloaded with toner is recognized as unused by a second printer, and fails to be recognized as improper. Printing is likely to be allowed even with the improper cartridge. Another preferred embodiment is provided, in view of overcoming the shortcoming by additional use of using history information.

Examples of the using history information are cartridge removal information and printer ID assigned to each printer. The printer ID is for example a manufacturing serial number. It is possible to determine whether the cartridge is unused or used according to existence or lack of the using history information. Note that the printer ID is written to the cartridge memory when the cartridge is set into the printer main unit or removed therefrom.

Figure 10:
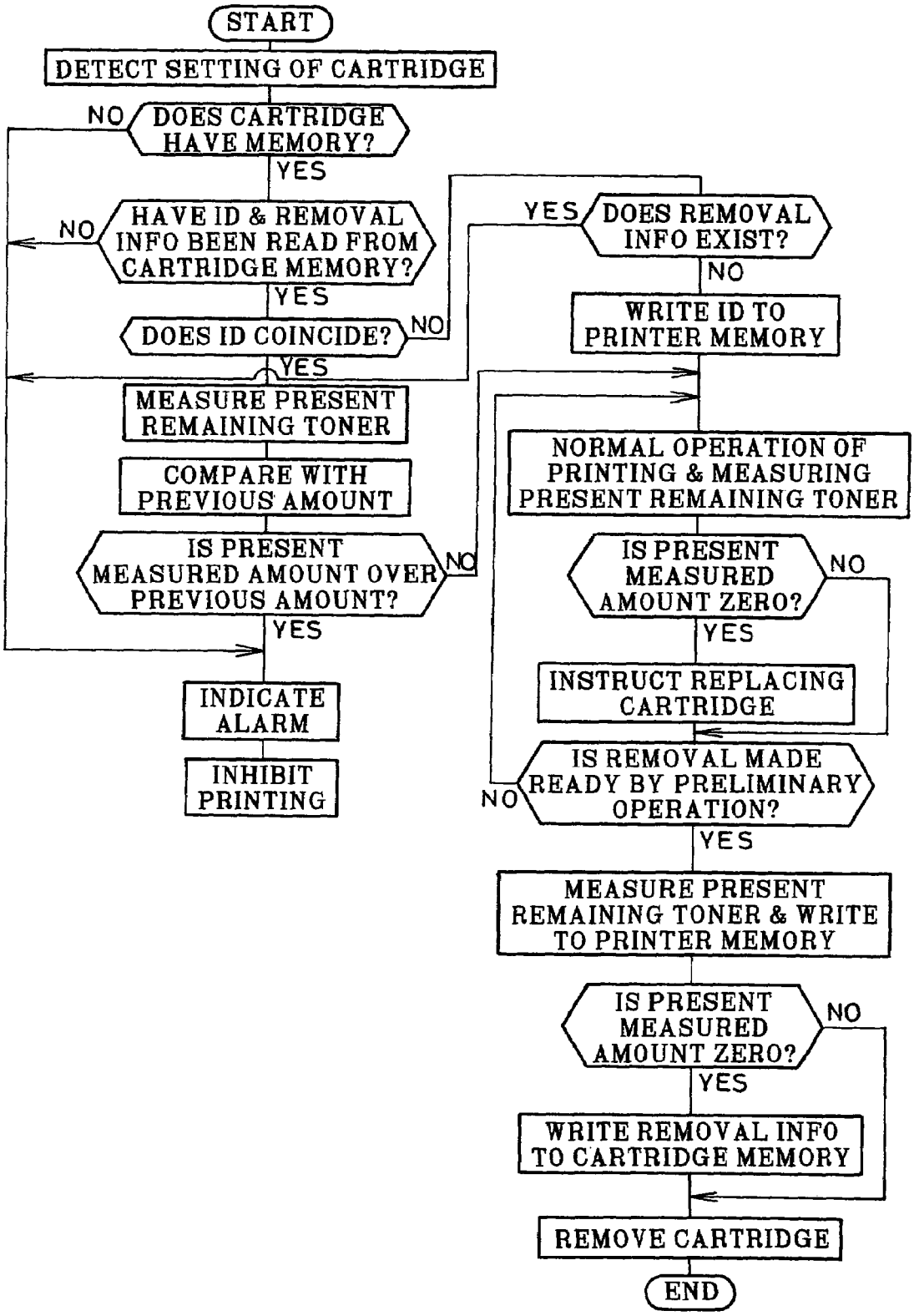
FIG. 10 is a flow chart illustrating a preferred embodiment in which removal information of cartridge removal is written to the cartridge memory.

In FIG. 10, a preferred embodiment is illustrated, in which cartridge removal information is used as using history information. In a manner similar to the embodiment of FIG. 9, the remaining toner amount is measured shortly before removing the cartridge 12 short of toner. Data of the remaining toner amount is written to the printer memory 61. If the remaining toner amount is zero, the cartridge removal information is written to the cartridge memory 65, informing that the cartridge 12 has been removed from the printer main unit 11.

After the removal information is written, the cartridge 12 is reloaded with the toner 14 and set in the printer main unit 11 identical to the former printer main unit. Then the existence of the cartridge memory 65 and readability of the information are checked. In a manner similar to the embodiment of FIG. 9, the cartridge is determined as used by means of checking the coincidence of the cartridge ID. Then an increase in the toner is checked, to discover that the cartridge is improper. Note that it can be checked whether the removal information exists or not without checking the increase in the toner, for the purpose of detecting impropriety of the cartridge.

If the cartridge 12 with impropriety and reloaded with toner is set in another printer, the checking of the cartridge ID results in that the cartridge 12 is unused. However, the cartridge 12 has the cartridge memory 65 storing the removal information. It is checked whether the removal information exists or not, so the impropriety of the cartridge 12 can be detected to generate an alarm signal and inhibit printing. If no removal information exists, then the cartridge 12 is determined proper and unused. The cartridge ID is written as described above. The printer operates normally for printing.

Figure 11:
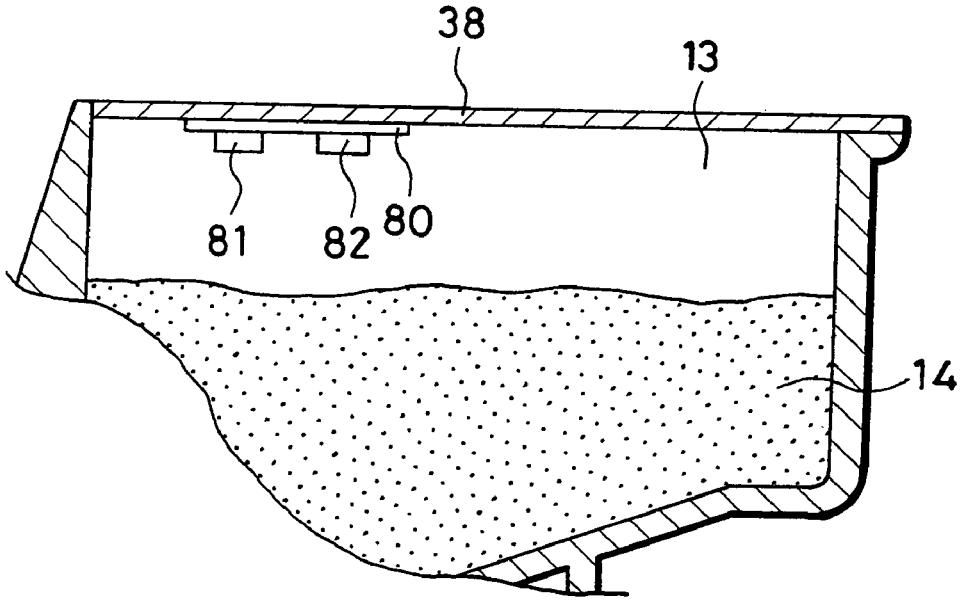
FIG. 11 is a cross section, partially broken, illustrating a preferred example of the remaining toner measurer of an ultrasonic rangefinding type.

In FIG. 11, another preferred remaining toner measurer is illustrated. A circuit board 80 is secured to the inside of the upper plate 38. In an ultrasonic rangefinder, there are a sound wave source 81 and a sound detector 82 or microphone. The sound wave source 81 applies ultrasonic wave to the toner 14. A part of the ultrasonic wave is reflected by a surface of the toner 14 and detected by the sound detector 82.

The printer main unit 11 measures time from the generation of ultrasonic wave at the sound wave source 81 to the detection of the same at the sound detector 82. In general, the more the remainder of the toner 14, the shorter the measured time. The remaining toner amount can be obtained from the measured time. Specifically, a table can be predetermined to represent a relationship between the time and the remaining toner amount, and referred to so as to convert the measured time to the estimated remaining toner amount.

The remaining toner measurer 64 includes a specialized CPU (not shown) for the purpose of measuring time and calculating remaining toner. If the above-described table is used, the specialized CPU also includes a table memory.

Note that it is possible not to use the specialized CPU. CPU 60 in the printer main unit 11 may measure time and calculate remaining toner.

The remaining toner measurer 64 is incorporated in the cartridge 12, and sends the printer main unit 11 data of the remaining toner amount through electrical connection points in the outside of the cartridge 12. The remaining toner measurer 64 of this ultrasonic type is free from being influenced by sticking of the toner 14 to the sound wave source 81 or the sound detector 82 in measurement of time.

The cartridge 12 in which toner is used up is returned to a dealer of the cartridge 12, withdrawn by the printer manufacturer, and recycled. The printer manufacturer disassembles and cleans up the cartridge 12, and inspects each of the parts. Among the withdrawn parts, normal ones are reused. Broken parts or parts after lapse of the lifetime with guaranteed quality are remolded and reused.

If the entirety of the cartridge 12 is reusable with each of the parts operable appropriately, the cartridge 12 can be loaded with the toner 14 of a genuine type. For such operation, data according to the added amount of the toner 14 is written to the cartridge memory 65. If the cartridge 12 is the type with the cartridge memory 65 storing the cartridge ID, a new cartridge ID is also written to the cartridge memory 65. If the cartridge 12 is the type in which the removal information is used, the information is deleted from the cartridge memory 65. Accordingly, the cartridge 12 with the toner 14 of the genuine type is treated as a proper cartridge. Furthermore, a ciphered code may be used as cartridge ID or information of the toner 14. The cartridge memory 65 may be protected from reading and writing of the information. For such a construction, the printer manufacturer can input the ciphered code, or can input a secret command signal for undoing the protection, for the purpose of reading and rewriting the information.

If an increase in the toner 14 occurs, reloading of the cartridge 12 is detected. It is particularly preferable that reloading is defined for an increase in the toner 14 of at least two times. This is in consideration of that the toner 14 consists of powder movable freely, and that errors are likely to occur in measurement of the remaining toner measurer 64.

In general, there are situations in which only the cartridge memory 65 is broken in the cartridge 12, of which all the remaining parts are completely normal and reusable. For such situations, it is desirable that only the cartridge memory 65 should be replaced instead of discarding all the cartridge 12. Thus, the cartridge memory 65 may have a form of a memory card or the like removably connected with circuits in the cartridge 12.

In the above embodiment, reloading of toner is checked upon setting of the cartridge while the power source for the printer remains turned on. There is no check in reloading of toner if the power source is turned on after setting of the cartridge. Consequently, it is preferable to check reloading of toner upon turning on the power source. In other words, it is preferable to check reloading of toner upon turning on the power source while the cartridge is set. Also, it is preferable to check reloading upon setting of the cartridge while the power source remains turned on. Note that the toner reloading may be checked in a manner other than those, for example upon measuring the remaining toner amount in the printing operation.

In FIGS. 12–18, a preferred embodiment is illustrated, in which shortage information is generated when the remaining toner amount comes down to a limit, and printing is inhibited when a printer is loaded with the cartridge associated with the shortage information. The printer herein is structurally the same as that according to FIG. 1. The cartridge is mechanically the same as that according to FIGS. 2–4. Elements similar to those depicted in these drawings are designated with identical reference numerals.

Figure 12:
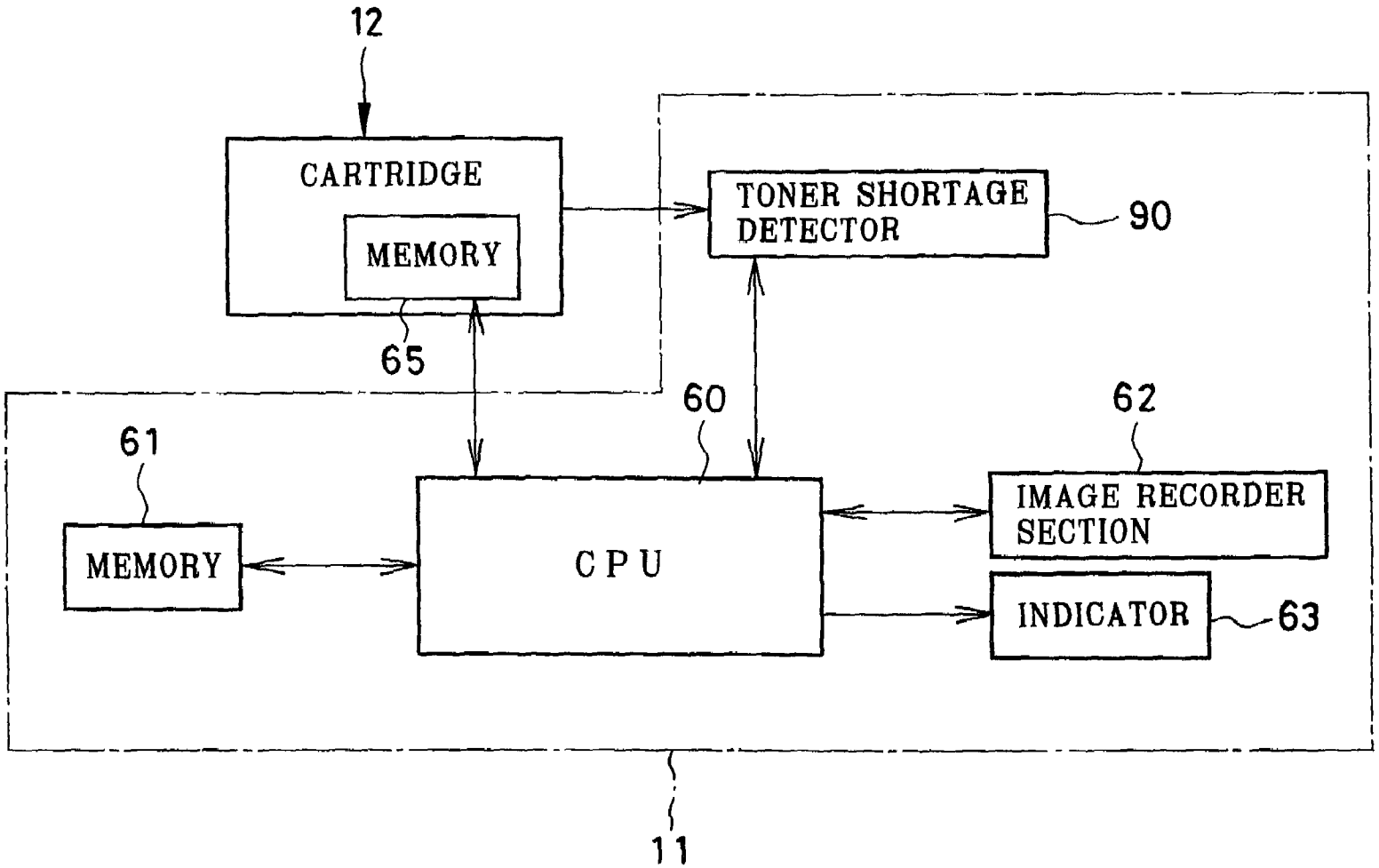
FIG. 12 is a block diagram illustrating arrangement of circuits of the printer having a toner shortage detector.

In FIG. 12, circuit arrangement of the printer is illustrated. A toner shortage detector 90 is a device according to an optical, acoustic, electrical or magnetic technique, and detects a decrease of the toner in the toner chamber 13 to a limit, preferably a decrease to substantially zero. Upon detecting the shortage of the toner, the toner shortage detector 90 generates shortage information and sends the same to CPU 60. The shortage information has a form of a flag, and written to the cartridge memory 65 or the printer memory 61.

CPU 60 sequentially controls the elements of the printer 10, and also checks impropriety of the cartridge reloaded with toner according to existence or lack of the shortage information. If the cartridge is determined improper, CPU 60 causes the indicator 63 to indicate impropriety of the cartridge, required replacement with a proper cartridge, and inhibition of printing, and also inhibits the image recorder section 62 from operating. If the cartridge ID is assigned to each cartridge, CPU 60 causes the printer memory 61 to store the cartridge ID of the cartridge that has been once set in the printer main unit 11, and the shortage information.

Figure 13:
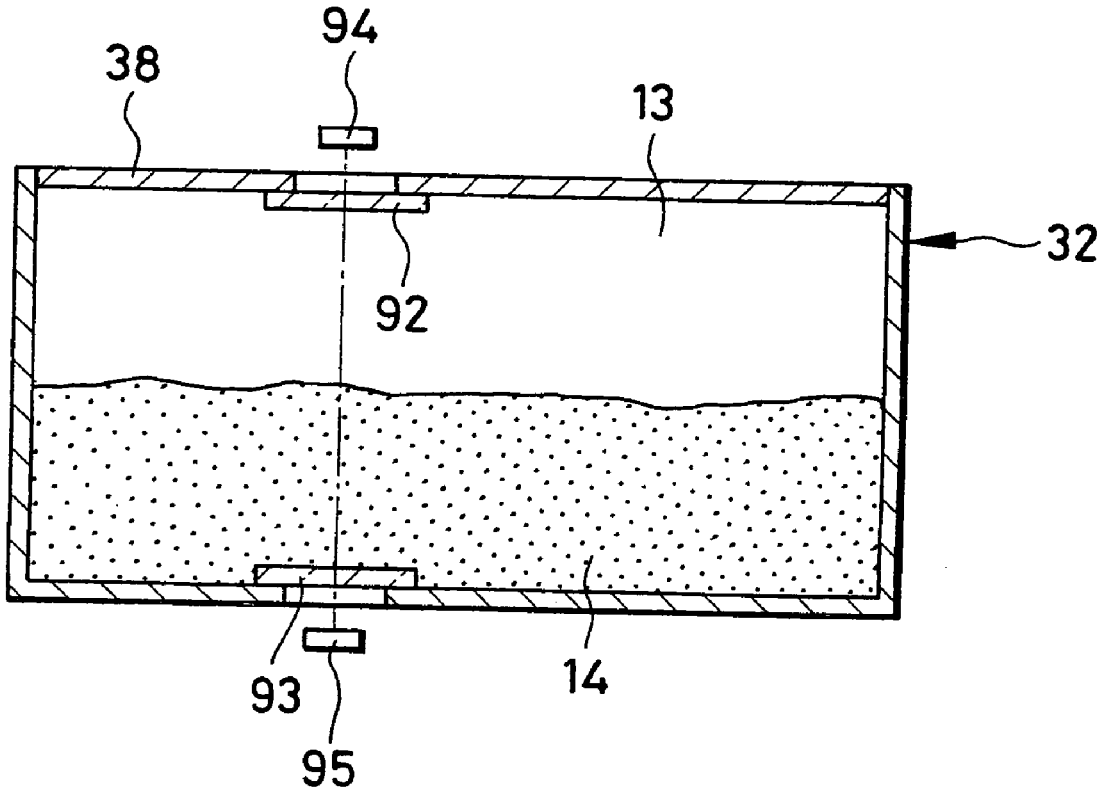
FIG. 13 is a vertical section illustrating a toner chamber with the toner shortage detector.

In FIG. 13, an example of the toner shortage detector 90 is depicted. The toner chamber 13 has pair of windows and transparent plates 92 and 93. The windows are formed in the upper plate 38 and an inclined lower wall of the toner chamber 13. The transparent plates 92 and 93 are fitted in the windows. A light source 94 and a photo sensor 95 are so disposed that the transparent plates 92 and 93 are located between those. An example of the light source 94 is a light-emitting diodes.

The toner shortage detector 90 is constituted by the light source 94 and the photo sensor 95. The light source 94 is driven for a predetermined time by CPU 60. A signal from the photo sensor 95 is retrieved by CPU 60, which recognizes shortage of the toner according to light detected by the photo sensor 95. If the amount of the toner 14 is more than the predetermined amount, the toner 14 blocks a light path between the light source 94 and the photo sensor 95. If the amount of the toner 14 is equal to or less than the predetermined amount, the toner 14 does not exist in the light path between the light source 94 and the photo sensor 95. Light from the light source 94 becomes incident upon the photo sensor 95, so that CPU 60 judges that there is a shortage in the toner 14.

Note that the toner shortage detector 90 may be provided in the cartridge 12 and may send toner shortage information to CPU 60 in the printer main unit 11. The light source 94 and the photo sensor 95 can be included in the cartridge 12. Also, the cartridge 12 can be provided with an extra CPU for controlling illumination of the light source 94 and determining shortage or scarcity of the toner. The extra CPU operates for determining the shortage when supplied with a data command signal from CPU 60 in the printer main unit 11.

Figure 14:
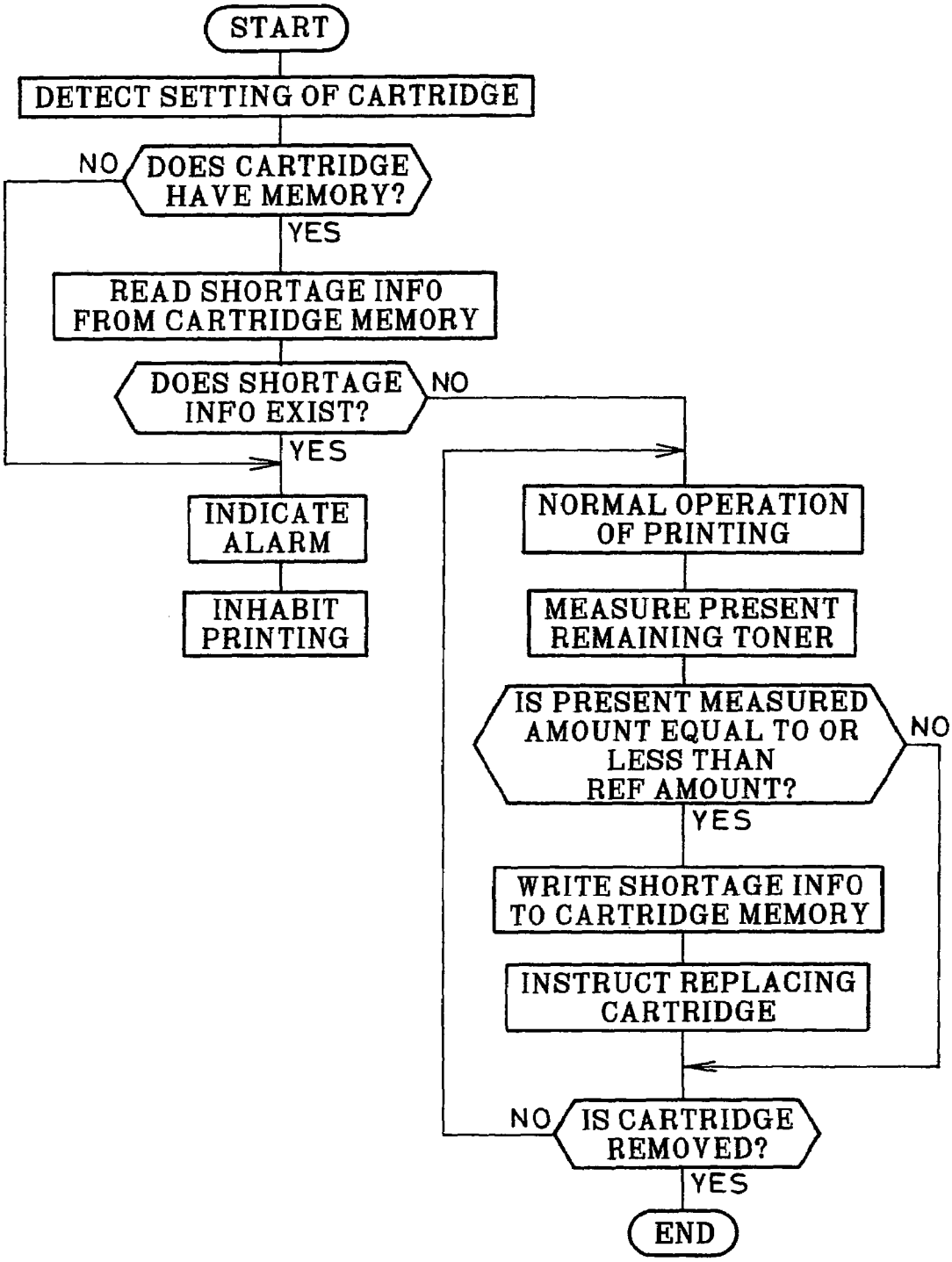
FIG. 14 is a flow chart illustrating a preferred embodiment in which shortage information is written to the cartridge memory.

In FIG. 14, a preferred embodiment is illustrated, in which the shortage information is written to the cartridge memory 65. As described above, CPU 60 checks existence or lack of the cartridge memory 65 upon setting of the cartridge 12. In addition to the shortage information, a flag for representing the existence of the cartridge memory 65 is stored in the cartridge memory 65. CPU 60, if it reads this flag, determines propriety of the cartridge from the printer manufacturer.

The cartridge 12 being not proper does not have the cartridge memory 65. No flag is read from such a cartridge. This cartridge is treated in the same manner as the improper cartridge reloaded with toner. CPU 60 generates an alarm signal to be indicated, and also inhibits printing.

If the cartridge 12 is determined proper by CPU 60, CPU 60 reads the shortage information from the cartridge memory 65. In case the cartridge 12 is unused, no shortage information is stored in the cartridge memory 65. In case the cartridge 12 has started being used, but its toner has not yet been used up, no shortage information is stored in the cartridge memory 65. In contrast, the shortage information is stored in the cartridge memory 65 if the cartridge 12 has a using history including shortage of the remaining toner for at least one time. Note that it is desirable to prevent fraudulent deletion or change of the shortage information. For this purpose, ciphered data can be used, and decoded by CPU 60. Also, a specialized protocol may be used for reading the data.

If no shortage information is stored in the cartridge memory 65, CPU 60 determines propriety of the cartridge 12 without reloading. If the shortage information is stored in the cartridge memory 65, CPU 60 determines impropriety of the cartridge 12 in which a shortage of toner occurs, or which is reloaded with toner.

If CPU 60 determines that the cartridge 12 is improper, CPU 60 generates an alarm signal informing that a proper cartridge should be used. Also, CPU 60 does not respond to a printing command signal from a personal computer or the like, and as a result, inhibits the image recorder section 62 from operating for printing.

If CPU 60 detects propriety of the cartridge, then CPU 60 enables the image recorder section 62 to operate for printing. Upon receipt of a command signal from a personal computer or the like, CPU 60 sequentially controls the image recorder section 62 to record an image or letters to the recording sheet 21. While the printer 10 operates normally, CPU 60 causes the toner shortage detector 90 to check shortage of toner at each time that a prescribed number of prints are produced, or at each time of lapse of prescribed time. If shortage of toner is detected, then CPU 60 writes shortage information to the cartridge memory 65.

If shortage of the remaining toner occurs, the indicator 63 is caused to indicate requirement of replacing the cartridge. Note that a small amount of the toner 14 remains upon the occurrence of the shortage. The printer can be operated to produce a small number of prints. The cartridge is exchanged by following the instructions indicated by the indicator 63, so that the printer 10 operates to check existence or lack of the cartridge memory, check existence or lack of the shortage information. No shortage information is written to the unused cartridge. Thus, the printer can be operated normally as described above.

As described above, a reloading agent may reload an emptied cartridge with toner. When such a cartridge is set in the printer main unit 11, shortage information is checked. The cartridge memory 65 in the toner reloaded cartridge stores the shortage information, because there has been toner shortage for one time. CPU 60 determines that the cartridge has been reloaded and is improper, generates an alarm signal and inhibits printing.

Figure 15:
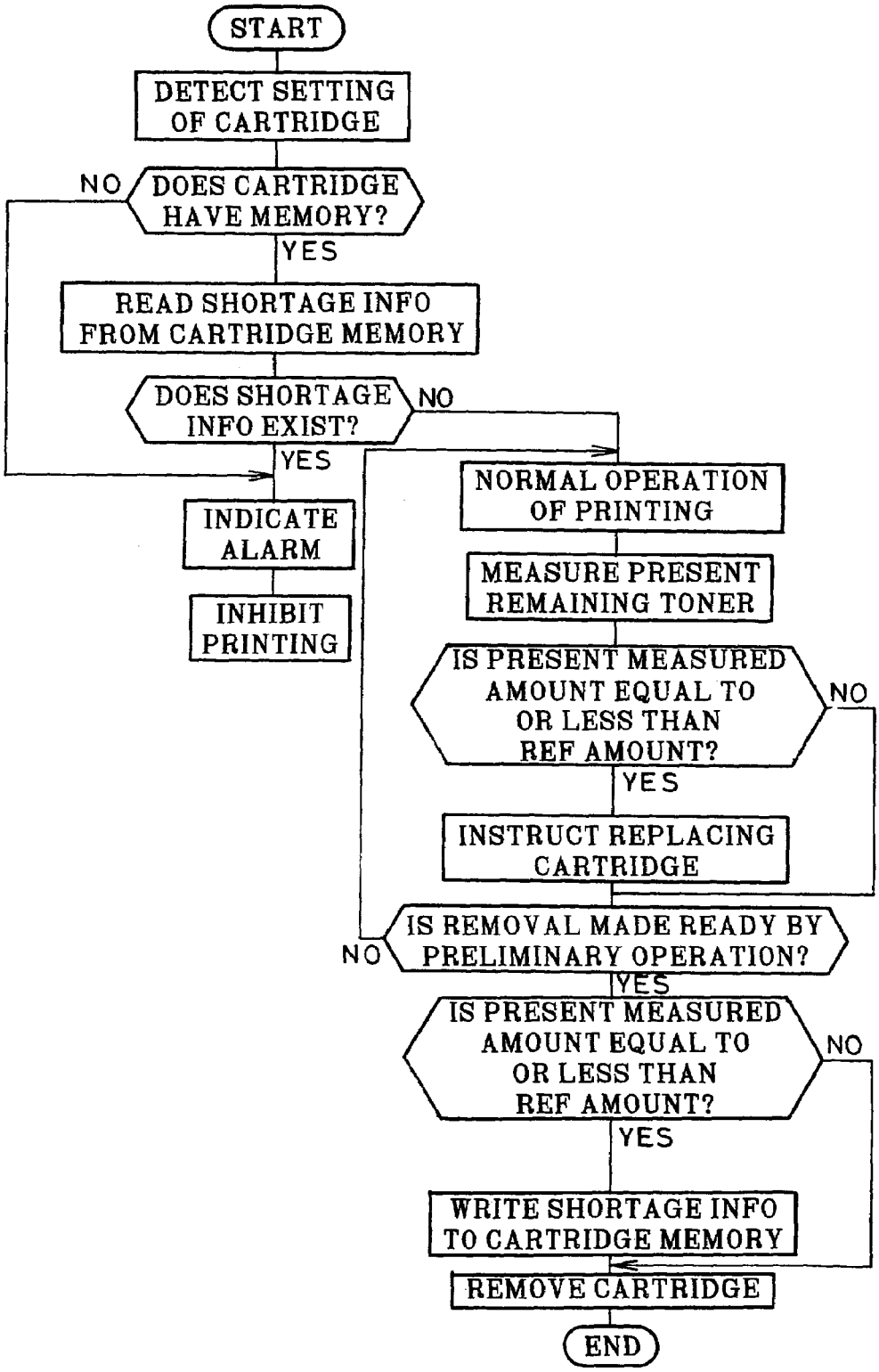
FIG. 15 is a flow chart illustrating a preferred embodiment in which the shortage information is written to the cartridge memory upon a mechanical operation preliminary to removal of the cartridge.

In FIG. 15, a preferred embodiment is illustrated, in which shortage information is written to the cartridge memory 65 upon removal of a cartridge.

In the embodiment of FIG. 14, shortage information is checked upon setting of the cartridge 12 while the power source remains turned on. If the power source is turned on after setting the cartridge 12, there is no check of shortage information. To prevent such a situation, it is preferable to check the shortage information upon turning on the power source of the printer.

However, there is a shortcoming in the checking the shortage information upon powering the printer. Once the shortage information is written, the power source cannot be turned off for using up the remaining toner of a small amount. This shortcoming can be overcome by the embodiment of FIG. 15 in which the shortage information is written to the cartridge memory 65 at the time of removing the cartridge 12 from the printer main unit 11. It follows that no shortage information is written to the cartridge memory 65 while the cartridge 12 remains set in the printer main unit 11. The printer 10 can continue being operated even if the power source is turned off for one time.

When readiness for the cartridge removal is detected after the above-described preliminary mechanical operation, CPU 60 drives the toner shortage detector 90. If CPU 60 recognizes shortage of toner, then CPU 60 writes shortage information to the cartridge memory 65.

Figure 16:
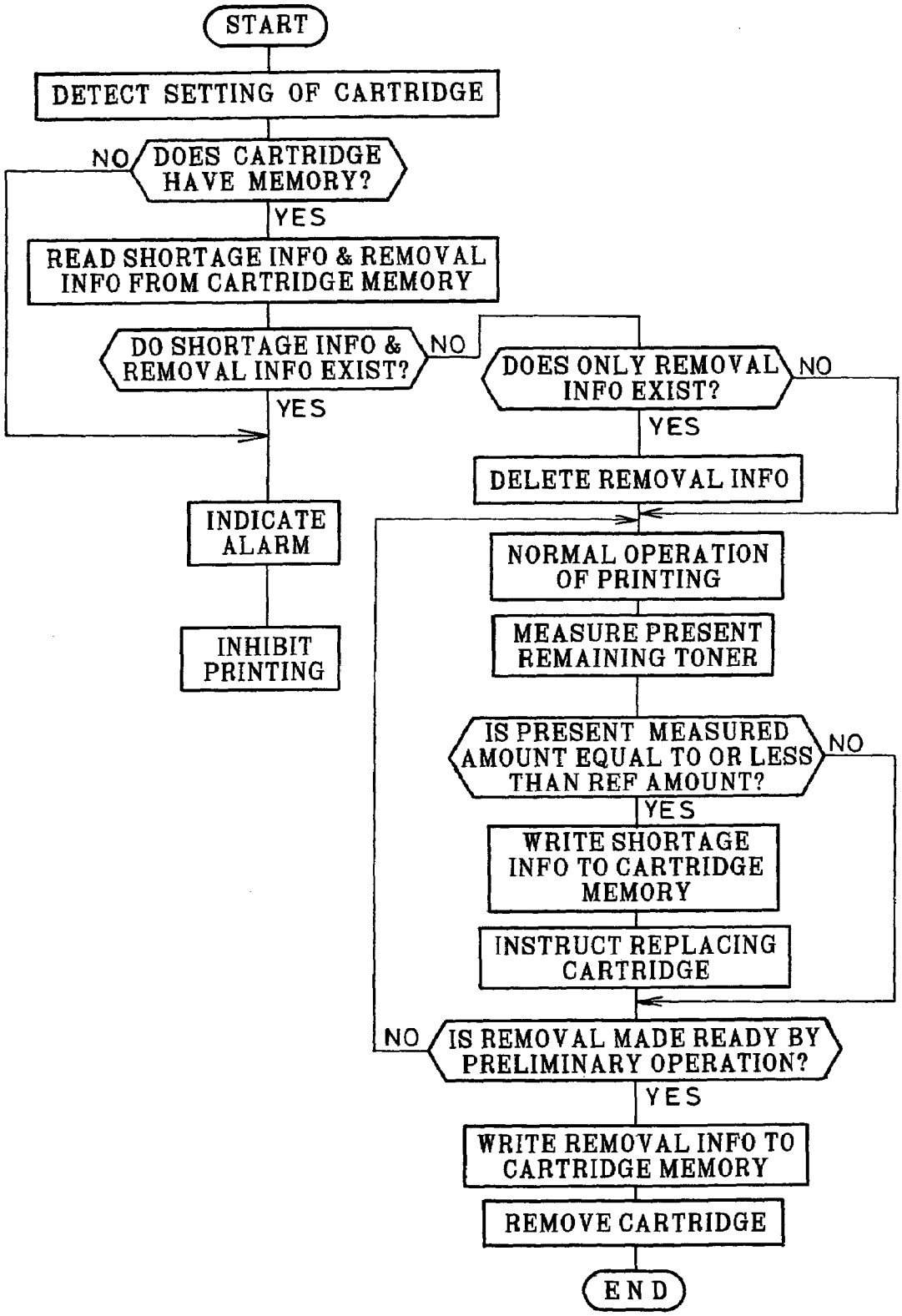
FIG. 16 is a flow chart illustrating a preferred embodiment in which toner reloading is detected according to the shortage information and removal information.

In FIG. 16, an alternative process is illustrated. Reloading of toner is estimated by reading the shortage information and removal information from the cartridge memory. Even if the power source is turned off after the shortage information is written to the cartridge memory 65, the remaining toner of a small amount can be used up. The removal information is written to the cartridge memory 65 upon a mechanical operation preliminary to the removal of the cartridge 12.

Even the shortage information is checked upon powering the printer, no removal information is written to the cartridge memory 65 while the cartridge 12 remains set in the printer main unit 11. The printer 10 can continue being operated even if the removal information exists.

If there occurs failure in printing, the cartridge 12 must be removed from the printer main unit 11. Then the removal information is written to the cartridge memory 65 at first. In this state, toner decreases to a limit value after use of the cartridge 12. The shortage information is written to the cartridge memory 65. As a result, the cartridge memory 65 has come to store both the shortage information and the removal information. There occurs a problem in that the cartridge 12 is inevitably determined improper after turning off of the power source.

To prevent this, the steps in FIG. 16 are effective. It is simply checked whether the removal information exists after checking whether both of the removal information and shortage information exist. If simply the removal information is stored in the cartridge memory 65, the same is deleted.

Figure 17:
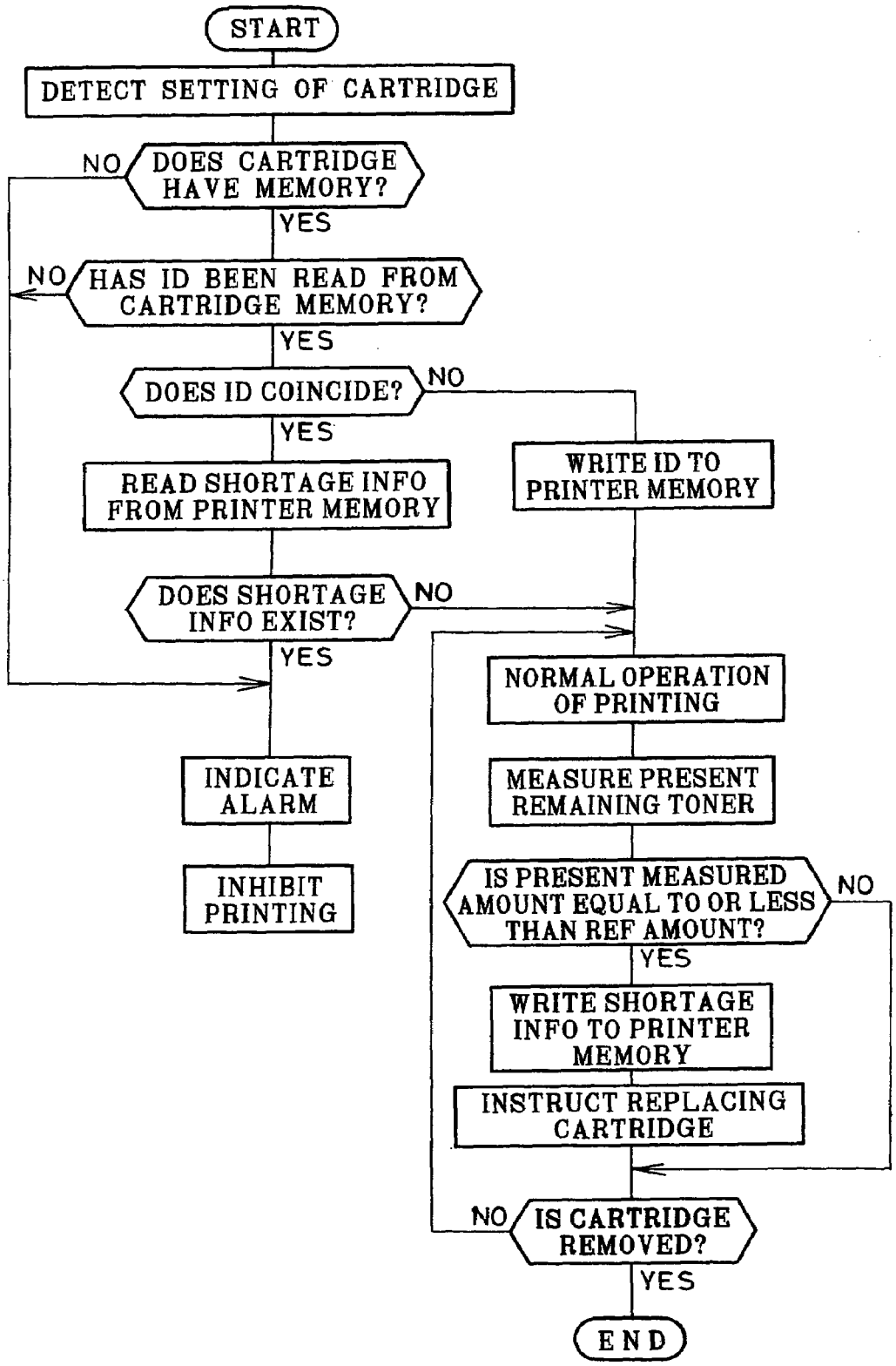
FIG. 17 is a flow chart illustrating a preferred embodiment in which a cartridge ID is stored in the cartridge memory, and the shortage information is written to the printer memory.

In FIG. 17, a preferred embodiment is illustrated, in which shortage information is written to the printer memory 61 with a cartridge ID. In a manner similar to the embodiment of FIG. 10, CPU 60 checks existence or lack of the cartridge memory 65 after setting of the cartridge 12 is detected. If the cartridge memory 65 does not exist or if no cartridge ID is read, an alarm signal is generated for indication. Printing is disabled. Then the cartridge ID is checked for determining the history of the particular cartridge including being used in the printer. If the cartridge is unused, the cartridge ID is written to the printer memory 61. As described above, the printer 10 safely can operate for printing. In the printing operation, shortage of toner is detected. Then shortage information is written to the printer memory 61 as information combined with the cartridge ID.

If the cartridge 12 is detected as used for at least one time according to checking of the cartridge ID, data of the shortage information is read from the printer memory 61 according to the cartridge ID. If the shortage information exists, the cartridge 12 is detected improper because reloaded with toner. An alarm signal is generated. Also, printing is inhibited. If the shortage information does not exist, the cartridge 12 is detected proper because not reloaded with toner. The printer 10 is caused to operate normally. Furthermore, it is preferable to use the using history information in combination with the cartridge ID as described above.

Figure 18:
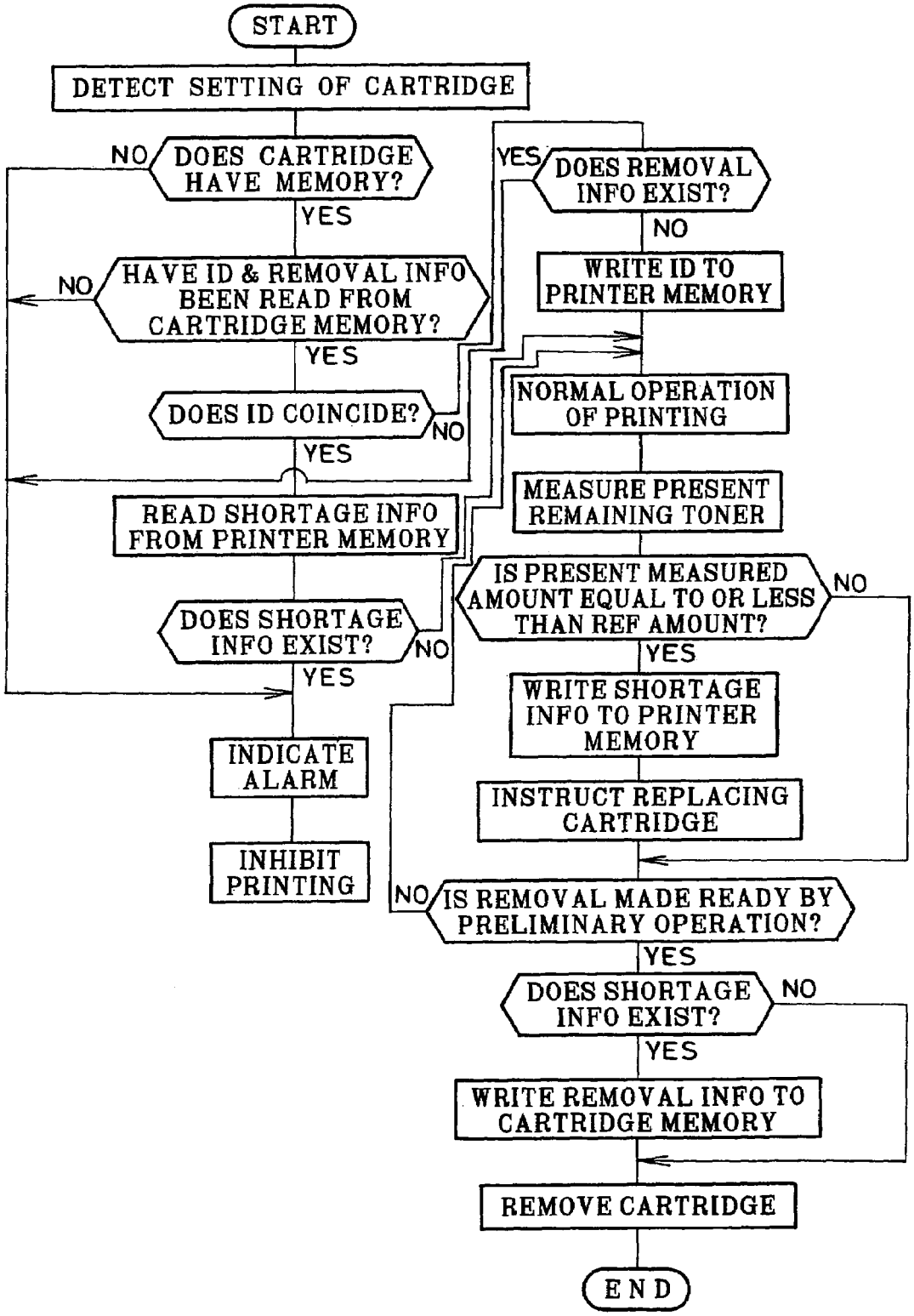
FIG. 18 is a flow chart illustrating a preferred embodiment in which the removal information is used in addition to the cartridge ID and shortage information.

In FIG. 18, a preferred embodiment is illustrated, in which removal information of a cartridge is used as using history information. At the time of removing the cartridge 12 short of toner, it is checked whether the shortage information is stored in the printer memory 61. If it is, then the removal information is written to the cartridge memory 65. The removal information represents a state where the cartridge 12 has been removed from the printer main unit 11. Thus, even though the shortage information is stored in the printer memory 61, the toner in the cartridge 12 can be used up while the cartridge 12 is kept set in the printer main unit 11. This is irrespective of turning off of the power source.

The cartridge 12 with the removal information is reloaded with the toner 14. After this, the cartridge 12 is set in the printer main unit 11 the same as before. Then existence or lack of the cartridge memory 65 is checked. Also, reading or failure in reading of information is checked. Since the printer main unit is the same as before, the used state of the cartridge is detected by checking coincidence of the cartridge ID in a manner similar to the embodiment of FIG. 16. Then existence or lack of shortage information is checked. Thus, impropriety of the cartridge is determined. Note that propriety or impropriety of the cartridge may be determined by checking existence or lack of the removal information without checking the shortage information.

If the cartridge 12 improperly reloaded with toner is set in another printer main unit, the cartridge memory 65 in the cartridge 12 stores the removal information. Existence and lack of the removal information is checked to detect that the cartridge 12 is improper. An alarm signal is generated. Printing is inhibited.

If an alarm signal for shortage of toner is generated or if irregularity in density according to positions of the recording sheet, a user can manually remove the cartridge from the printer main unit, shake the cartridge to pulverize lumps of toner locally behind a wall of the toner chamber, or to regularize distribution of toner. If shortage information is stored, there occurs a problem in that next setting of the cartridge to the printer main unit causes determination of impropriety. Printing is erroneously inhibited.

To prevent such a situation, a timer is operated to measure time during which the cartridge remains removed from the printer main unit. If the cartridge is set again without a predetermined time, for example 30 minutes, it is judged that there is no reloading of toner, to enable printing.

FIG. 18 is referred to for example. If the cartridge provided with the shortage information is removed, then the time during which the cartridge remains removed is measured in connection with the cartridge ID. When the cartridge is set again in the printer main unit, it is checked according to the cartridge ID whether the cartridge being set coincides with the cartridge related to the measurement of the time of the removed state. If it does, then it is checked whether the time of the removed state is equal to or shorter than a reference time. If it is, then the removal information is deleted. The printer 10 is enabled to operate for printing.

As described above, the used cartridge is withdrawn by the printer manufacturer, and recycled suitably. In a recycling factory, the shortage information and the removal information is deleted from the cartridge memory. Also, a new cartridge ID is written to the cartridge memory. Note that the cartridge memory may be protected from writing of the cartridge ID, shortage information or removal information. Such protection is undone before the information is read or rewritten. Cartridges recycled by the printer manufacturer are treated as proper.

In FIGS. 19–22, a preferred embodiment is illustrated, in which a characteristic value of the toner is measured, and impropriety due to reloading is determined if the measured value is not within a predetermined range. A printer in the embodiment is basically similar to that of FIG. 1. A cartridge in the embodiment is basically similar to that of FIGS. 2–4.

Figure 19:
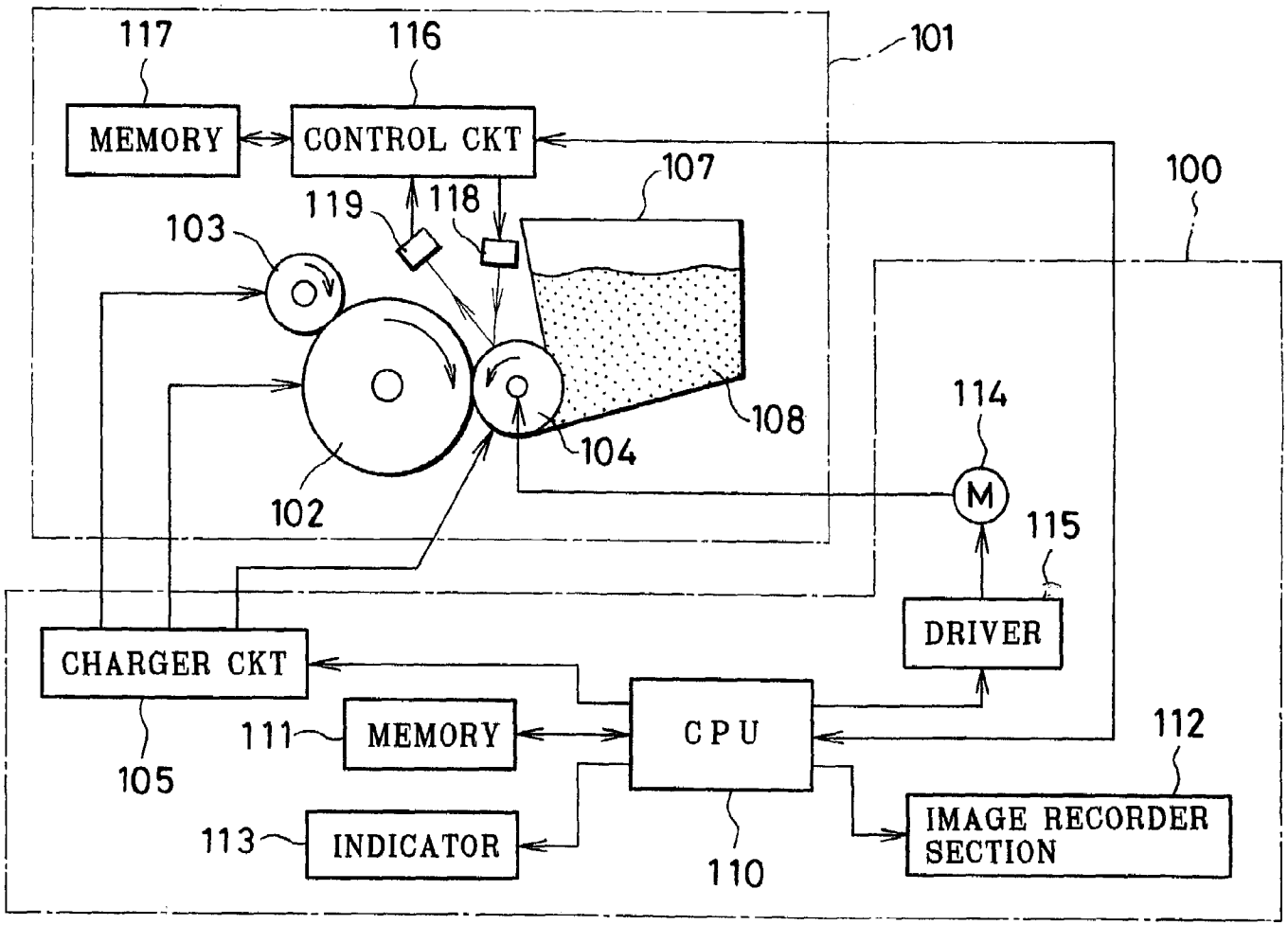
FIG. 19 is a block diagram illustrating the printer of an embodiment in which toner reloading is detected according to a change in the characteristic of the toner.

In FIG. 19, circuit arrangement of the printer is illustrated. A printer main unit 100 is provided with a cartridge 101 set thereon in a removable manner. In the cartridge 101 are rotatable a photoreceptor drum 102, a charger roller 103 and a developer roller 104. A charger circuit 105 is contained in the printer main unit 100, and charges the photoreceptor drum 102 at a voltage of approximately 400 volts, and charges the developer roller 104 at a voltage of approximately 250 volts.

A toner chamber 107 in the cartridge 101 contains toner 108. The toner 108 is mixture of toner particles of black color and abrasive particles of white color. A main composition of the toner particles is polyester, which is charged in the negative polarity by charge control agent used as additive. The abrasive particles consist of acrylic beads, and are charged in the positive polarity. The abrasive particles are stuck on surfaces of the toner particles, and operate as spacer between the toner particles and the developer roller 104, to prevent the toner particles from remaining on the developer roller 104 after printing. The density of the toner 108, namely a ratio of mixture between the toner particles and the abrasive particles is predetermined in consideration of processing characteristics of the printer, such as characteristics of the photoreceptor drum, the charging voltage, cleaning characteristics, fixing characteristics and the like.

The developer roller 104 attracts toner particles electrostatically. The abrasive particles, which are charged in a reverse polarity, are stuck to the toner particles. As described above, an electrostatic latent image has been created on a surface of the photoreceptor drum 102. A voltage of the electrostatic latent image is higher than that of the developer roller 104. When the electrostatic latent image contacts the developer roller 104, the toner 108 on the developer roller 104 is transferred to the electrostatic latent image. Thus, a visible toner image is formed.

The printer main unit 100 has the charger circuit 105 and the fixer, and also includes a CPU 110, a printer memory 111, an image recorder section 112, an indicator 113 and a motor 114. The image recorder section 112 is constituted by the laser, the polygon mirror and the like. A driver 115 drives the motor 114, to rotate the photoreceptor drum 102 and the developer roller 104. There are connection points (not shown), provided in the printer main unit 100 and the cartridge 101, for connection of electric parts.

The cartridge 101 has the photoreceptor drum 102, and also includes a control circuit 116, a cartridge memory 117, a light-emitting element 118 and a photoreceptor element 119. The light-emitting element 118 and the photoreceptor element 119 constitute a measurer for measuring toner density as one of characteristics, and starts measurement in response to a control signal from the control circuit 116. The light-emitting element 118 applies light of a regular amount to the developer roller 104 attracting the toner 108. The light reflected by the developer roller 104 becomes incident upon the photoreceptor element 119. The photoreceptor element 119 converts the reflected light to an electric signal photoelectrically, and sends the same to the control circuit 116. The signal is logarithmically converted by the control circuit 116. As a result, density of the toner stuck to the developer roller 104 is obtained by use of the photoreceptor element 119. To be precise, a value correlated to the density of the toner is obtained. The toner density is different between a genuine type of toner contained in an unused cartridge and a type reloaded in the cartridge by a reloading agent. Thus, it is possible to check whether the cartridge has been reloaded with toner by the measurement of the toner density.

The cartridge memory 117 stores data of a range of density of genuine toner designated by the printer manufacturer. The range is experimentally obtained. In manufacturing the cartridge 101, toner density is measured for a plurality of times for each cartridge. The range is determined to cover an average value of the toner density, and in consideration of differences of the measurement. As the density range is obtained for each cartridge, it is possible to discern the genuine toner in a manner free from being influenced by differences in the precision of the measurer. It is to be noted that a common range determined experimentally may be written to the cartridge memory 117. This is advantageous for its simplicity.

CPU 110 sequentially controls the various elements in the printer, and also causes the control circuit 116 to measure toner density in the toner in the toner chamber 107. CPU 110 reads information of the allowable range from the cartridge memory 117, and compares the measured density with the allowable range. If the measured density is not within the allowable range, the cartridge is determined as improper because reloaded with toner. CPU 110 causes the indicator 113 to indicate requirement of replacement with an unused cartridge, and inhibition of printing. Also, the image recorder section 112 is inhibited from operating.

Figure 20:
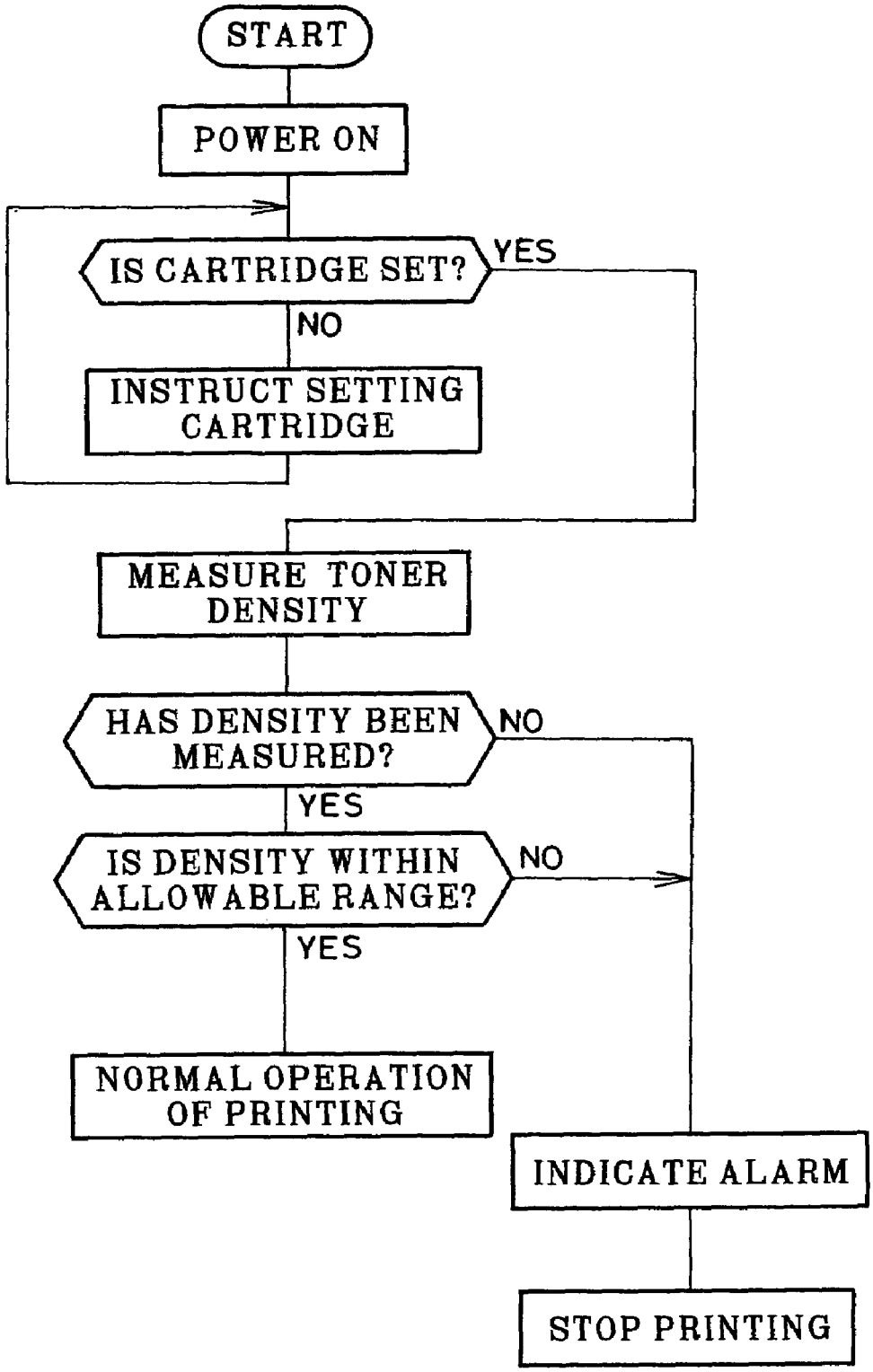
FIG. 20 is a flow chart illustrating a preferred embodiment in which the cartridge memory stores toner density of genuine toner.

In FIG. 20, the cartridge chamber is loaded with the cartridge 101 being unused. When the printer is powered, the printer main unit 100 checks whether the cartridge 101 is set or not. When no cartridge 101 is set, CPU 110 causes the indicator 113 to indicate requirement of setting the cartridge 101. If the printer has already been powered, CPU 110 judges that the cartridge 101 is set upon closing of a lid of the cartridge chamber.

When setting of the cartridge 101 is detected, CPU 110 starts warming up the printer main unit 100, and causes the control circuit 116 to measure density of the toner 108 accommodated in the toner chamber 107. The measured density is compared with the allowable range of the characteristic value stored in the cartridge memory 117. In general, the toner used by the reloading agent has different composition from that of a genuine type supplied by the printer manufacturer. The measured density is out of the allowable range of the characteristic value stored in the cartridge memory 117. Then CPU 110 judges that the cartridge 101 is improper because reloaded with toner, and generates an alarm signal for informing requirement of replacement of the cartridge 101. Even though a printing command signal is received from a personal computer, CPU 110 does not respond to the command signal, and results in inhibiting the image recorder section 112 from operating for printing.

If the cartridge is not a genuine type supplied by a printer manufacturer, it does not have a characteristic measurer. Such a cartridge cannot measure the toner density. In such a situation, CPU 110 determines impropriety of the cartridge reloaded with toner. An alarm signal is generated, printing being inhibited.

In contrast, if the measured density is within the allowable range stored in the cartridge memory 117, then CPU 110 judges that the cartridge is proper and has been supplied by the printer manufacturer, and enables the image recorder section 112 to operate for printing. When CPU 110 receives a printing command signal from a personal computer or the like, CPU 110 sequentially controls the image recorder section 112 to produce prints. If an improper cartridge reloaded with toner is used, no printing is effected even when a printing command signal is received from a personal computer or the like.

The used cartridge is returned to a cartridge dealer and withdrawn to the printer manufacturer, and recycled. In a recycling process, the cartridge 101 is filled with genuine toner, and set in an inspecting device, which rotates the developer roller 104 for testing development. In the test, the toner density is measured for plural times, to calculate an average toner density. Data of a range of which the center is defined as the average toner density is written to the cartridge memory 117.

Figure 21:
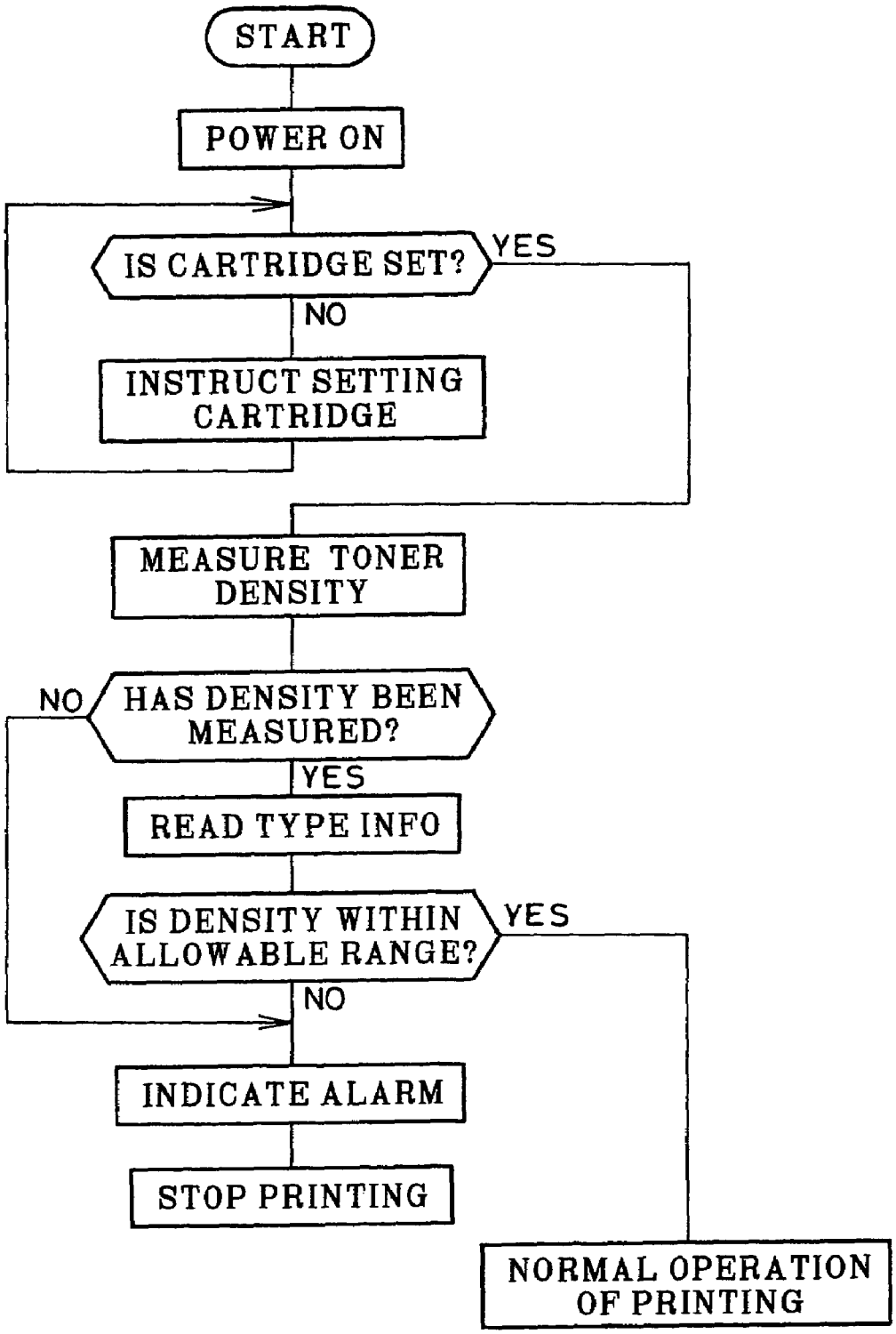
FIG. 21 is a flow chart illustrating a preferred embodiment in which the printer memory stores toner density of genuine toner.

In FIG. 21, a preferred embodiment is illustrated, in which type information is assigned to each of the cartridges to represent a type of the cartridge, and plural bodies of type information and allowable ranges of a characteristic value are stored in the printer memory. The plural types of cartridges are predetermined according to types of printers. The type information is stored in the cartridge memory 117. If the type of the cartridge is different, a different type of toner is used. Thus, the printer memory 111 previously stores the types of the cartridges and allowable ranges of a characteristic value of toner. Note that it is possible to use type information representing a type of the toner.

When the setting of the cartridge 101 is detected, CPU 110 measures density of the toner as described above. If the cartridge 101 does not have a structure for measuring the density, CPU 110 determines that the cartridge 101 is improper. After the measurement, type information is read from the cartridge memory 117. According to the type information, one of the plural allowable ranges of the characteristic stored in the printer memory 111 is read. The measured density is compared with the particular allowable range, to determine propriety or impropriety of the cartridge 101.

Note that type information of the cartridge may be stored in the cartridge memory 117. Also, a pattern of projections and/or recesses may be formed with the cartridge, and may be detected by a micro switch of the printer main unit 100 for the purpose of specifying the cartridge type. Furthermore, it is possible to use an optical code pattern including reflective and not reflective portions in combination, and an electric contact pattern including conductive and not conductive portions in combination.

Note that the characteristic value used in the above embodiment is toner density in determining the type of the toner. However the characteristic may be electrical resistance or the like. For ink of an ink cartridge as expendable material, a characteristic of the ink may be resistance, viscosity, spectral density or the like. For ink ribbon of an ink ribbon cartridge as expendable material, a characteristic of the ink ribbon may be spectral density or the like.

If reloading of toner becomes widely utilized in the market, it might be inevitable in future to authorize reloading. However, it is still essential to keep the quality of a cartridge even after reloading with toner. Parts of the cartridge including a photoreceptor drum are gradually degraded with time. It is preferable to predict a lifetime of the cartridge in consideration of durability of the parts, and to inhibit the use of the cartridge when the lifetime is up. For this process, the number of times of toner reloading can be preferably used as correlated to the length of the lifetime.

Figure 22:
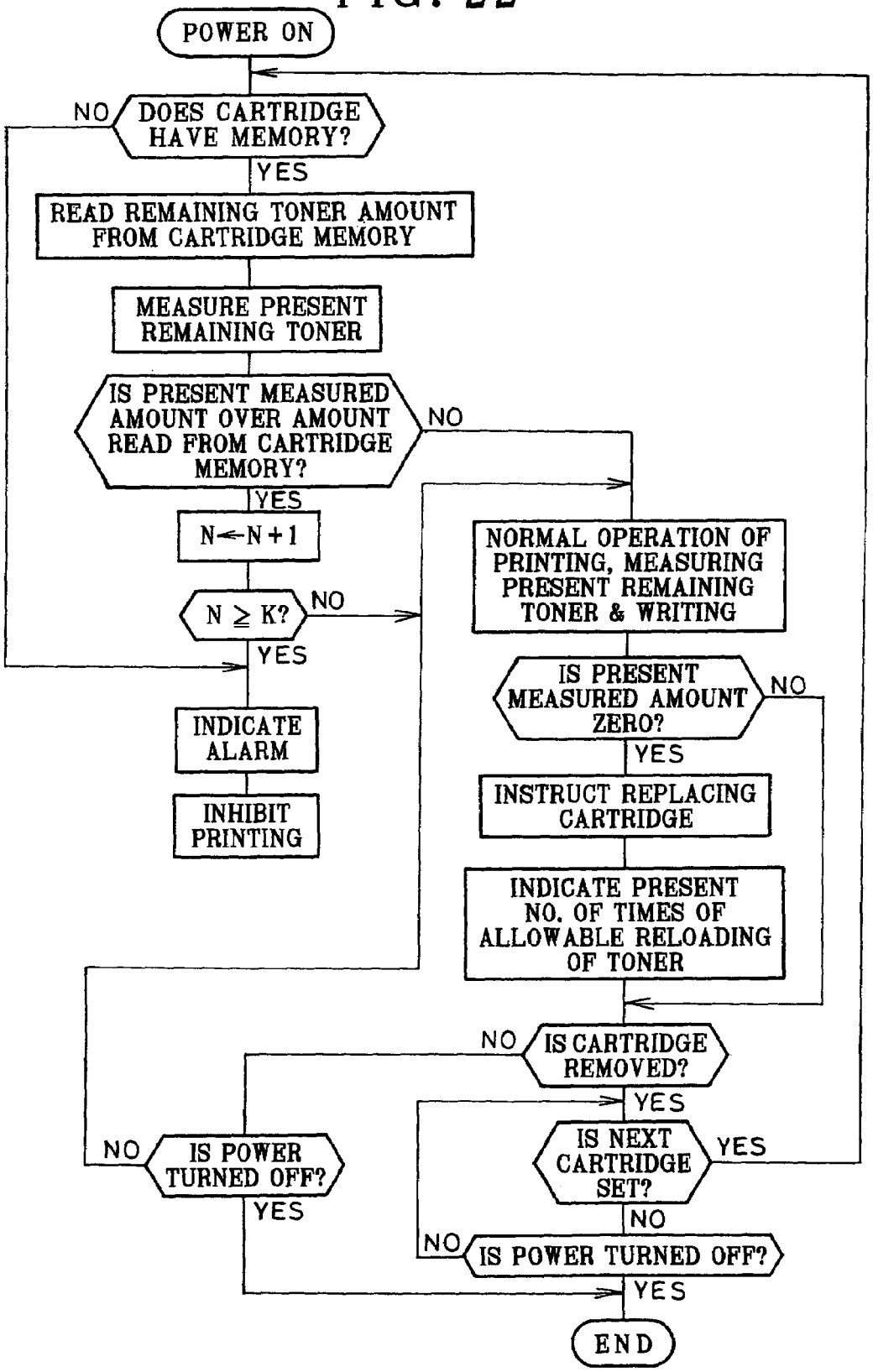
FIG. 22 is a flow chart illustrating a preferred embodiment in which the remaining toner amount is written to the cartridge memory.
Figure 23:
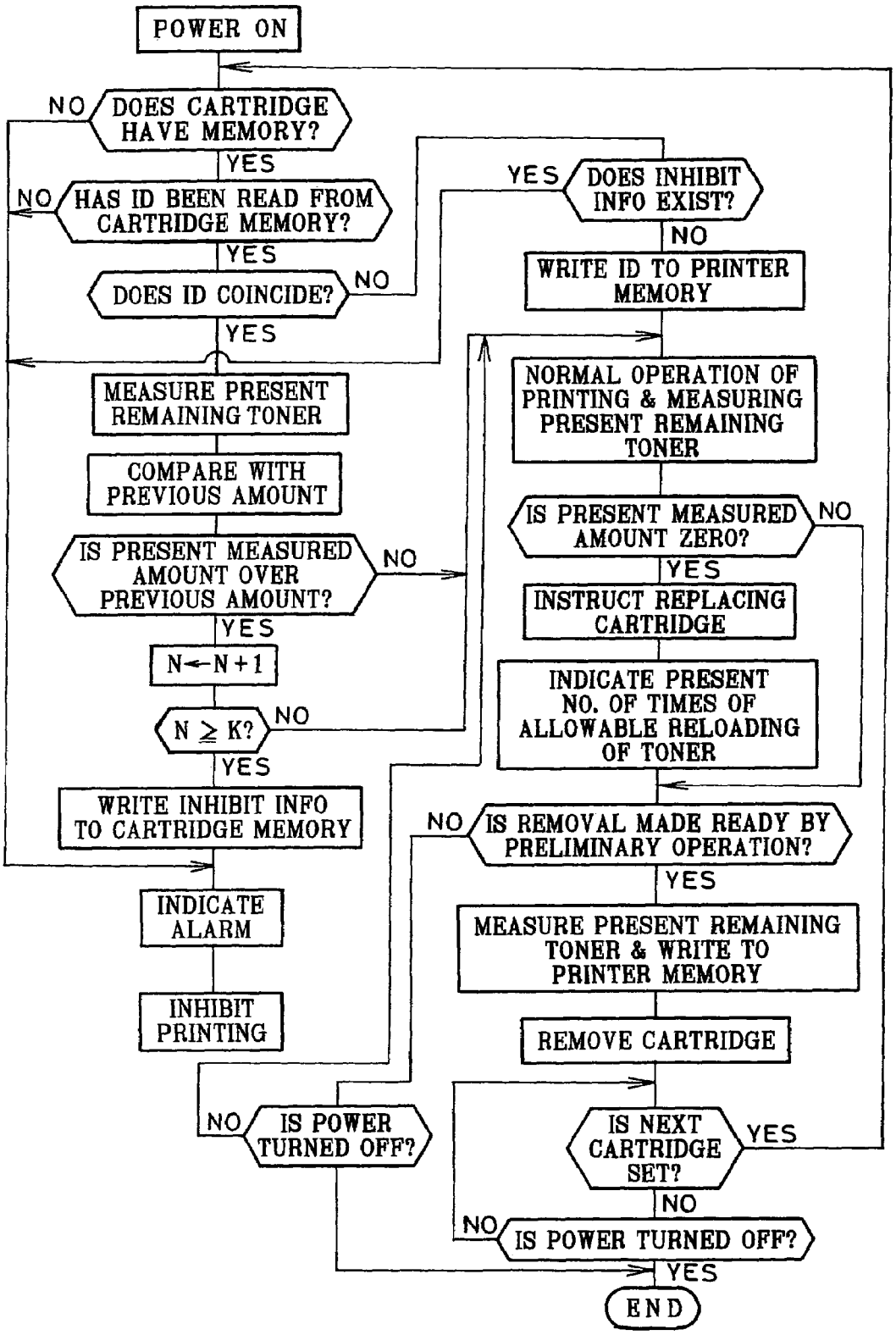
FIG. 23 is a flow chart illustrating a preferred embodiment in which the remaining toner amount is written to the printer memory.

In FIGS. 22 and 23, a preferred embodiment is depicted in which the number of times of allowable reloading of toner is limited to inhibit an improper cartridge from being used as unavailable. The printer for use with the present embodiment is schematically the same as that of FIG. 1. A mechanical structure of the cartridge is the same as that of FIGS. 2–4. The circuit arrangement of the printer is the same as that of FIG. 5. The remaining toner measurer is the same as that of FIGS. 6 and 11. Thus, elements are hereinafter designated with reference numerals in FIGS. 1–6.

In FIG. 22, the printer main unit 11 is loaded with the cartridge 12. When the power source for the printer main unit 11 is turned on, CPU 60 checks whether the cartridge 12 has the cartridge memory 65. The cartridge memory 65 stores information including the amount of the remaining toner and the number of times of reloading of the toner, and a flag for representing existence of the cartridge memory 65. Upon reading of the flag, CPU 60 determines that the cartridge 12 is proper as supplied by the printer manufacturer. If the cartridge 12 is determined as improper, the cartridge 12 is treated together with degraded cartridges. CPU 60 causes the indicator 63 to indicate the alarm, and inhibits the image recorder section 62 from printing operation.

If CPU 60 recognizes that the cartridge 12 is a proper type, CPU 60 reads data of the amount of the remaining toner from cartridge memory 65. If the cartridge 12 is unused, the cartridge memory 65 stores predetermined data representing the full amount of toner loaded in the course of manufacturing the cartridge 12. If the cartridge 12 is used, the cartridge memory 65 stores data of the amount of previous remaining toner measured by the remaining toner measurer 64.

Then CPU 60 causes the remaining toner measurer 64 to measure the toner 14 remaining in the toner chamber 13. CPU 60 compares the amount of the measured remaining toner with that read from the cartridge memory 65. If the measured remaining toner is more than the remaining toner according to the information read from the cartridge memory 65, then CPU 60 detects that there has been reloading or addition of the toner. If the measured remaining toner is as much as or less than the remaining toner according to the cartridge memory 65, then CPU 60 detects that no reloading has occurred.

If CPU 60 recognizes the reloading of the toner, then CPU 60 adds one (1) to the number N of times of reloading of the toner stored in the cartridge memory 65, obtains the number N+1, and writes the number N+1 to the cartridge memory 65. Then CPU 60 checks whether the renewed number N has come up to the reference number K representing an upper limit of times of reloading of the toner.

If the number N has come up to the reference number K, then CPU 60 determines that the cartridge 12 is degraded and improper. An alarm signal is generated visually or acoustically to inform that the cartridge 12 is improper, that printing quality will be unacceptably low, or that a proper cartridge should be substituted. Also, CPU 60 inhibits the image recorder section 62 from operating for printing.

The photoreceptor drum, the developer roller and the various parts are degraded with time. The degradation is correlated with a used amount of the toner, so the degree of the degradation is estimated according to the number of times of reloading. According to experiments, the cartridge is repetitively reloaded with the toner. The degree of the degradation comes up to reach the lapse of a lifetime of the cartridge. Thus, the reference number K as the maximum number of times of reusing the cartridge by loading of toner is obtained. For a normal type of cartridge, K=2 or 3.

The restriction of the number of times of reloading the toner 14 is also effective in regulating unauthorized reloading of the toner 14 by printer dealers or the like. As a result, profits of the printer manufacturer will be ensured. There is a type of the cartridge 12 in which parts including the photoreceptor drum must be renewed upon using up the toner 14. For such a type, it is preferable to inhibit the use of the cartridge 12 reloaded with the toner 14 for the purpose of maintaining expected quality in printing. Of course, a certain user may reload the cartridge 12 with the toner 14 without knowledge of impropriety of the reloading. If this user is obliged to abandon the cartridge 12 reloaded with the toner 14 by him or her, there occurs waste in his or her expense for the toner. In view of this, the reference number K can be determined two (2), which allows the user to use the cartridge 12 reloaded with the toner 14 at one time. This is preferable to users.

If the number N of toner reloading times is smaller than the reference number K, CPU 60 determines that the cartridge is proper because not degraded, and enables the image recorder section 62 to operate for printing normally. During the printing operation, CPU 60 causes the remaining toner measurer 64 to measure the remaining toner at each time that a prescribed number of prints are produced, or at each time of lapse of prescribed time. The remaining toner amount is written to the cartridge memory 65.

While the printer 10 operates normally, the measured remainder of the toner becomes zero or a limit predetermined suitably. Then CPU 60 drives the indicator 63 to indicate requirement of replacement of the cartridge 12. Also, CPU 60 causes the indicator 63 to indicate the number K−N or the present number of times of allowable reloading of the toner. Thus, the user can be informed of the present number of times of allowable toner reloading, or that the cartridge 12 is degraded.

If another unused cartridge is set in the cartridge chamber, the above-described control is effected for checking the existence of the cartridge memory 65, the increase in the toner and the number of times of the reloading. When the power source is turned off, the sequential control of CPU 60 is terminated.

The cartridge short of the toner is withdrawn by the printer manufacturer, and reloaded with toner. When the cartridge 12 reloaded with the toner in a proper manner is set in the printer main unit 11, the above-described control is effected for checking the increase in the toner. CPU 60 recognizes that there has been reloading of the toner.

When toner reloading is detected, the number N of the toner reloading times is stepped incrementally. It is checked whether the number N has come up to the reference number K to detect impropriety of the cartridge. Upon detecting impropriety, the indicator 63 is driven to indicate an alarm. Printing is inhibited.

In FIG. 23, a preferred embodiment is illustrated, in which a cartridge ID is assigned to each cartridge and the printer memory 61 stores the cartridge ID, the amount of the remaining toner and the number of times of reloading. When the power source for the printer main unit 11 is turned on, CPU 60 checks the existence of the cartridge memory 65 in the above-described manner. A cartridge without the cartridge memory 65 is judged as improper. Then the cartridge ID is read from the cartridge memory 65. If no cartridge ID is read, an alarm signal is generated visually. Printing is inhibited.

Then it is checked whether the cartridge ID coincides with that of a cartridge which has been set in the printer main unit 11. If it is confirmed that the cartridge 12 has been once set in the printer main unit 11 according to the cartridge ID, then the remaining toner measurer 64 measures the remaining toner in the toner chamber 13. The printer memory 61 stores the cartridge ID and the previously measured amount of the remaining toner. According to the cartridge ID read from the cartridge memory 65, data of the previously measured amount of the remaining toner is read from the printer memory 61.

CPU 60 compares the amount of the present remainder with the amount of the previous remainder read from the printer memory 61, and if the present remainder is more, then judges that there has been reloading. Then CPU 60 reads the number N of times of reloading stored in the printer memory 61 with the cartridge ID, and renews the number N by use of the number N+1. Then CPU 60 checks the degraded and improper state of the cartridge 12 by evaluating the number N with reference to the reference number K, and if impropriety is recognized, generates an alarm signal and inhibits printing. Also, CPU 60 writes inhibit information to the cartridge memory 65.

In contrast, the cartridge 12 can be used normally for printing if no increase in the toner is detected in the cartridge 12, or if the number N is confirmed to be smaller than the reference number K.

If an improper cartridge of which the number of times of the reloading has come up to the reference number is set in another printer, the printer is caused to read a new cartridge ID and determine wrongly that the cartridge is unused and proper. In the present embodiment, however, the inhibit information is used to prevent errors in the determination of the state of the cartridge.

The cartridge 12 without the inhibit information is determined as unused. The data for the full amount of toner is written to the printer memory 61. The full amount is of course the amount of toner filled in the toner chamber 13 in the course of manufacturing the cartridge 12. After writing to the printer memory 61, the printer 10 operates for printing normally as described with FIG. 22. Then the remaining toner is measured during the printing operation. If remaining toner decreases to zero, the indicator 63 is caused to indicate requirement of replacement of the cartridge. Also, the indicator 63 indicates the number of times of allowable reloading of the toner.

Before removing the cartridge 12 from the printer main unit 11, the remaining toner measurer 64 is operated to measure the present remaining toner. The measured amount of the same is written to the printer memory 61 at an address of the cartridge ID. After the removal of the cartridge 12, a new cartridge is set, and then is inspected in the manner above. The power source is turned off, to terminate the sequential control of CPU 60.

In the above embodiment, the toner reloading is detected by checking the increase in the toner. Alternatively, the cartridge may be provided with a measuring unit for measuring a certain characteristic of the toner, such as reflection density or electric resistance, and may detect the toner reloading if there is a change in the characteristic. There is a type of the cartridge 12 in which parts must be disassembled before reloading of the toner 14. For such a type, it is preferable to detect occurrence of disassembling operation for the purpose of detecting the toner reloading.

In FIGS. 24–31, a preferred embodiment is illustrated, in which a cartridge is disabled from operating when toner is used up. The printer 10 in FIG. 1 is used. A cartridge 120 includes upper and lower cartridges which are structurally the same as the upper and lower cartridges 32 and 33 in FIGS. 2 and 3. Elements similar to those illustrated in FIGS. 1–4 are designated with identical reference numerals.

Figure 24:
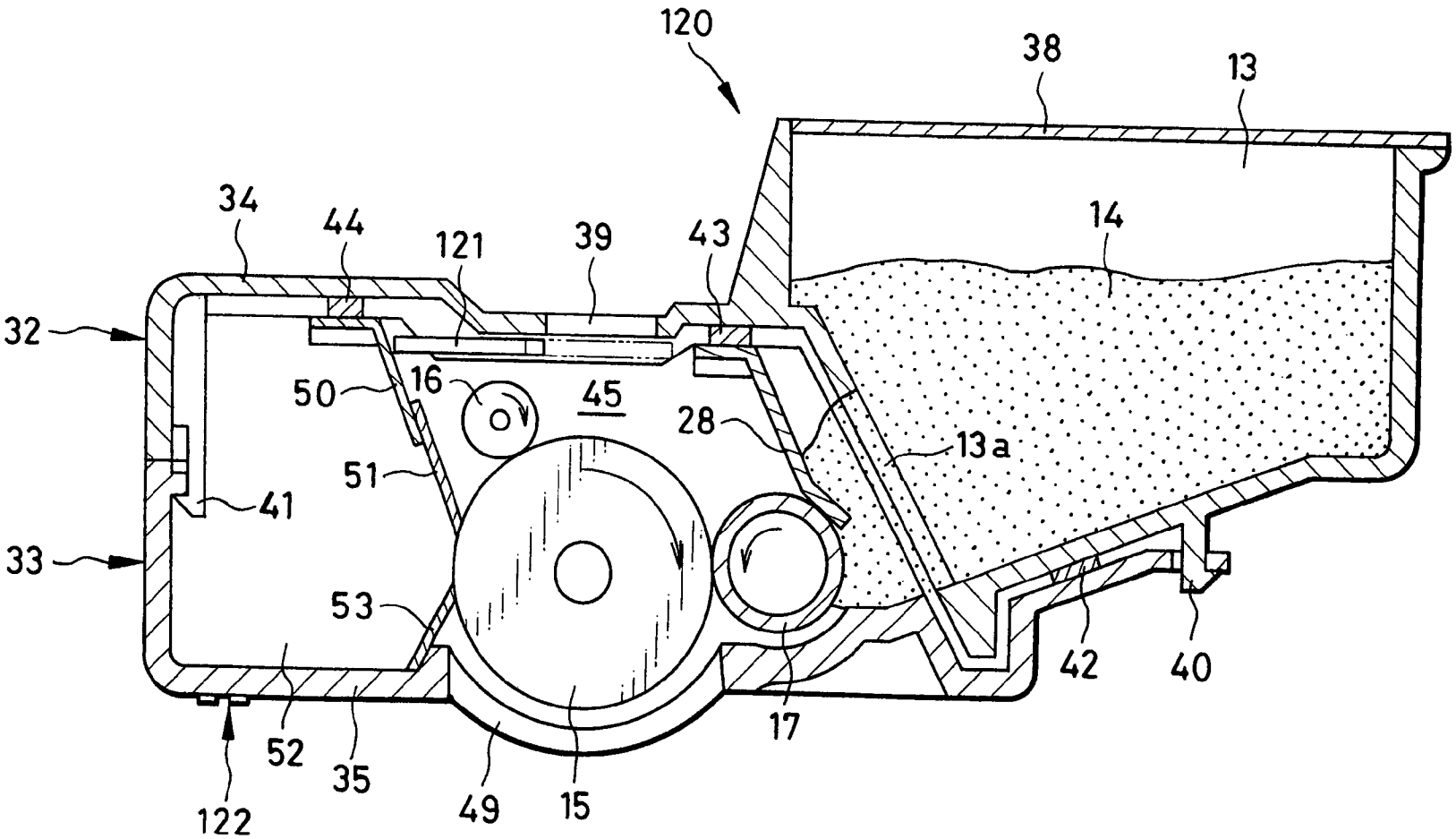
FIG. 24 is a cross section illustrating the cartridge in which operation is inhibited upon occurrence of shortage of toner.

In FIG. 24, a shutter 121 is included in the upper cartridge 32 and movable between an open position to open the exposure opening 39 and a closed position to close the exposure opening 39, and when in the closed position, blocks laser light directed to the photoreceptor drum 15. At the time of shipment of the cartridge 120 from a factory, the shutter 121 is set in the open position. While the cartridge 120 is used, the remainder of the toner 14 comes down to a predetermined limit. Then the shutter 121 is caused to move to the closed position to close the exposure opening 39. The upper cartridge 32 with the exposure opening 39 closed by the shutter 121 is improper and unavailable for printing. Note that there are connector terminals 122 in the lower cartridge 33.

Figure 25:
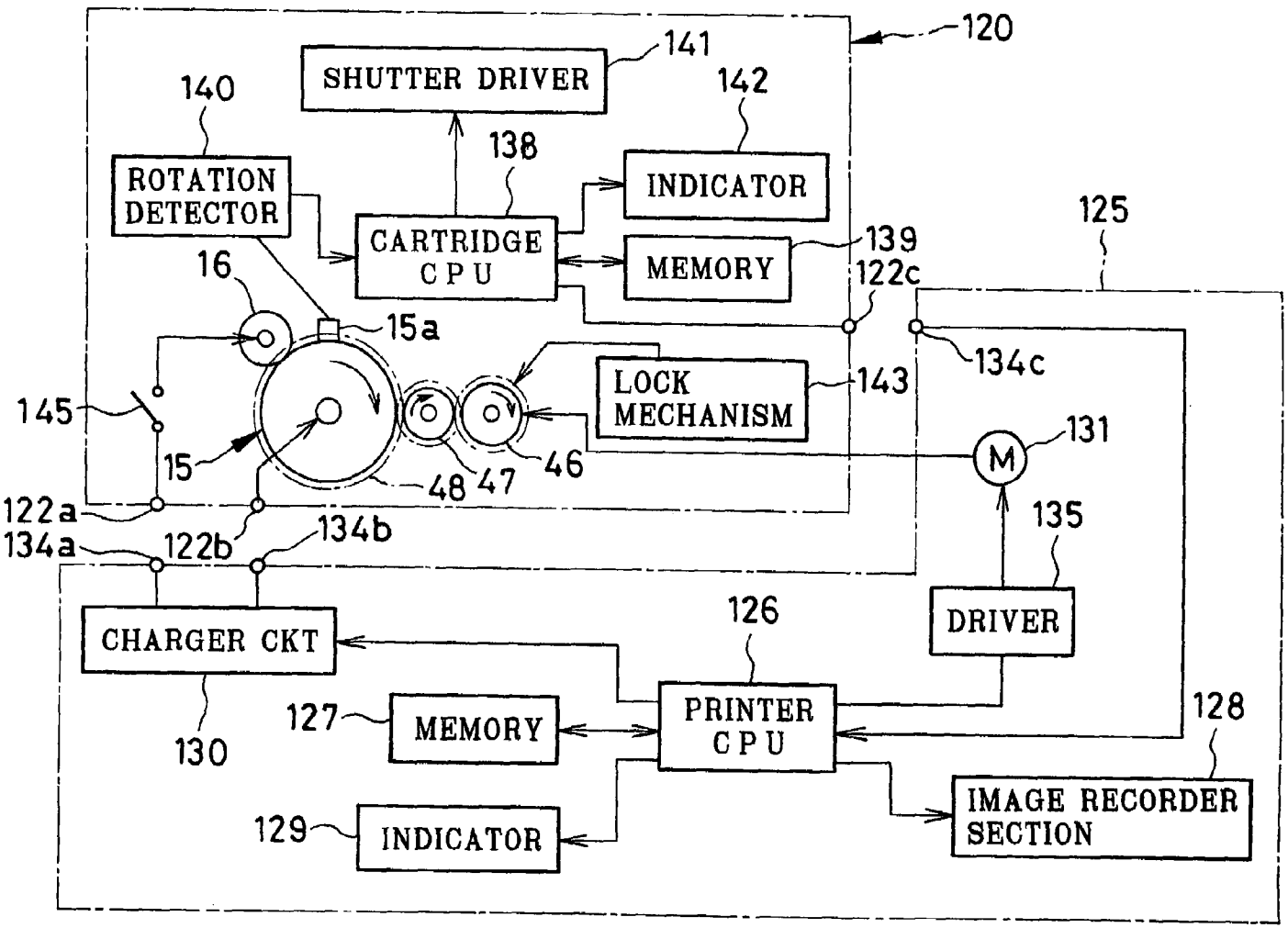
FIG. 25 is a block diagram illustrating arrangement of the circuits of the printer combined with the cartridge in FIG. 24.

In FIG. 25, a printer main unit 125 includes a printer CPU 126, a printer memory 127, an image recorder section 128, an indicator 129, a charger circuit 130 and a motor 131.

The printer CPU 126 sequentially controls elements of the printer 10 depicted in FIG. 1. The cartridge 120 has cartridge contact points 122*a*, 122*b* and 122*c*. The printer main unit 125 has cartridge contact points 134*a*, 134*b* and 134*c* for connection with the cartridge contact points 122*a*–122*c*. A driver 135 drives the motor 131 to rotate the driven gear 46, and the gears 47 and 48. The developer roller 17 rotates with the gear 47. The photoreceptor drum 15 rotates with the gear 48.

The cartridge 120 has the photoreceptor drum 15 and also includes a cartridge CPU 138, a cartridge memory 139, a rotation detector 140, a shutter driver 141, an indicator 142, a lock mechanism 143 and a switch 145. The shutter driver 141, the lock mechanism 143 and the switch 145 are controlled by the printer CPU 126, and cooperate to disable the cartridge 120 from operating. Note that the cartridge CPU 138 may operate to control the shutter driver 141, the lock mechanism 143 and the switch 145. The circuits in the cartridge 120 are supplied with power by the printer main unit 125. Of course, a battery may be accommodated in the cartridge 120 as a power source.

In the present embodiment, the used or unused state of the cartridge 120 is determined by checking the remaining toner amount according to the cumulative number of rotations of the photoreceptor drum 15. Specifically, an average amount of toner used in the course of producing a single print is empirically found. The number of rotations made by the photoreceptor drum 15 for a single print depends upon a diameter of the photoreceptor drum 15 and a size of the print. Consequently, the remaining toner amount can be estimated if the cumulative number of rotations of the photoreceptor drum 15 is checked. The rotation detector 140 detects each one of rotations of the photoreceptor drum 15. An example of the rotation detector 140 is a photo interrupter including a light source and a photoreceptor for receiving light from the light source.

A projection 15*a* is formed with an end of the photoreceptor drum 15. The light source and the photoreceptor are so disposed that the projection 15*a* is located between those. When the projection 15*a* is moved past the rotation detector 140 by rotation of the photoreceptor drum 15, light projected from the light source to the photoreceptor is blocked for a short time. The rotation detector 140 detects that the photoreceptor drum 15 has made one rotation upon passage of the projection 15*a*. Note that it is possible to use a reflection type of photo sensor instead of the photo interrupter. Also, a micro switch may be disposed so as to be turned on by the projection 15*a*, and may detect passage of the projection 15*a*.

The rotation detector 140, upon detection that the photoreceptor drum 15 has made one rotation, sends a detection signal to the cartridge CPU 138. The cartridge CPU 138 adds one (1) to the cumulative number of rotations stored in the cartridge memory 139, and writes the renewed cumulative number to the cartridge memory 139.

The cartridge memory 139 stores a reference value adapted to determine that the cartridge 120 is used. The reference number is related to rotations of the photoreceptor drum 15. It is to be noted that the remaining toner amount may be estimated according to the number of rotations of the charger roller 16, the developer roller 17 or the transfer roller 24 (See FIG. 1), because the number of rotations of any of those is correlated to that of the photoreceptor drum 15. For such an operation, a reference value to be used should be such according to the reference value associated with rotations of the photoreceptor drum 15.

The cartridge CPU 138, during the printing operation, compares the cumulative value in the cartridge memory 139 with the reference value, and when the cumulative value comes up to the reference value, judges that the cartridge 120 is used. When the printer CPU 126 receives data of the used state from the cartridge CPU 138, the printer CPU 126 causes the indicator 129 to indicate a message that the cartridge 120 should be replaced with an unused cartridge. It is to be noted that, the cumulative value in the cartridge memory 139 and the reference value may be sent via the cartridge CPU 138 to the printer CPU 126, which may effect the comparison and the judgement.

Figure 26:
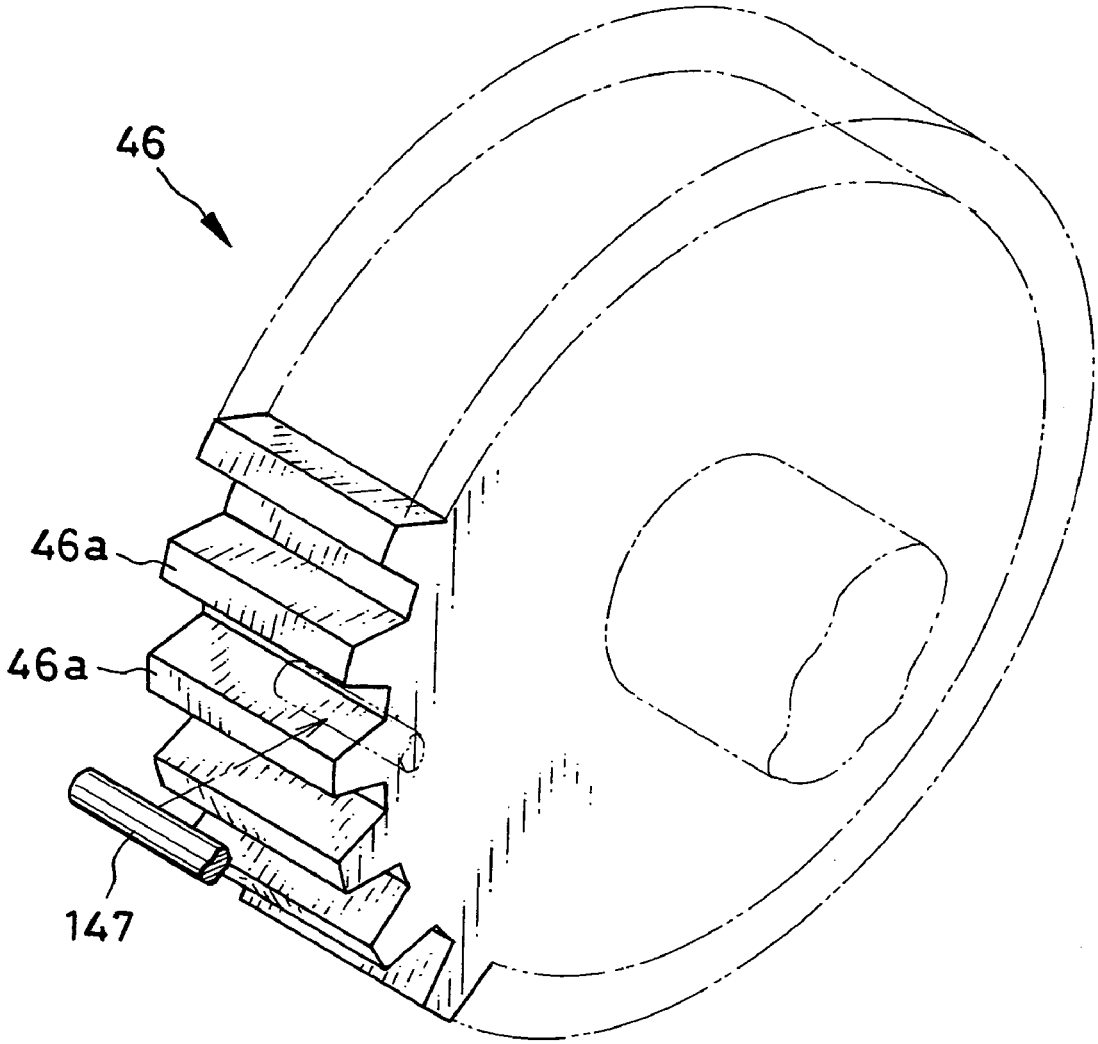
FIG. 26 is a perspective illustrating a lock mechanism for a driven gear.

The shutter driver 141 drives the shutter 121. When the cartridge 120 is determined used, the shutter driver 141 is actuated to shift the shutter 121 to the closed position. In FIG. 26, a lock pin 147 is illustrated, with which a solenoid constitutes the lock mechanism 143. The lock pin 147 is kept movable between an inserted position where inserted in a rotational orbit of teeth 46*a* of the driven gear 46, and a retracted position where retracted from the rotational orbit.

When the cartridge 120 becomes used, the solenoid starts being energized. In response, the lock pin 147 is moved to the inserted position. The lock pin 147 in the inserted position is located between the teeth 46*a*, to keep the driven gear 46 from rotating. Then rotation of the photoreceptor drum 15 and the developer roller 17 is blocked.

The switch 145 is connected in a line between the charger circuit 130 and the charger roller 16 for power supply, and turned off when the cartridge 120 is detected used. The indicator 142 is disposed in an outer wall of the cartridge 120, and when the cartridge 120 is detected used, indicates that no toner remains and the cartridge 120 is inhibited from being used.

Figure 27:
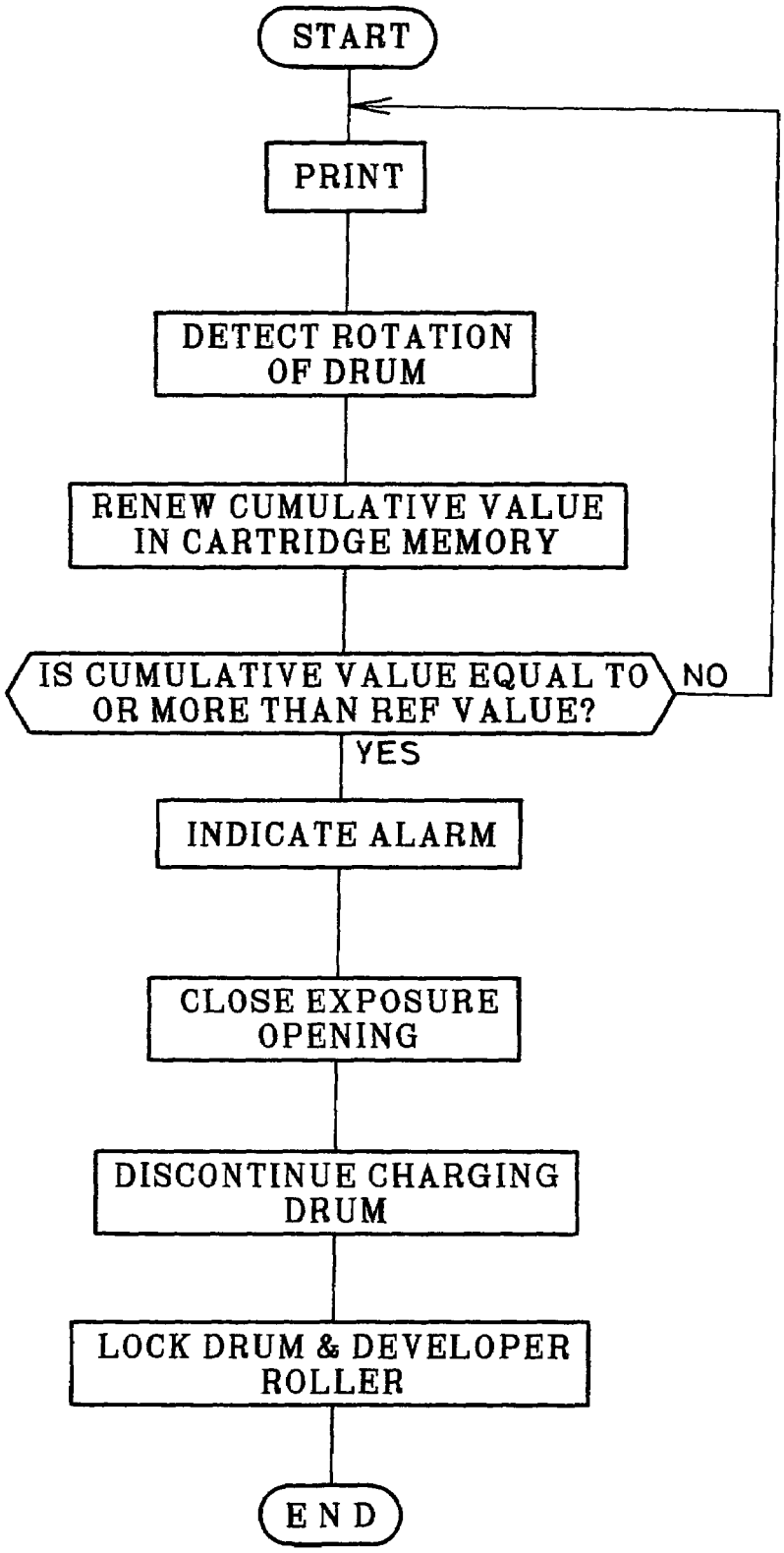
FIG. 27 is a flow chart illustrating operation of the printer in FIG. 25.

The operation of the embodiment of FIGS. 24-26 is depicted in FIG. 27. The printer main unit 125 is loaded with the cartridge 120. If the cartridge 120 is unused, the cartridge 120 operates properly. The printer normally operates to record an image to the recording paper.

While the printer operates normally, the cartridge CPU 138 receives a detection signal from the rotation detector 140 at each time that the photoreceptor drum 15 makes one rotation, to renew the cumulative value in cartridge memory 139. At each time of the renewal, the cartridge CPU 138 checks whether the cumulative value has come up to the reference value. If it has, then the cartridge CPU 138 judges that the cartridge 120 becomes used, and drives the indicator 142 to indicate that no toner remains.

The cartridge CPU 138 sends the printer CPU 126 the data representing the used state of the cartridge 120. The printer CPU 126 causes the indicator 129 to indicate requirement of replacing the cartridge 120. Furthermore, the printer CPU 126 actuates the shutter driver 141 to move the shutter 121 to the closed position closing the exposure opening 39. The switch 145 is turned off to discontinue supply of power to the charger roller 16, to stop charging the photoreceptor drum 15. Also, the lock mechanism 143 is actuated to block rotation of the driven gear 46, to keep the photoreceptor drum 15 and the developer roller 17 from rotating. Thus, the cartridge 120 is disabled from operating. Even though the cartridge 120 is reloaded with toner and placed on the printer main unit 125 after being disabled, the printer 10 does not execute the printing operation.

Note that it is possible not to use the cartridge CPU 138. The printer CPU 126 may receive the detection signal from the rotation detector 140, and renew the cumulative value in the cartridge memory 139. The amount of the remaining toner can be detected indirectly according to the cumulative value of the rotations of the photoreceptor drum 15. Also, the remainder may be detected directly by use of the remaining toner measurer illustrated in FIG. 6 or 11.

Figure 28:
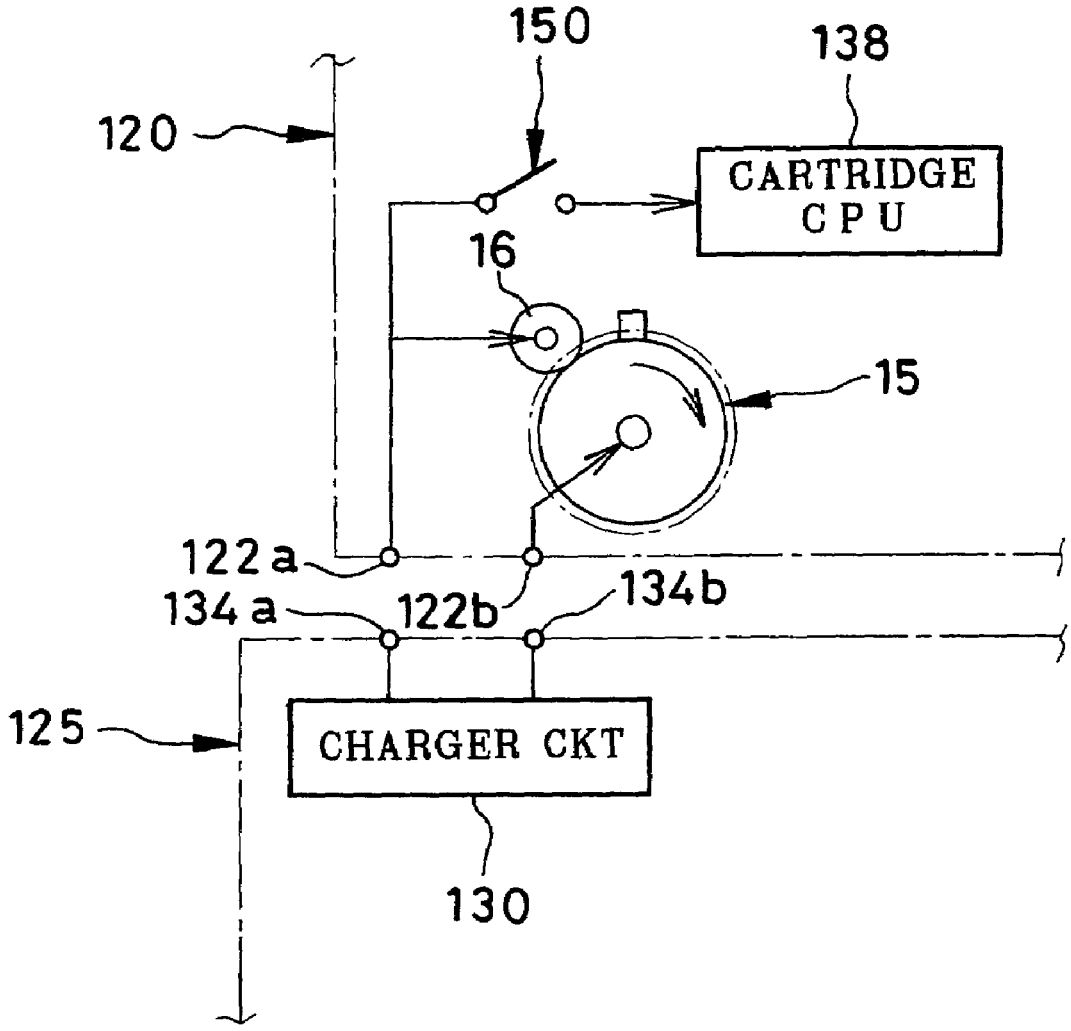
FIG. 28 is a block diagram illustrating a preferred embodiment in which a cartridge CPU is electrically destroyed to inhibit operation of the cartridge.

In FIG. 28, another preferred embodiment is illustrated, in which circuits in a used cartridge are electrically destroyed for inhibition of reuse. Elements similar to those of FIG. 25 are designated with identical reference numerals. A switch 150 is connected in a line between the charger circuit 130 and the cartridge CPU 138 for power supply. When the cartridge CPU 138 detects that the cartridge 120 is used, the cartridge CPU 138 turns on the switch 150, and causes the charger circuit 130 to apply high voltage to the cartridge CPU 138 to destroy the cartridge CPU 138 electrically. Thus, the printer CPU 126 detects that the cartridge 120 is improper because of failure in communication with the cartridge CPU 138. The printer main unit 125 effects no printing operation. Accordingly, the use of the cartridge 120 is inhibited.

Figure 29:
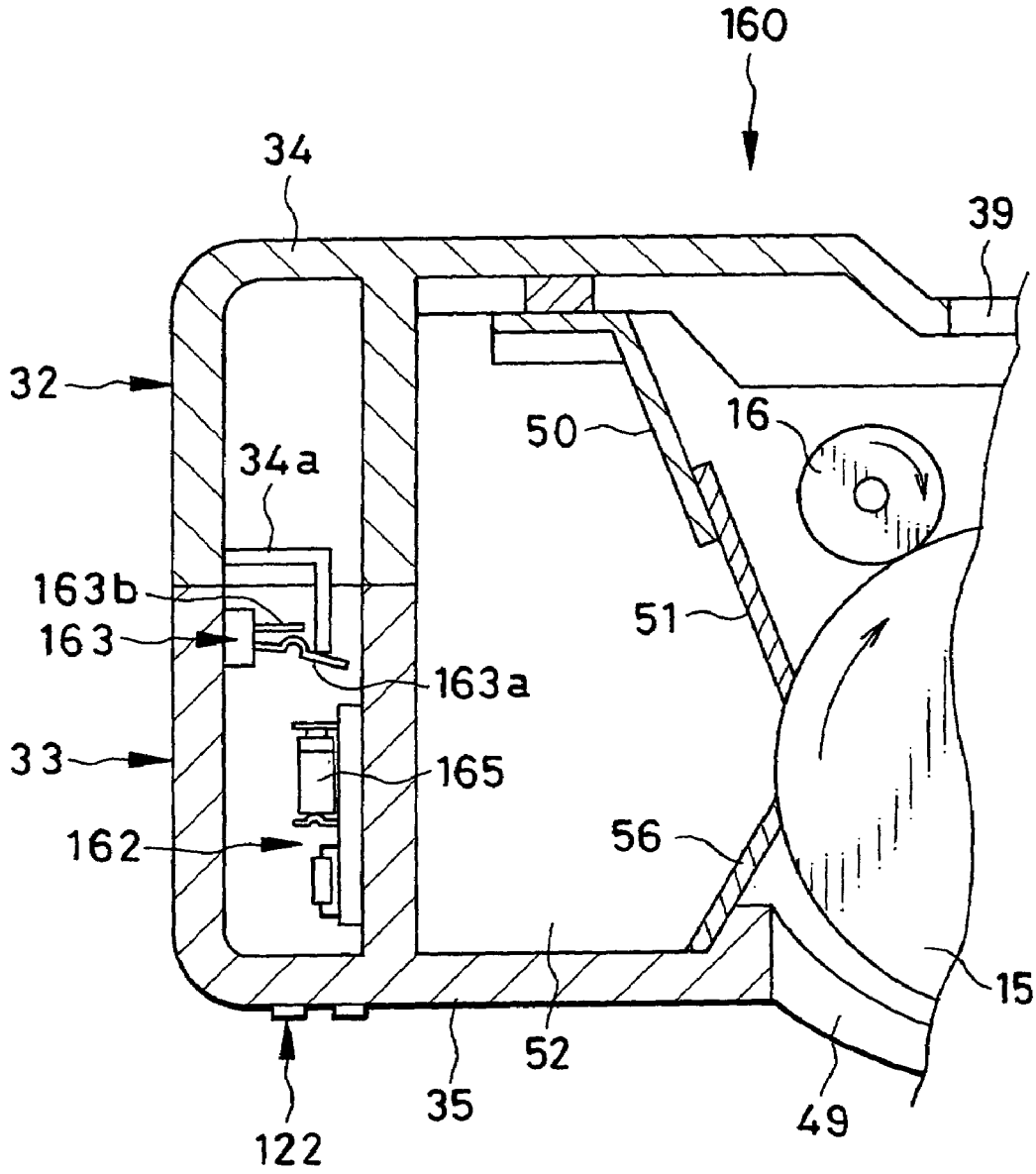
FIG. 29 is a cross section, partially broken, illustrating a preferred embodiment in which operation of the cartridge is inhibited upon disassembling the cartridge.
Figure 30:
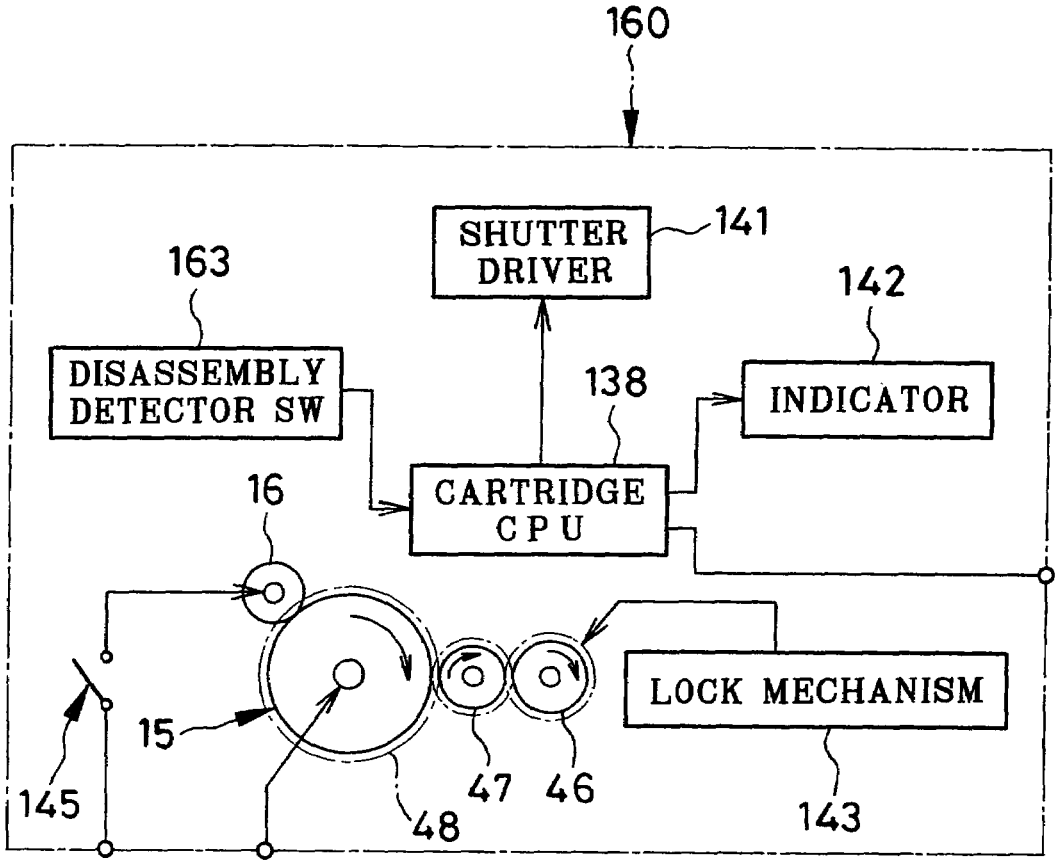
FIG. 30 is a block diagram illustrating arrangement of circuits of the cartridge of FIG. 29.

In FIGS. 29 and 30, a preferred embodiment is illustrated in which the cartridge is disabled upon being disassembled. Elements similar to those in FIGS. 24 and 25 are designated with identical reference numerals. A cartridge 160 has a disassembly detector switch 163 and a printed circuit board 162 disposed in a chamber adjacent to the waste toner chamber 52. The disassembly detector switch 163 detects a disassembled state of the cartridge 160, includes contact points 163*a* and 163*b* secured to the inside of the cartridge body 35, and is connected with the printed circuit board 162 electrically. An L-shaped depression member 34*a* is formed with the cartridge body 34.

The depression member 34*a* operates to disconnect the contact points 163*a* and 163*b* from one another by pushing a free end of the contact point 163*a* when the upper cartridge 32 is secured to the lower cartridge 33. When the lower cartridge 33 is separated from the upper cartridge 32, the depression member 34*a* comes away from the contact point 163*a*, which contacts the contact point 163*b* to turn on the disassembly detector switch 163. Note that the disassembly detector switch 163 is a mechanical switch, but also may be an optical switch or photo sensor, a magnetic sensor, and the like.

The cartridge CPU 138, when detecting turning on of the disassembly detector switch 163, writes disassembly information to the cartridge memory 139. Upon this writing, the cartridge 160 is set in an ineffective state. To be precise, the cartridge CPU 138 actuates the shutter driver 141 and the lock mechanism 143, and turns off the switch 145. Also, the indicator 142 is caused to indicate alarm information. In the printed circuit board 162 is a battery 165 by which those elements are supplied with power. Note that, when the disassembly detector switch 163 is turned on, it is possible to destroy the cartridge CPU 138 electrically by applying high voltage to the cartridge CPU 138.

Figure 31:
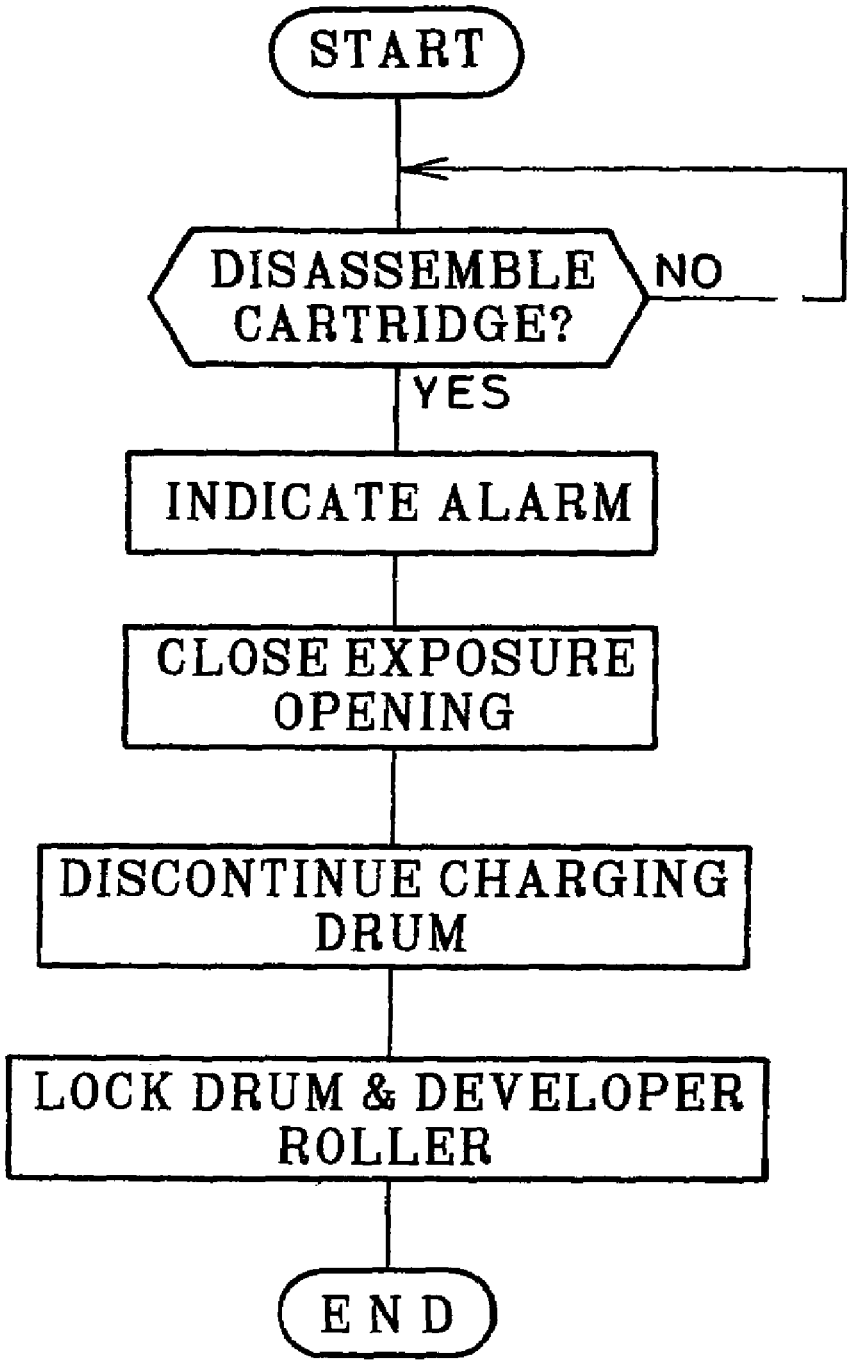
FIG. 31 is a flow chart illustrating operation of the cartridge of FIG. 30.

In FIG. 31, the disassembly detector switch 163 is turned on when the cartridge 160 is disassembled. The cartridge CPU 138 causes the indicator 142 to indicate the alarm, causes the shutter driver 141 to close the exposure opening 39, discontinues charging the photoreceptor drum 15, and also causes the lock mechanism 143 to block rotation of the photoreceptor drum 15 and the developer roller 17. Thus, the cartridge 160 is disabled from operating and inhibited from being used. Should some one wish to reload the cartridge 160 with toner, he or she must disassemble the cartridge 160. The present embodiment can prevent toner reloading agents from reloading the cartridge 160 with toner inappropriately.

In the above embodiment, the process of disabling the cartridge includes the various operations including closing the exposure opening with the shutter, discontinuing charging the photoreceptor drum, and blocking rotation of the photoreceptor drum and the developer roller. However, it is possible to use only one of those operations for disabling the cartridge. Also, it is possible to dispose a shutter at a toner chamber, and to stop supply of toner to the developer roller when the remaining toner decreases to zero.

It is possible to, if the disassembly information is written, disable the printing operation of the printer main unit in the manner similar to the shortage information instead of disabling the cartridge from operating. Also, it is possible to disable the cartridge from operating instead of disabling the printing operation of the printer main unit if the shortage information is written, if the reloading is detected after an increase in the toner, if a difference in the characteristic value is detected, or if the number of toner reloading times has come to the reference number. Furthermore, the cartridge may be disabled from operating simultaneously to disable the printing operation of the printer main unit.

Figure 32:
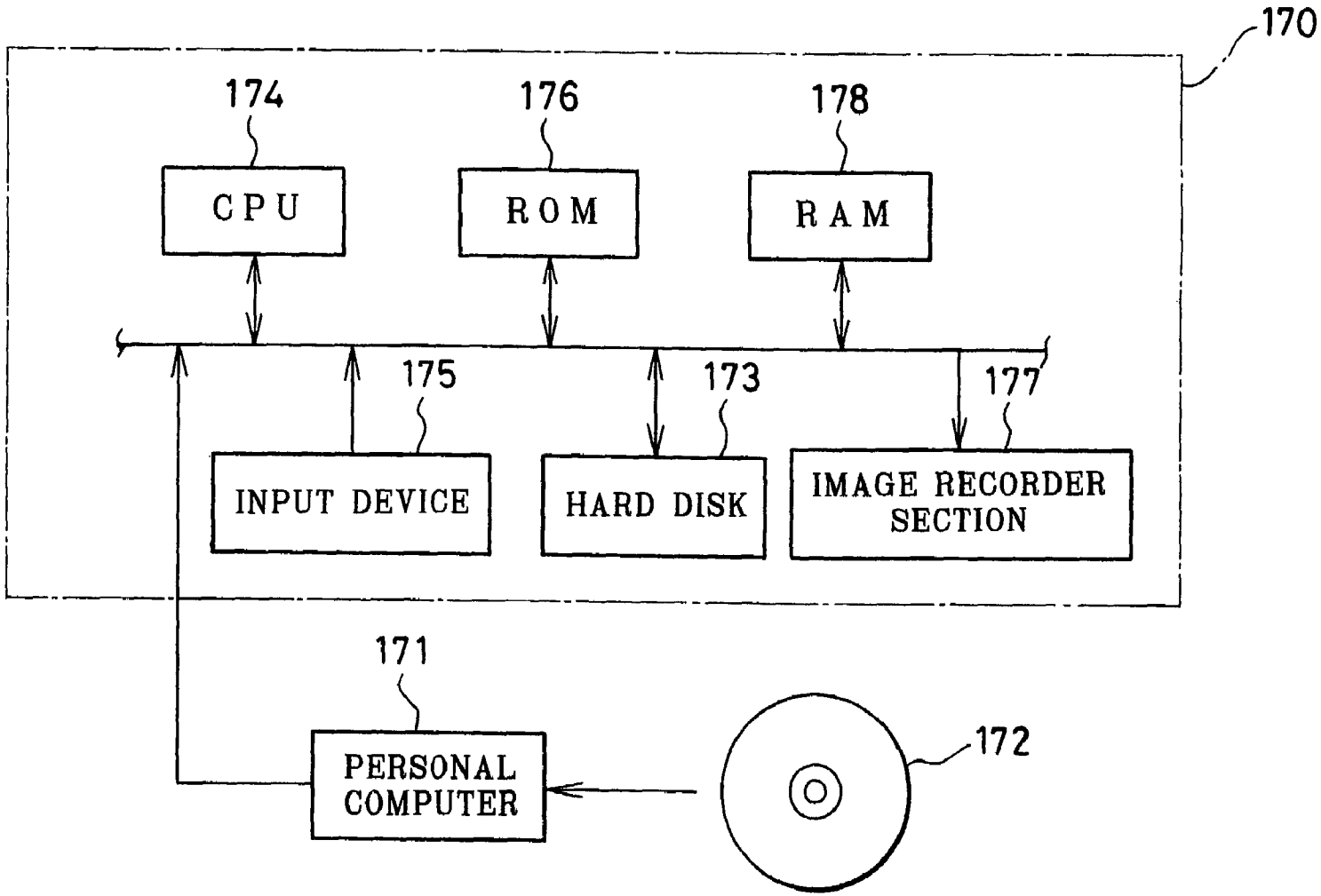
FIG. 32 is an explanatory view illustrating a preferred embodiment in which a program is installed in a printer main unit.

In FIG. 32, a preferred embodiment is illustrated, in which a program for detecting impropriety of a cartridge and inhibiting its use is stored in a recording medium such as a CD, flexible disk, IC memory, MO, DVD and the like, and the program is installed to CPU of a printer main unit 170. The printer main unit 170 is connected with a personal computer 171, and prints an image or letters to a recording sheet according to data supplied by the personal computer 171.

If the printer main unit 170 is not provided with a program for processes in FIGS. 7–10 for detecting impropriety of a cartridge and inhibiting its use, and for controlling elements related to these processes, it is impossible to inhibit the use of the improper cartridge. It is necessary in the printer main unit 170 to install the program for detecting impropriety of a cartridge and inhibiting its use.

A CD 172 stores a program for executing the process illustrated in FIG. 7. The personal computer 171 has a CD drive (not shown) in which the CD 172 is set. The personal computer 171 reads the program from the CD 172, and writes the same to a hard disk 173 included in the printer main unit 170.

A CPU 174 in the printer main unit 170 executes the program written in the hard disk 173, and thus detects the improper cartridge reloaded with toner, generates an alarm signal and inhibits the use.

An input device 175 is adapted to inputting image data or letter data sent from a scanner, a digital camera or the like. A ROM 176 stores a program for controlling printing of an image recorder section 177, a program for image processing and the like. Also, a RAM 178 stores data in a temporary manner.

Note that the CD 172 may be directly set in the printer main unit 170 to write the necessary program to a storage in the printer main unit 170. Furthermore, the CD 172 may be used while set in the printer main unit 170, which may run the program read from the CD 172, and check the toner reloading of the cartridge.

Furthermore, it is possible that the CD 172 stores any one of the program of FIGS. 14–18 in which the shortage information is used, the program of FIGS. 20 and 21 in which the characteristic value is used, the program of FIGS. 22 and 23 in which the number of times of reloading the toner is limited, the program of FIGS. 27 and 31 in which the cartridge is disabled. The CD 172 may store all of those programs, at least one of which may be designated and installed in the printer main unit 170 selectively.

The cartridge according to the above embodiments is a process cartridge. However, a cartridge according to the invention may be a toner cartridge in which toner is simply contained. Also, a cartridge according to the invention may be an ink cartridge in which ink for ink-jet printing is contained, a ribbon cartridge in which ink ribbon for a dot printer is contained, a ribbon cartridge in which ink ribbon for a thermal printer is contained, and the like. Furthermore, a device for recording an image according to the invention may be a telefacsimile, duplicator instead of the printer.

The following are preferred, exemplary, modes consistent with the concepts of the present invention.

($1^{st}$ Mode) A detector device for detecting an improper cartridge, comprising:

a detector for generating a first signal by detecting that a remaining amount of expendable material comes down to at most a reference amount, said expendable material being contained in a cartridge set in an exchangeable manner in an image recorder;

a memory caused in response to said first signal to store shortage information representing shortage of said expendable material;

a determiner for checking whether said shortage information is stored in said memory, to determine said cartridge as said improper cartridge if said shortage information is stored in said memory.

($2^{nd}$ Mode) A detector device as defined in the $1^{st}$ mode, wherein if said cartridge is determined as said improper cartridge, said image recorder inhibits image recording operation.

($3^{rd}$ mode) A detector device as defined in the $2^{nd}$ mode, further comprising an indicator for indicating alarm information if said cartridge is determined as said improper cartridge.

($4^{th}$ mode) A detector device as defined in the $2^{nd}$ mode, wherein said memory is incorporated in said cartridge.

($5^{th}$ mode) A detector device as defined in the $4^{th}$ mode, wherein said determiner checks if said memory exists in said cartridge, and determines impropriety in case of lack of said memory.

($6^{th}$ mode) A detector device as defined in the $2^{nd}$ mode, wherein upon setting of said cartridge in said image recorder, said determiner operates for determining impropriety.

($7^{th}$ mode) A detector device as defined in the $2^{nd}$ mode, wherein at a time of removal of said cartridge from said image recorder, said memory comes to store said shortage information.

($8^{th}$ mode) A detector device for detecting an improper cartridge, comprising:

a first memory, incorporated in a cartridge set in an exchangeable manner in an image recorder, for storing discernment information for discernment of respectively said cartridge;

a detector for measuring a remaining amount of expendable material contained in said cartridge and for generating a first signal by detecting that said remaining amount comes down to at most a reference amount;

a second memory, incorporated in said image recorder, caused in response to said first signal to store said discernment information and shortage information representing shortage of said expendable material;

a determiner for checking whether said shortage information is stored in said second memory according to said discernment information read from said first memory, to determine impropriety of said cartridge if said shortage information is stored in said second memory.

($9^{th}$ mode) A detector device as defined in the $8^{th}$ mode, further comprising:

an indicator for indicating an alarm information when impropriety of said cartridge is determined;

an inhibitor for inhibiting said image recorder from image recording operation.

($10^{th}$ mode) A detector device as defined in the $9^{th}$ mode, wherein said determiner checks if said first memory exists, and determines impropriety in case of lack of said first memory.

($11^{th}$ mode) A detector device as defined in the $9^{th}$ mode, wherein upon setting of said cartridge in said image recorder, said determiner operates for determining impropriety.

($12^{th}$ mode) A detector device as defined in the $9^{th}$ mode, wherein at a time of removal of said cartridge from said image recorder, said second memory comes to store said shortage information.

($13^{th}$ mode) A detecting method of detecting an improper cartridge, comprising steps of:

measuring a remaining amount of expendable material contained in a cartridge set in an exchangeable manner in an image recorder;

if said remaining amount decreases to at most a reference amount, assigning shortage information to said cartridge, said shortage information representing shortage of said expendable material;

when said shortage information is assigned to said cartridge, determining said cartridge as said improper cartridge;

when said cartridge is determined as said improper cartridge, generating an alarm signal or inhibiting image recording operation.

($14^{th}$ mode) A recording medium for storing a program for being run in a computer for an image recorder, said program including:

a detecting function for detecting a decrease of a remaining amount of expendable material to at most a reference amount, said expendable material being contained in a cartridge set in an exchangeable manner in said image recorder;

a writing function for writing shortage information to a memory upon detection of said decrease of said remaining amount to at most said reference amount, said shortage information representing shortage of said expendable material;

a checking function for checking whether said shortage information is stored in said memory, to determine impropriety of said cartridge if said shortage information is stored in said memory.

($15^{th}$ mode) A recording medium for storing a program for being run in a computer for an image recorder, said program including:

a reading function for reading discernment information for discernment of a cartridge from a first memory in said cartridge, said cartridge being set in an exchangeable manner in said image recorder;

a detecting function for detecting that a remaining amount of expendable material comes down to at most a reference amount, said expendable material being contained in said cartridge;

a writing function for writing said discernment information and shortage information to a second memory in said image recorder upon detecting that said remaining amount has come down to at most said reference amount, said shortage information representing shortage of said expendable material;

a determining function for checking whether said shortage information is stored in said second memory according to said discernment information read from said first memory, to determine impropriety of said cartridge if said shortage information is stored in said second memory.

($16^{th}$ mode) A detecting system for detecting an improper cartridge, comprising a cartridge and an image recorder device;

said cartridge including:

an expendable material chamber for containing expendable material for use in image recording;

a memory for storing shortage information upon detection that a remaining amount of said expendable material is at most a reference amount, said shortage information representing shortage of said expendable material;

said image recorder device including:

an image recorder section for recording an image to recording material;

a detector for detecting a decrease of said remaining amount of said expendable material to at most said reference amount, said expendable material being contained in said cartridge being set;

a writer for writing said shortage information to said memory upon detection of said decrease of said remaining amount to at most said reference amount;

a determiner for checking whether said shortage information is stored in said memory, to determine said cartridge as said improper cartridge if said shortage information is stored in said memory.

($17^{th}$ mode) A detecting system for detecting an improper cartridge, comprising a cartridge and an image recorder device;

said cartridge including:

an expendable material chamber for containing expendable material for use in image recording;

a first memory for storing cartridge discernment information;

said image recorder device including:

an image recorder section for recording an image to recording material;

a detector for detecting a decrease of a remaining amount of said expendable material to at most a reference amount, said expendable material being contained in said cartridge set in an exchangeable manner;

a second memory for storing said discernment information and shortage information representing shortage of said expendable material upon detecting said decrease of said remaining amount of said expendable material to at most said reference amount;

a determiner for checking whether said shortage information is stored in said second memory according to said discernment information read from said first memory, to determine said cartridge as said improper cartridge if said shortage information is stored in said second memory.

($18^{th}$ mode) A detector device for detecting an improper cartridge, comprising:

a measurer for measuring a characteristic of expendable material contained in a cartridge set in an exchangeable manner in an image recorder;

a memory for storing a range of said characteristic of said expendable material; and a determiner for reading said range from said memory, and for determining said cartridge as said improper cartridge reloaded with said expendable material if said characteristic being measured is out of said range.

($19^{th}$ mode) A detector device as defined in the $18^{th}$ mode, wherein if said cartridge is determined as said improper cartridge, said image recorder inhibits image recording operation.

($20^{th}$ mode) A detector device as defined in the $19^{th}$ mode, further comprising an indicator for indicating alarm information if said cartridge is determined as said improper cartridge.

($21^{st}$ mode) A detector device as defined in the $19^{th}$ mode, wherein upon setting of said cartridge in said image recorder, said determiner operates for determining impropriety.

($22^{nd}$ mode) A detector device as defined in the $19^{th}$ mode, wherein said characteristic is density of said expendable material, said measurer includes a light-emitting element and a photoreceptor element disposed in said cartridge, said light-emitting element applies light to either one of a developer roller and a photoreceptor drum with said expendable material stuck thereto, and said photoreceptor element detects light reflected by said either one for measurement of said density of said expendable material.

($23^{rd}$ mode) A detector device as defined in $22^{nd}$ mode, wherein said memory is incorporated in said cartridge.

($24^{th}$ mode) A detector device as defined in the $22^{nd}$ mode, wherein said range is defined to cover a value obtained by measuring said characteristic of said expendable material provided in said cartridge in manufacturing said cartridge, and said range of said characteristic is predetermined for respectively said cartridge.

($25^{th}$ mode) A detecting method of detecting an improper cartridge, comprising steps of:

measuring a characteristic of expendable material contained in a cartridge set in an exchangeable manner in an image recorder;

if said characteristic being measured is out of a predetermined range, determining impropriety of said cartridge reloaded with said expendable material.

($26^{th}$ mode) A detecting system for detecting an improper cartridge, comprising a cartridge and an image recorder device;

said cartridge including:

an expendable material chamber for containing expendable material for use in image recording;

a measurer for measuring a characteristic of said expendable material contained in said expendable material chamber;

a memory for storing a range of said characteristic of said expendable material;

said image recorder device including:

an image recorder section for recording an image to recording material;

a determiner for reading said range from said memory in said cartridge being set, and for determining said cartridge as said improper cartridge reloaded with said expendable material if said characteristic being measured is out of said range;

a controller for generating an alarm signal or for inhibiting image recording operation if said cartridge is determined as said improper cartridge.

($27^{th}$ mode) A detecting system for detecting an improper cartridge, comprising a cartridge and an image recorder device;

said cartridge including:

an expendable material chamber for containing expendable material for use in image recording;

a measurer for measuring a characteristic of said expendable material contained in said expendable material chamber;

a first memory for storing type information representing a cartridge type;

said image recorder device including:

an image recorder section for recording an image to recording material;

a second memory for storing a range of said characteristic for respectively said type information;

a determiner for reading said type information from said first memory in said cartridge being set, for reading said range from said second memory according to said type information, and for determining said cartridge as said improper cartridge reloaded with said expendable material if said characteristic being measured is out of said range;

a controller for generating an alarm signal or for inhibiting image recording operation if said cartridge is determined as said improper cartridge.

($28^{th}$ mode) A detecting system as defined in the $26^{th}$ or $27^{th}$ modes, wherein said cartridge includes:

a photoreceptor drum adapted to forming an electrostatic latent image;

a charger roller, supplied with power by a charger circuit, for charging said photoreceptor drum;

a developer roller for creating a toner image by developing said electrostatic latent image with toner.

($29^{th}$ mode) A recording medium for storing a program for being run in a computer for an image recorder, said program executing steps of:

measuring a characteristic of expendable material contained in a cartridge set in an exchangeable manner in said image recorder;

reading a range of said characteristic from a memory in said cartridge;

if said characteristic being measured is out of said range, determining impropriety of said cartridge reloaded with said expendable material.

($30^{th}$ mode) A recording medium for storing a program for being run in a computer for an image recorder, said program executing steps of:

measuring a characteristic of expendable material contained in a cartridge set in an exchangeable manner in said image recorder;

reading type information from a first memory in said cartridge, said type information representing a cartridge type of said cartridge;

reading a range of said characteristic from a second memory in said image recorder according to said type information;

if said characteristic being measured is out of said range, determining said cartridge as said improper cartridge reloaded with said expendable material.

($31^{st}$ mode) A detector device for detecting an improper cartridge, comprising:

a detector for detecting reloading of a cartridge with expendable material contained in a cartridge set in an exchangeable manner in an image recorder;

an accumulator for accumulating and storing a number of times of said reloading of said cartridge with said expendable material according to a signal from said detector;

a determiner for determining said cartridge as said improper cartridge if said accumulated number has come up to a reference number.

($32^{nd}$ mode) A detector device as defined in the $31^{st}$ mode, wherein if said cartridge is determined as said improper cartridge, said image recorder inhibits image recording operation.

($33^{rd}$ mode) A detector device as defined in the $32^{nd}$ mode, further comprising an alarm signal generator for generating an alarm signal if said cartridge is determined as said improper cartridge.

($34^{th}$ mode) A detector device as defined in the $32^{nd}$ mode, wherein said detector includes:

a measurer for measuring a remaining amount of said expendable material contained in said cartridge;

a memory for storing said remaining amount being measured;

said determiner comparing said remaining amount measured by said measurer with a remaining amount of said expendable material previously measured, said previously measured remaining amount being read from said memory, and if said remaining amount measured presently is greater, said determiner determining said reloading with said expendable material.

($35^{th}$ mode) A detector device as defined in the $34^{th}$ mode, wherein upon setting of said cartridge in said image recorder or upon turning on a power source for said image recorder, said detector and said determiner operate for detection of said reloading with said expendable material and for determination of impropriety.

($36^{th}$ mode) A detector device as defined in $35^{th}$ mode, wherein said memory is incorporated in said cartridge.

($37^{th}$ mode) A detector device as defined in the $36^{th}$ mode, wherein said determiner checks if said memory exists in said cartridge, and determines impropriety in case of lack of said memory.

($38^{th}$ mode) A detector device for detecting an improper cartridge, comprising:

a first memory, incorporated in a cartridge set in an exchangeable manner in an image recorder, for storing discernment information for discernment of said cartridge;

a detector for detecting reloading of said cartridge with expendable material contained in said cartridge;

an accumulator for accumulating and storing a number of times of said reloading of said cartridge with said expendable material according to a signal from said detector;

a second memory, incorporated in said image recorder, for storing said accumulated number from said accumulator with said discernment information;

a determiner for determining said cartridge as said improper cartridge if said accumulated number read from said second memory according to said discernment information is greater than a reference number.

($39^{th}$ mode) A detector device as defined in the $38^{th}$ mode, wherein if said cartridge is determined as said improper cartridge, said image recorder inhibits image recording operation.

($40^{th}$ mode) A detector device as defined in $39^{th}$ mode, further comprising an alarm signal generator for generating an alarm signal if said cartridge is determined as said improper cartridge.

($41^{st}$ mode) A detector device as defined in the $39^{th}$ mode, wherein said detector includes:

a measurer for measuring a remaining amount of said expendable material contained in said cartridge;

a memory for storing said remaining amount being measured;

said determiner comparing said remaining amount measured by said measurer with a remaining amount of said expendable material previously measured, said previously measured remaining amount being read from said memory, and if said remaining amount measured presently is greater, said determiner determining said reloading with said expendable material.

($42^{nd}$ mode) A detector device as defined in the $41^{st}$ mode, wherein upon setting of said cartridge in said image recorder or upon turning on a power source for said image recorder, said detector and said determiner operate for detection of said reloading with said expendable material and for determination of impropriety.

($43^{rd}$ mode) A detector device as defined in the $42^{nd}$ mode, wherein said determiner checks if said memory exists in said cartridge, and determines impropriety in case of lack of said memory.

($44^{th}$ mode) A detecting method of detecting an improper cartridge, comprising steps of:

obtaining a number of times of reloading of a cartridge with expendable material, said cartridge being set in an exchangeable manner in an image recorder;

if said obtained number has come up to a reference number, determining said cartridge as said improper cartridge.

($45^{th}$ mode) A detecting method as defined in the $44^{th}$ mode, further comprising a step of, if said cartridge is determined as said improper cartridge, indicating alarm information or inhibiting said image recorder from image recording operation.

($46^{th}$ mode) A cartridge for being set in an image recorder in an exchangeable manner, and provided with a predetermined amount of expendable material therein during manufacture, comprising:

a memory for storing a number of times of reloading with said expendable material.

($47^{th}$ mode) A recording medium for storing a program for being run in a computer for an image recorder, said program including:

a detecting function for detecting reloading of a cartridge with expendable material, said cartridge being set in an exchangeable manner in said image recorder;

an obtaining function for obtaining a number of times of said reloading of said cartridge with said expendable material;

a writing function for writing said obtained number to a memory;

a determining function for determining impropriety of said cartridge if said obtained number has come up to a reference number.

(48$^{th}$ mode) A recording medium for storing a program for being run in a computer for an image recorder, said program including:

a reading function for reading discernment information for discernment of a cartridge from a first memory in said cartridge, said cartridge being set in an exchangeable manner in said image recorder;

a detecting function for detecting reloading of said cartridge with expendable material contained in said cartridge;

an obtaining function for obtaining a number of times of said reloading of said cartridge with said expendable material;

a writing function for writing said obtained number to a second memory in said image recorder with said discernment information;

a determining function for determining said cartridge as said improper cartridge if said obtained number read from said second memory has come up to at least a reference number.

(49$^{th}$ mode) A detecting system for detecting an improper cartridge, comprising a cartridge and an image recorder device;

said cartridge including:

an expendable material chamber for containing expendable material for use in image recording;

a memory for storing a number of times of reloading of said cartridge with said expendable material;

said image recorder device including:

an image recorder section for recording an image to recording material;

a reloading detector for detecting said reloading of said cartridge with said expendable material, said cartridge being set in an exchangeable manner;

an arithmetic unit for obtaining a number of times of said reloading according to a signal from said reloading detector;

a writer for writing said obtained number to said memory;

a determiner for determining said cartridge as said improper cartridge if said obtained number read from said memory has come up to a reference number.

(50$^{th}$ mode) A detecting system for detecting an improper cartridge, comprising a cartridge and an image recorder device;

said cartridge including:

an expendable material chamber for containing expendable material for use in image recording;

a memory for storing cartridge discernment information;

said image recorder device including:

an image recorder section for recording an image to recording material;

a reloading detector for detecting reloading of said cartridge with said expendable material, said cartridge being set in an exchangeable manner;

an arithmetic unit for obtaining a number of times of said reloading according to a signal from said reloading detector;

a second memory for storing said obtained number with said discernment information;

a determiner for determining said cartridge as said improper cartridge if said obtained number read from said second memory has come up to a reference number.

(51$^{st}$ mode) A detecting system as defined in the 49$^{th}$ or 50$^{th}$ modes, wherein said reloading detector includes:

a measurer for measuring a remaining amount of said expendable material contained in said expendable material chamber;

a writer for writing said remaining amount measured by said measurer to said memory or said second memory;

said determiner comparing said remaining amount measured by said measurer with a remaining amount of said expendable material previously measured, said previously measured remaining amount being read from said memory or said second memory, and if said remaining amount measured presently is greater, said determiner determining said reloading with said expendable material.

(52$^{nd}$ mode) An inhibitor device for inhibiting a use of a cartridge set in an exchangeable manner in an image recorder, comprising:

an expendable material measurer for measuring a remaining amount of expendable material contained in said cartridge;

a determiner for determining said cartridge as used if said remaining amount has come down to at most a reference amount;

an inhibitor for disabling said cartridge from operating upon determining said cartridge as used, to inhibit said use thereof.

(53$^{rd}$ mode) An inhibitor device as defined in the 52$^{nd}$ mode, further comprising an alarm signal generator for generating an alarm signal if said cartridge is determined as used.

(54$^{th}$ mode) An inhibitor device as defined in the 52$^{nd}$ mode, wherein said cartridge includes:

a photoreceptor drum adapted to forming an electrostatic latent image;

a charger roller, supplied with power by a charger circuit, for charging said photoreceptor drum;

a developer roller for creating a toner image by developing said electrostatic latent image with toner.

(55$^{th}$ mode) An inhibitor device as defined in the 54$^{th}$ mode, wherein said expendable material measurer includes:

a rotation detector for detecting rotations of said photoreceptor drum, said charger roller or said developer roller;

a memory for storing a cumulative number of rotations according to a signal from said rotation detector, said cumulative number being adapted to estimate said remaining amount.

(56$^{th}$ mode) An inhibitor device as defined in the 55$^{th}$ mode, wherein said inhibitor comprises a shutter movable between a closed position to close an exposure opening and an open position to open said exposure opening, for moving to said closed position if said cartridge is determined as used, said exposure opening introducing light to said photoreceptor drum.

(57$^{th}$ mode) An inhibitor device as defined in the 55$^{th}$ mode, wherein said inhibitor comprises a switch, connected in a line through which said charger circuit supplies power, for disconnecting said line if said cartridge is determined as used.

(58$^{th}$ mode) An inhibitor device as defined in the 55$^{th}$ mode, wherein said inhibitor comprises a lock mechanism for blocking rotations of said photoreceptor drum, said charger roller or said developer roller if said cartridge is determined as used.

(59$^{th}$ mode) An inhibitor device as defined in the 55$^{th}$ mode, wherein if said cartridge is determined as used, said inhibitor electrically destroys an electrical part in said cartridge.

($60^{th}$ mode) A cartridge for being set in an image recorder in an exchangeable manner, and having an expendable material chamber for containing expendable material for image recording, comprising:

an expendable material measurer for measuring a remaining amount of said expendable material directly or indirectly;

a determiner for determining a cartridge used state if said remaining amount has come down to at most a reference amount;

an inhibitor for disabling a cartridge operation upon determining said cartridge used state, to inhibit a use.

($61^{st}$ mode) A cartridge as defined in the $60^{th}$ mode, further comprising an alarm signal generator for generating an alarm signal if said cartridge used state is determined.

($62^{nd}$ mode) A cartridge as defined in the $60^{th}$ mode, further comprising:

a photoreceptor drum adapted to forming an electrostatic latent image;

a charger roller, supplied with power by a charger circuit, for charging said photoreceptor drum;

a developer roller for creating a toner image by developing said electrostatic latent image with toner.

($63^{rd}$ mode) A cartridge as defined in the $62^{nd}$ mode, wherein said expendable material measurer includes:

a rotation detector for detecting rotations of said photoreceptor drum, said charger roller or said developer roller;

an accumulator for obtaining a cumulative number of rotations according to a signal from said rotation detector, said cumulative number being adapted to estimate said remaining amount.

($64^{th}$ mode) A cartridge as defined in the $63^{rd}$ mode, wherein said inhibitor comprises a shutter movable between a closed position to close an exposure opening and an open position to open said exposure opening, for moving to said closed position if said cartridge used state is determined, said exposure opening introducing light to said photoreceptor drum.

($65^{th}$ mode) A cartridge as defined in the $63^{rd}$ mode, wherein said inhibitor comprises a switch, connected in a line through which said charger circuit supplies power, for disconnecting said line if said cartridge used state is determined.

($66^{th}$ mode) A cartridge as defined in the $63^{rd}$ mode, wherein said inhibitor comprises a lock mechanism for blocking rotations of said photoreceptor drum, said charger roller or said developer roller if said cartridge used state is determined.

($67^{th}$ mode) A cartridge as defined in the $63^{rd}$ mode, wherein if said cartridge used state is determined, said inhibitor electrically destroys a cartridge electrical part.

($68^{th}$ mode) An inhibiting method of inhibiting a use of a cartridge set in an exchangeable manner in an image recorder, comprising steps of:

obtaining a remaining amount of expendable material contained in said cartridge;

if said remaining amount has come down to at most a reference amount, determining said cartridge as used;

upon determining said cartridge as used, disabling said cartridge from operating to inhibit said use thereof.

($69^{th}$ mode) An inhibiting system for inhibiting a use of a cartridge, comprising a cartridge and an image recorder device;

said cartridge including:

an expendable material chamber for containing expendable material for use in image recording;

an expendable material measurer for measuring a remaining amount of expendable material;

an inhibitor for disabling a cartridge operation upon determining a cartridge used state, to inhibit said use;

said image recorder device including:

an image recorder section for recording an image to recording material;

a determiner for determining said cartridge as used if said remaining amount has come down to at most a reference amount, and for operating said inhibitor, said cartridge being set in an exchangeable manner.

($70^{th}$ mode) A recording medium for storing a program for being run in a computer for an image recorder, said program executing steps of:

measuring a remaining amount of expendable material contained in a cartridge set in an exchangeable manner in said image recorder;

if said remaining amount has come down to at most a reference amount, determining said cartridge as used;

upon determining said cartridge as used, disabling said cartridge from operating to inhibit said use thereof.

($71^{st}$ mode) A cartridge for being set in an image recorder in an exchangeable manner, and having an expendable material chamber for containing expendable material for image recording, comprising:

a detector for detecting a cartridge state of being disassembled;

an inhibitor for disabling a cartridge operation upon receipt of a signal from said detector, to inhibit a use.

($72^{nd}$ mode) A cartridge as defined in the $71^{st}$ mode, further comprising an alarm signal generator for generating an alarm signal if said cartridge disassembled state is detected.

($73^{rd}$ mode) A cartridge as defined in the $71^{st}$ mode, further comprising:

a photoreceptor drum adapted to forming an electrostatic latent image;

a charger roller, supplied with power by a charger circuit, for charging said photoreceptor drum;

a developer roller for creating a toner image by developing said electrostatic latent image with toner.

($74^{th}$ mode) A cartridge as defined in the $73^{rd}$ mode, wherein said inhibitor comprises a shutter movable between a closed position to close an exposure opening and an open position to open said exposure opening, for moving to said closed position if said cartridge disassembled state is detected, said exposure opening introducing light to said photoreceptor drum.

($75^{th}$ mode) A cartridge as defined in the $73^{rd}$ mode, wherein said inhibitor comprises a switch, connected in a line through which said charger circuit supplies power, for disconnecting said line if said cartridge disassembled state is detected.

($76^{th}$ mode) A cartridge as defined in the $73^{rd}$ mode, wherein said inhibitor comprises a lock mechanism for blocking rotations of said photoreceptor drum, said charger roller or said developer roller if said cartridge disassembled state is detected.

($77^{th}$ mode) A cartridge as defined in the $73^{rd}$ mode, wherein if said cartridge disassembled state is detected, said inhibitor electrically destroys a cartridge electrical part.

($78^{th}$ mode) An inhibiting method of inhibiting a use of a cartridge set in an exchangeable manner in an image recorder, comprising steps of:

detecting that said cartridge is disassembled;

upon detecting that said cartridge is disassembled, disabling said cartridge from operating to inhibit said use thereof.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A checking device for checking a cartridge, comprising:

a writer for writing removal information in a memory provided in said cartridge when said cartridge is removed from a main unit of an image forming apparatus, said removal information representing removal of said cartridge from said main unit, said cartridge, exchangeably loaded in said image forming apparatus, for containing expendable material for use in image forming;

checking means for checking existence of said removal information in said memory; and a determiner for determining said cartridge as an improper cartridge if said removal information is stored in said memory, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

2. A checking device as claimed in claim 1, wherein said memory is separably attached to said cartridge.

3. A checking device as claimed in claim 1, wherein said memory is removably or exchangeably provided in said cartridge.

4. A checking device as claimed in claim 1, wherein said expendable material comprises toner or ink.

5. A checking device as claimed in claim 1, wherein said removal information is written in said memory in a ciphered form.

6. A recording medium for storing a program to execute processes in a computer of an image forming apparatus, said process comprising:

writing removal information in a memory, separably provided in a cartridge, when said cartridge is removed from a main unit of said image forming apparatus, said removal information representing removal of said cartridge from said main unit, said cartridge being exchangeably loaded in said image forming apparatus;

checking existence of said removal information in said memory; and determining said cartridge as an improper cartridge if said removal information is stored in said memory, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

7. A recording medium as claimed in claim 6, wherein said cartridge contains expendable material for use in image forming.

8. A recording medium as claimed in claim 7, wherein said expendable material comprises toner or ink.

9. A recording medium as claimed in claim 6, wherein said removal information is written in said memory in a ciphered form.

10. An image forming apparatus comprising:

an apparatus main unit in which a cartridge is loaded exchangeably, said cartridge having a memory, provided in a cartridge body, for storing removal information representing removal of said cartridge from said apparatus main unit, said cartridge body containing expendable material for use in image forming;

a writer for writing said removal information in said memory when said cartridge is removed from said apparatus main unit;

a checking means for checking existence of said removal information in said memory; and a determiner for determining said cartridge as an improper cartridge if said removal information is stored in said memory.

11. An image forming apparatus as claimed in claim 10, wherein said memory is separably attached to said cartridge.

12. An image forming apparatus as claimed in claim 10, wherein said memory is removably or exchangeably provided in said cartridge.

13. An image forming apparatus as claimed in claim 10, wherein said expendable material comprises toner or ink.

14. An image forming apparatus as claimed in claim 10, wherein said removal information is written in said memory in a ciphered form.

15. An image forming apparatus as claimed in claim 10, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

16. A checking device for checking a cartridge, comprising:

a writer for writing shortage information in a memory provided in said cartridge when expendable material contained in said cartridge runs short, said shortage information representing shortage of expendable material in said cartridge, said cartridge, exchangeably loaded in an image forming apparatus, for containing said expendable material for use in image forming;

checking means for checking existence of said shortage information in said memory; and a determiner for determining said cartridge as an improper cartridge if said shortage information is stored in said memory, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

17. A checking device as claimed in claim 16, wherein said memory is separably attached to said cartridge.

18. A checking device as claimed in claim 16, wherein said memory is removably or exchangeably provided in said cartridge.

19. A checking device as claimed in claim 16, wherein said expendable material comprises toner or ink.

20. A checking device as claimed in claim 16, wherein said shortage information is written in said memory in a ciphered form.

21. An image forming apparatus comprising:

an apparatus main unit in which a cartridge is loaded exchangeably, said cartridge having a memory, provided in a cartridge body, for storing shortage information representing shortage of expendable material contained in said cartridge, said cartridge body containing said expendable material for use in image forming;

a writer for writing said shortage information in said memory when said expendable material runs short;

a checking means for checking existence of said shortage information in said memory; and a determiner for determining said cartridge as an improper cartridge if said shortage information is stored in said memory.

22. An image forming apparatus as claimed in claim 21, wherein said memory is separably attached to said cartridge.

23. An image forming apparatus as claimed in claim 21, wherein said memory is removably or exchangeably provided in said cartridge.

24. An image forming apparatus as claimed in claim 21, wherein said expendable material comprises toner or ink.

25. An image forming apparatus as claimed in claim 21, wherein said shortage information is written in said memory in a ciphered form.

26. An image forming apparatus as claimed in claim 21, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

27. A cartridge comprising:

a photoreceptor drum adapted for forming an electrostatic latent image;

a charger roller, supplied with power by a charger circuit, for charging said photoreceptor drum;

a developer roller for creating a toner image by developing said electrostatic latent image with toner;

an expendable material chamber for containing expendable material adapted to image forming; and a cartridge memory configured to accept shortage information representing depletion of said expendable material and removal information representing removal of said cartridge from an image forming apparatus.

28. A cartridge as claimed in claim 27, wherein said cartridge memory is separably attached.

29. A cartridge as claimed in claim 27, wherein said cartridge memory is removably or exchangeably provided.

30. A cartridge as claimed in claim 27, wherein said expendable material comprises toner or ink.

31. A cartridge as claimed in claim 27, wherein said shortage information and said removal information is written in said cartridge memory in a ciphered form.

32. A detector device for detecting an improper cartridge, comprising:

a detector for detecting when a remaining amount of expendable material becomes equal to or less than a reference amount, said expendable material being contained in a cartridge set in an image forming apparatus in an exchangeable manner;

a cartridge memory, incorporated in said cartridge, for storing shortage information of shortage of said expendable material after being used up;

a writer, operated responsively if said detector detects that said remaining amount has become said reference amount or less, for writing said shortage information to said cartridge memory, further said writer, operated responsively upon operation of removal of said cartridge from said image forming apparatus, for writing removal information to said cartridge memory; and a determiner, operated responsively if said cartridge memory stores said shortage information and stores said removal information, for determining said cartridge as said improper cartridge, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

33. A detector device as claimed in claim 32, wherein said cartridge memory is separably attached to said cartridge.

34. A detector device as claimed in claim 32, wherein said cartridge memory is removably or exchangeably provided in said cartridge.

35. A detector device as claimed in claim 32, wherein said expendable material comprises toner or ink.

36. A detector device as claimed in claim 32, wherein said shortage information and said removal information is written in said cartridge memory in a ciphered form.

37. A detecting method of detecting whether a cartridge set in an image forming apparatus in an exchangeable manner is an improper cartridge, comprising steps of:

measuring a remaining amount of expendable material in said cartridge;

if it is detected that said remaining amount has become equal to or less than a reference amount, writing shortage information to a cartridge memory in said cartridge upon operation of removal of said cartridge from said image forming apparatus, said shortage information representing shortage of said expendable material after being used up;

if said cartridge is associated with said shortage information, determining said cartridge as said improper cartridge upon reusing; and if said cartridge is determined as said improper cartridge, generating an alarm signal, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

38. A detecting method as claimed in claim 37, further comprising the step of:

if said cartridge is determined as said improper cartridge, inhibiting operation of image forming.

39. A detecting method of detecting whether a cartridge set in an image forming apparatus in an exchangeable manner is an improper cartridge, comprising steps of:

measuring a remaining amount of expendable material in said cartridge;

if it is detected that said remaining amount has become equal to or less than a reference amount, writing shortage information to a cartridge memory in said cartridge, said shortage information representing shortage of said expendable material after being used up;

upon operation of removal of said cartridge from said image forming apparatus, writing removal information of said removal to said cartridge memory;

if said cartridge is associated with said shortage information and said removal information, determining said cartridge as said improper cartridge upon reusing; and if said cartridge is determined as said improper cartridge, generating an alarm signal, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

40. A detecting method as claimed in claim 39, further comprising the step of:

if said cartridge is determined as said improper cartridge, inhibiting operation of image forming.

41. A recording medium for storing a program to execute processes in a computer for an image forming apparatus, said processes comprising:

detecting when a remaining amount of expendable material becomes equal to or less than a reference amount, said expendable material being contained in a cartridge set in said image forming apparatus in an exchangeable manner;

if it is detected that said remaining amount has become said reference amount or less, writing shortage information of shortage of said expendable material to a cartridge memory in said cartridge;

if said cartridge memory stores said shortage information, determining said cartridge as improper, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

42. A recording medium as claimed in claim 41, wherein said cartridge memory is separably attached to said cartridge.

43. A recording medium as claimed in claim 41, wherein said cartridge memory is removably or exchangeably provided in said cartridge.

44. A recording medium as claimed in claim 41, wherein said expendable material comprises toner or ink.

45. A recording medium as claimed in claim 41, wherein said shortage information is written in said cartridge memory in a ciphered form.

46. A recording medium for storing a program to execute processes in a computer for an image forming apparatus, said processes comprising:

detecting when a remaining amount of expendable material becomes equal to or less than a reference amount, said expendable material being contained in a cartridge set in said image forming apparatus in an exchangeable manner;

if it is detected that said remaining amount has become equal to or less than said reference amount, writing shortage information to a cartridge memory in said cartridge, said shortage information representing shortage of said expendable material after being used up;

upon operation of removal of said cartridge from said image forming apparatus, writing removal information of said removal to said cartridge memory; and if said cartridge is associated with said shortage information and said removal information, determining said cartridge as improper upon reusing, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

47. A recording medium as claimed in claim 46, wherein said cartridge memory is separably attached to said cartridge.

48. A recording medium as claimed in claim 46, wherein said cartridge memory is removably or exchangeably provided in said cartridge.

49. A recording medium as claimed in claim 46, wherein said expendable material comprises toner or ink.

50. A recording medium as claimed in claim 46, wherein said shortage information and said removal information is written in said cartridge memory in a ciphered form.

51. An improper cartridge detecting system, comprising a cartridge and an image forming apparatus in which said cartridge is set in an exchangeable manner;

said cartridge including an expendable material chamber for containing expendable material adapted to image forming, and a cartridge memory for storing shortage information of shortage of said expendable material after being used up;

said image forming apparatus including:

an image forming unit for image forming to a recording sheet;

a detector for detecting when a remaining amount of said expendable material in said cartridge becomes equal to or less than a reference amount;

a writer, operated responsively if it is detected that said remaining amount has become said reference amount or less, for writing shortage information of shortage of said expendable material after being used up to said cartridge memory; and a determiner for checking whether said cartridge memory stores said shortage information, and for, if said cartridge memory stores said shortage information, determining said cartridge as improper, wherein said cartridge comprises:

a photoreceptor drum adapted for forming an electrostatic latent image;

a charger roller, supplied with power by a charger circuit, for charging said photoreceptor drum; and a developer roller for creating a toner image by developing said electrostatic latent image with toner.

52. An improper cartridge detecting system as claimed in claim 51, wherein said cartridge memory is separably attached to said cartridge.

53. An improper cartridge detecting system as claimed in claim 51, wherein said cartridge memory is removably or exchangeably provided in said cartridge.

54. An improper cartridge detecting system as claimed in claim 51, wherein said expendable material comprises toner or ink.

55. An improper cartridge detecting system as claimed in claim 51, wherein said shortage information is written in said cartridge memory in a ciphered form.

56. An improper cartridge detecting system, comprising a cartridge and an image forming apparatus in which said cartridge is set in an exchangeable manner;

said cartridge including an expendable material chamber for containing expendable material adapted to image forming, and a cartridge memory for storing shortage information of shortage of said expendable material after being used up;

said image forming apparatus including:

an image forming unit for image forming to a recording sheet;

a detector for detecting when a remaining amount of said expendable material in said cartridge becomes equal to or less than a reference amount;

a first writer, operated responsively if it is detected that said remaining amount has become said reference amount or less, for writing shortage information of shortage of said expendable material after being used up to said cartridge memory;

a second writer for writing removal information to said cartridge memory, said removal information representing a removed state of said cartridge from an apparatus main unit;

a determiner for checking whether said cartridge memory stores said shortage information and said removal information, and for, if said cartridge memory stores said shortage information and said removal information, determining said cartridge as improper, wherein said cartridge comprises:

a photoreceptor drum adapted for forming an electrostatic latent image:

a charger roller, supplied with power by a charger circuit, for charging said photoreceptor drum; and a developer roller for creating a toner image by developing said electrostatic latent image with toner.

57. An improper cartridge detecting system as claimed in claim 56, wherein said cartridge memory is separably attached to said cartridge.

58. An improper cartridge detecting system as claimed in claim 56, wherein said cartridge memory is removably or exchangeably provided in said cartridge.

59. An improper cartridge detecting system as claimed in claim 56, wherein said expendable material comprises toner or ink.

60. An improper cartridge detecting system as claimed in claim 56, wherein said shortage information and said removal information is written in said cartridge memory in a ciphered form.

* * * * *